US006995326B2

(12) United States Patent
Sugimura et al.

(10) Patent No.: US 6,995,326 B2
(45) Date of Patent: Feb. 7, 2006

(54) INPUT KEY AND INPUT APPARATUS

(75) Inventors: Toshiaki Sugimura, Yokohama (JP); Masaaki Fukumoto, Yokohama (JP); Takashi Ninjouji, Yokohama (JP)

(73) Assignee: NTT DoCoMo, Inc., Tokyo (JP)

( * ) Notice: Subject to any disclaimer, the term of this patent is extended or adjusted under 35 U.S.C. 154(b) by 40 days.

(21) Appl. No.: 11/000,227

(22) Filed: Dec. 1, 2004

(65) Prior Publication Data

US 2005/0167251 A1 Aug. 4, 2005

(30) Foreign Application Priority Data

Jan. 30, 2004 (JP) ..... 2004-024165
Jan. 30, 2004 (JP) ..... 2004-024193
Oct. 6, 2004 (JP) ..... 2004-294230

(51) Int. Cl.
*H01H 9/00* (2006.01)

(52) U.S. Cl. ..... 200/5 R; 200/6 A; 200/4; 345/159

(58) Field of Classification Search ..... 200/5 R, 200/5 A, 6 A, 4, 18; 345/156–160
See application file for complete search history.

(56) References Cited

U.S. PATENT DOCUMENTS 4,514,600 A * 4/1985 Lentz ..... 200/5 R
5,468,924 A * 11/1995 Naitou et al. ..... 200/6 A
5,691,517 A * 11/1997 Yamamoto et al. ..... 200/6 A
5,744,765 A * 4/1998 Yamamoto ..... 200/6 A
5,952,628 A * 9/1999 Sato et al. ..... 200/4
5,952,631 A * 9/1999 Miyaki ..... 200/6 A
6,266,046 B1 * 7/2001 Arita ..... 345/156
6,399,904 B1 * 6/2002 Mimata ..... 200/6 A
6,613,990 B2 * 9/2003 Kawasaki ..... 200/6 A

FOREIGN PATENT DOCUMENTS

JP 2003-296001 10/2003

* cited by examiner

*Primary Examiner*—K. Lee
(74) *Attorney, Agent, or Firm*—Oblon, Spivak, McClelland, Maier & Neustadt, PC

(57) ABSTRACT

An input key which is assigned a plurality of information items to be inputted, of the present invention, includes a key top which can incline relative to a support plate for supporting the input key; a key top supported portion provided on an opposite surface in the key top to the support plate and arranged to be pushed together with the key top; a key top supporting portion provided on the support plate, and arranged to come into contact with the key top supported portion during a push on the key top and to support the key top supported portion so as to permit the key top to incline in a state of the contact with the key top supported portion; at least one inclination detector provided in a direction assigned one of the information items to be inputted, on an opposite surface in the support plate to the key top or on the opposite surface in the key top to the support plate; push detecting means for detecting a push on the input key; and inclination direction detecting means for detecting an inclination direction of the key top when the push detecting means detects a push on the input key.

12 Claims, 58 Drawing Sheets

*Fig.12*

| | | |
|---|---|---|
| | D | |
| B | A | C |
| | E | |

Fig.13

| DIRECTION | CONDITION |
|---|---|
| CENTER | $t_A > T_A$,<br>$r_{AB}, r_{AC}, r_{AD}, r_{AE} \leq R_A$ |
| LEFT | $t_B > T_B$,<br>$r_{AB} > \alpha$,<br>$r_{BC}, r_{BD}, r_{BE} \leq R_B$ |
| RIGHT | $t_C > T_C$,<br>$r_{AC} > \alpha$,<br>$r_{CB}, r_{CD}, r_{CE} \leq R_C$ |
| UP | $t_D > T_D$,<br>$r_{AD} > \alpha$,<br>$r_{DB}, r_{DC}, r_{DE} \leq R_D$ |
| DOWN | $t_E > T_E$,<br>$r_{AE} > \alpha$,<br>$r_{EB}, r_{EC}, r_{ED} \leq R_E$ |

*Fig.14*

| KEY | DIRECTION | SYMBOL |
|---|---|---|
| KEY 10a | CENTER | お |
| | UP | あ |
| | RIGHT | い |
| | DOWN | う |
| | LEFT | え |

Fig.50

| KEY No. | K1 | K2 | K3 | K4 | K5 | K6 | K7 | K8 | K9 | K10 | K11 | K12 |
|---|---|---|---|---|---|---|---|---|---|---|---|---|
| CENTER | あ | か | さ | た | な | は | ま | や | ら | を | ん | DOWNSHIFT |
| UP | い | き | し | ち | に | ひ | み | ゐ | り | わ | (JAPANESE COMMA) | CONVERSION TO VOICED CONSONANT |
| DOWN | う | く | す | つ | ぬ | ふ | む | ゆ | る | ー (LONG SOUND) | (JAPANESE PERIOD) | CONVERSION TO P-SOUND |
| LEFT | え | け | せ | て | ね | へ | め | ゑ | れ | ? | (COMMA) | CONVERSION TO SMALL KATAKANA |
| RIGHT | お | こ | そ | と | の | ほ | も | よ | ろ | ! | (CENTERED DOT) | CONVERSION TO LARGE KATAKANA |

*Fig.51*

| KEY No. | K1 | K2 | K3 | K4 | K5 | K6 | K7 | K8 | K9 | K10 | K11 | K12 |
|---|---|---|---|---|---|---|---|---|---|---|---|---|
| CENTER | A | F | K | P | U | Z | , | . | ? | : | ; | — |
| UP | B | G | L | Q | V | CR | ' | + | @ | { | < | = |
| DOWN | C | H | M | R | W | TAB | " | * | $ | } | > | ~ |
| LEFT | D | I | N | S | X | [ | ` | / | ¥ | ( | Back Space | – |
| RIGHT | E | J | O | T | Y | ] | # | % | & | ) | ESC | \| |

Fig.53

(a)

| KEY No. | K1 | K2 | K3 | K4 | K5 |
|---|---|---|---|---|---|
| CENTER | b | h | n | i | z |
| UP | c | j | p | t | zh |
| DOWN | ch | k | q | w | |
| LEFT | f | l | r | x | |
| RIGHT | g | m | s | y | |

(b)

| KEY No. | K1 | K2 | K3 | K4 | K5 | K6 | K7 |
|---|---|---|---|---|---|---|---|
| CENTER | a | e | i | in | ong | ia | uo |
| UP | ai | ei | iang | uai | iu | uan | o |
| DOWN | an | en | uang | ing | ou | ui | u |
| LEFT | ang | eng | iao | ng | u | ue | ue |
| RIGHT | ao | er | ie | iong | ua | un | |

Fig.54

| KEY No. | K1 | K2 | K3 | K4 | K5 | K6 | K7 | K8 |
|---|---|---|---|---|---|---|---|---|
| CENTER | ㄱ | ㄲ | ㄴ | ㄷ | ㅓ | ㅐ | ㅏ | ㅐ |
| UP | ㄷ | ㄹ | ㅁ | ㅂ | ㅗ | ㅔ | ㅑ | ㅔ |
| DOWN | ㅃ | ㅅ | ㅆ | ㅇ | ㅛ | ㅘ | ㅙ | ㅚ |
| LEFT | ㅈ | ㅉ | ㅊ | ㅋ | ㅜ | ㅝ | ㅓㅣ | ㅞ |
| RIGHT | ㅌ | ㅍ | ㅎ | ㅏ | ㅡ | ㅠ | ㅡ | ㅢ |

163

INPUT KEY AND INPUT APPARATUS

BACKGROUND OF THE INVENTION

1. Field of the Invention

The present invention relates to an input apparatus having at least one input key assigned a plurality of information items to be inputted, and to the input key.

2. Related Background Art

The portable terminals such as cell phones need to be compact enough to be carried by users. For this reason, where the portable terminals are provided with a keyboard, the number of keys in the keyboard is often much smaller than that in the so-called full keyboard.

In the case as described above, it is common practice to assign one key a plurality of symbols. A conventionally proposed method of inputting a plurality of symbols through one key is to detect a direction of a force exerted on the key and input an independent symbol by the direction. For example, Japanese Patent Application Laid-Open No. 2003-296001 discloses the following technology of detecting the direction of the push on the key, for substantializing this idea. This technology is such that switches and protruding portions according to push directions are provided inside the key, and with a push, a protruding portion turns on a switch according to a direction of the push, thereby detecting the direction of the push.

SUMMARY OF THE INVENTION

However, the above method requires a considerably careful operation to avoid actuation of the switch in the central direction (vertical direction) during a push in the forward, backward, left, or right direction, and there is thus still room for improvement in an aspect of operability.

The present invention has been accomplished in order to solve the above problem and an object of the present invention is to provide an input key and an input apparatus superior in operability.

In order to achieve the above object, an input key according to the present invention is an input key which is assigned a plurality of information items to be inputted, comprising: a key top which can incline relative to a support plate for supporting the input key; a key top supported portion provided on an opposite surface in the key top to the support plate and arranged to be pushed together with the key top; a key top supporting portion provided on the support plate, and arranged to come into contact with the key top supported portion during a push on the key top and to support the key top supported portion so as to permit the key top to incline in a state of the contact with the key top supported portion; at least one inclination detector provided in a direction assigned one of the information items to be inputted, on an opposite surface in the support plate to the key top or on the opposite surface in the key top to the support plate; push detecting means for detecting a push on the input key; and inclination direction detecting means for detecting an inclination direction of the key top when the push detecting means detects a push on the input key. Here the term "information items to be inputted" includes information generally assigned to each of input keys in the so-called full keyboard, e.g., information such as symbols, numbers, and marks, information of the linefeed code and control code, and so on.

A user of the input key according to the present invention pushes an input key corresponding to an information item to be inputted, while inclining a key top of the input key in a direction corresponding to the information item to be inputted. In the input key, first the push brings the key top supported portion into contact with the key top supporting portion to establish a supported state. Subsequently, the key top inclines into the direction in which the user inclines it, in the supported state (a stable state with the key top supporting portion and the key top supported portion serving as an axis). This causes an inclination detector corresponding to the direction of the inclination to come into contact with a surface opposed to the inclination detector (e.g., the support plate, or the opposite surface on the key top side (or the key top supported portion)).

Then the push detecting means detects the push on the input key. When the push is detected, the inclination direction detecting means detects the contact of the inclination detector with the surface on the opposite side. This makes it feasible to specify information corresponding to the direction of the inclination of the key top by the user (an information item to be inputted). The detection by the inclination direction detecting means (the detection of the contact of the inclination detector with the opposite surface) is implemented, for example, by the following method. Describing an example of the contact of the inclination detector with the support plate, an electrode to conduct electricity upon the contact of the inclination detector with the support plate is embedded in the support plate and the electric conduction is detected to detect the contact of the inclination detector with the opposite surface. In another configuration, a button or a switch or the like is provided at the contact part in the support plate in contact with the inclination detector and a push on the button or the switch or the like is detected. In still another configuration, a piezoelectric device or a strain gage or the like is provided at the contact part in the support plate in contact with the inclination detector and the push is detected by the piezoelectric device or the strain gage or the like. The foregoing "means for detecting the contact" such as the electrode to conduct electricity upon the contact, the button, the switch, the piezoelectric device, and the strain gage will be referred to hereinafter as "contact detecting means".

As described above, the present invention enables stabler input based on the inclination of the key top around the axis on the key top supported portion and the key top supporting portion arranged to contact each other upon a push on the key top, thereby achieving better operability.

More specifically, the input key according to the present invention preferably has a configuration wherein the inclination detector is of such a protruding shape as to facilitate contact with the surface opposite to the surface where the inclination detector is provided, and wherein the inclination direction detecting means detects the contact of the inclination detector with the opposite surface to detect the inclination direction of the key top.

The input key according to the present invention also preferably has a configuration wherein the inclination detector is comprised of one or two out of: a key-top-side slope portion forming a part of the opposite surface in the key top to the support plate and formed so as to increase distance to the support plate from the interior side toward the exterior side; and a support-plate-side slope portion forming a part of the opposite surface in the support plate to the key top and formed so as to increase distance to the key top from the interior side toward the exterior side; and wherein the inclination direction detecting means detects contact of the inclination detector with the opposite surface to detect the inclination direction of the key top.

The input key according to the present invention also preferably has a configuration further comprising a key top periphery supporting portion formed of an elastically deformable material and arranged to support a peripheral portion in the key top so as to keep the distance substantially constant between the key top and the support plate.

The input key according to the present invention also preferably has a configuration wherein the inclination detector is provided on the opposite surface in the key top to the support plate, and wherein when the key top is inclined during a push on the key top, the key top supported portion comes into contact with the key top supporting portion to be supported by the key top supporting portion and the inclination detector comes into contact with the support plate.

The input key according to the present invention also preferably has a configuration wherein the inclination detector is provided on the opposite surface in the support plate to the key top, and wherein when the key top is inclined during a push on the key top, the key top supported portion comes into contact with the key top supporting portion to be supported by the key top supporting portion and the inclination detector comes into contact with the key-top-side opposite surface or with the key top supported portion.

More specifically, the input key according to the present invention preferably has a configuration wherein one of the key top supported portion and the key top supporting portion is of a convex shape and the other is of a concave shape. The above shapes enable securer support between the key top supported portion and the key top supporting portion, and the key top supported portion and the key top supporting portion function as an axis during the inclination of the key top, thereby enabling smoother inclination.

More specifically, the input key according to the present invention preferably has a configuration wherein contact detecting means for detecting contact is placed on both or either one of the inclination detector, and a surface with which the inclination detector comes into contact during an inclination of the key top, and wherein the inclination direction detecting means detects the contact of the inclination detector with the foregoing surface by the contact detecting means to detect the inclination direction of the key top. In particular, a button, a switch, a piezoelectric device, a strain gage, or the like may be placed on both or one of the inclination detector, and the surface to contact the inclination detector; or the both surfaces may be provided with electrodes to conduct electricity upon the contact. The piezoelectric device as an example of the contact detecting means is a device that generates a voltage upon occurrence of stress and is able to detect a pressure due to a push of the inclination detector. In the "arrangement" of the piezoelectric device, the piezoelectric device may be attached onto the both or one of the inclination detector and the surface to contact it or may be embedded in the both or one of the inclination detector and the surface to contact it.

The input key according to the present invention also preferably has a configuration wherein the support plate is formed of an elastically deformable material. Namely, when the user pushes the input key, the key top supported portion pushes the key top supporting portion and the pertinent part of the support plate gets dented by the pressure of the push to elastically deform the support plate into a concave shape. This causes the peripheral part of the key top supporting portion in the support plate (i.e., the part where the inclination detector is placed or the part where the inclination detector contacts the support plate) to relatively bulge, thereby decreasing the clearance between the inclination detector and the surface to contact the inclination detector. This results in decreasing the inclination amount into the direction corresponding to the information item to be inputted by the user, which makes the input of information easier.

The input key according to the present invention also preferably has a configuration wherein one portion or both portions in at least one combination out of combinations of portions to come into contact with each other inside the input key during a push on the input key are of an embossed structure. The embossed structure is a sheetlike structure bulging in the center. When a force over a given level is applied to the bulging portion, the central bulging portion collapses at a stretch to get dented to the other side. When the force over the given level is removed, the central bulging portion dented to the other side bulges (or recovers). Once the bulging portion bulges to a certain shape, it returns into the original bulging state at a breath. The embossed structure is formed of an embossed sheet or the like made of soft vinyl or the like.

As the user pushes the input key, the input key according to the present invention is subject to a reaction force from the embossed sheet before the force of the push reaches the aforementioned given level. However, once the user applies the force over the given level, the embossed sheet collapses at a stretch to be dented, so as to decrease the reaction at a breath. This permits the user to sense the decrease of the reaction at a fingertip during the push on the input key with a user's finger. As the user lifts the finger from the input key, the part of the embossed structure gradually returns from the dented state of the central bulging portion to the original shape to elevate the input key. When it returns up to a certain shape, the central bulging portion suddenly generates a strong restoring force to quickly increase the force to lift the input key.

As described above, the present invention permits the user of the input key to have a touch of a push on the key top, so called a "click feel", and thereby obtain a light keying feel.

In order to achieve the above object, an input apparatus according to the present invention is an input apparatus for input of information through at least one input key assigned a plurality of information items to be inputted, comprising: (1) an input key comprising: (1a) a key top which can incline relative to a support plate for supporting the input key; (1b) a key top supported portion provided on an opposite surface in the key top to the support plate and arranged to be pushed together with the key top; (1c) a key top supporting portion provided on the support plate, and arranged to come into contact with the key top supported portion during a push on the key top and to support the key top supported portion so as to permit the key top to incline in a state of the contact with the key top supported portion; and (1d) at least one inclination detector provided in a direction assigned one of the information items to be inputted, on an opposite surface in the support plate to the key top or on the opposite surface in the key top to the support plate; (2) assignment information holding means for holding assignment information of each of the information items to be inputted, according to an inclination direction of the key top of the input key; (3) push detecting means for detecting a push on the input key; (4) inclination direction detecting means for detecting an inclination direction of the key top when the push detecting means detects a push on the input key; and (5) information determining means for determining an information item to be inputted, based on the inclination direction detected by the inclination direction detecting means and the information held in the assignment information holding means and fed according to the inclination direction.

Processing executed in the input apparatus according to the present invention will be described below. A user of the input apparatus pushes an input key corresponding to an information item to be inputted, while inclining the key top in a direction corresponding to the information item to be inputted. In the input key, first, the push brings the key top supported portion into contact with the key top supporting portion to establish a supported state. Subsequently, in this supported state (a stable state with the key top supporting portion and the key top supported portion serving as an axis), the key top inclines into the direction in which the user inclines the key top. This causes an inclination detector corresponding to the direction of the inclination to come into contact with a surface on the side opposite the inclination detector (e.g., the support plate, or the opposite surface on the key top side (or the key top supported portion)).

Then the push detecting means detects the push on the input key. When the push is detected, the inclination direction detecting means detects the contact of the inclination detector with the surface on the opposite side. Subsequently, the information determining means determines the information item to be inputted, based on the detected inclination direction and the information held in the assignment information holding means. This makes it feasible to specify information corresponding to the direction of the inclination of the key top by the user (an information item to be inputted).

According to the present invention, as described above, the key top is inclined about the axis on the key top supported portion and the key top supporting portion in contact with each other, so as to enable stabler input and achieve better operability.

In the input apparatus according to the present invention, preferably, one of the key top supported portion and the key top supporting portion is of a convex shape and the other is of a concave shape. The input apparatus according to the present invention also preferably has a configuration wherein contact detecting means for detecting contact is placed on both or either one of the inclination detector, and a surface with which the inclination detector comes into contact during an inclination of the key top, and wherein the inclination direction detecting means detects the contact of the inclination detector with the foregoing surface by the contact detecting means to detect the inclination direction of the key top. In particular, a button, a switch, a piezoelectric device, a strain gage, or the like may be placed on both or one of the inclination detector, and the surface to contact the inclination detector; or the both surfaces may be provided with electrodes to conduct electricity upon the contact. In the input apparatus according to the present invention, the support plate is preferably formed of an elastically deformable material.

Furthermore, the input apparatus according to the present invention preferably has a configuration wherein one portion or both portions in at least one combination out of combinations of portions to come into contact with each other inside the input key during a push on the input key are of an embossed structure. This configuration permits the user of the input key to have a touch of a push on the key top, so called a "click feel", and thereby to obtain a light keying feel.

Incidentally, in a desired configuration of the input apparatus according to the present invention, the input apparatus further comprises controlling means for, during a push operation on an input key, outputting assignment information of a plurality of input information elements to the input key at a time of the operation, to an external display device and for making the display device highlight information of an input candidate corresponding to the push operation at the time, out of the plurality of input information elements.

This achieves the following three effects. Namely, (1) in a case where the assignment of the plurality of input information elements to the input key is changed according to frequencies of use or the like, the user can check the up-to-date assignment information on the external display device during a push operation on the input key. (2) For example, in a case where the input mode is switched from an input mode of Japanese hiragana writing symbols to an alphabet input mode, it is feasible to feed back to the user the assignment information of input information about the input mode after the switch, which cannot be readily displayed by only the display on the key top. Furthermore, (3) the user can also check the information as an input candidate corresponding to a push operation at the time of the operation (information selected at the time). The feedback function of up-to-date assignment information as described above can dramatically improve easiness and certainty of user operation.

The present invention enables stabler input and achieves better operability, based on the configuration of inclining the key top around the axis on the key top supported portion and the key top supporting portion in contact with each other during a push on the key top.

BRIEF DESCRIPTION OF THE DRAWINGS

FIG. 12 is an illustration showing directions of inclination of a key top in the first embodiment.

FIG. 13 is a decision table for making a decision on an inclination direction of a key top in the first embodiment.

FIG. 14 is an example of a symbol conversion table in the first embodiment.

FIG. 50 is a table showing an example of assignment of Japanese hiragana writing symbols and marks to each of keys.

FIG. 51 is a table showing an example of assignment of English alphabet symbols and marks to each of keys.

FIG. 53 is a table showing an example of assignment of Chinese 声母(consonants) and Chinese 韻母(vowels) to each of keys.

FIG. 54 is a table showing an example of assignment of Korean symbols to each of keys.

DESCRIPTION OF THE PREFERRED EMBODIMENTS

Various embodiments of the present invention will be described below with reference to the drawings. The following description will concern the first to fourth embodiments in configurations wherein inclination detectors of an input key according to the present invention are provided in a protruding shape on a support plate (i.e., on an opposite surface to a key top), the fifth to seventh embodiments in configurations wherein inclination detectors of an input key according to the present invention are provided in a protruding shape on a key top (i.e., on an opposite surface to a support plate), and the eighth embodiment in a configuration wherein inclination detectors of an input key according to the present invention constitute a part of an opposite surface in a key top to a support plate and are comprised of a key-top-side slope portion formed so as to increase the distance to the support plate from the interior side toward the exterior side, which will be described below in order.

First Embodiment

Figure 1:
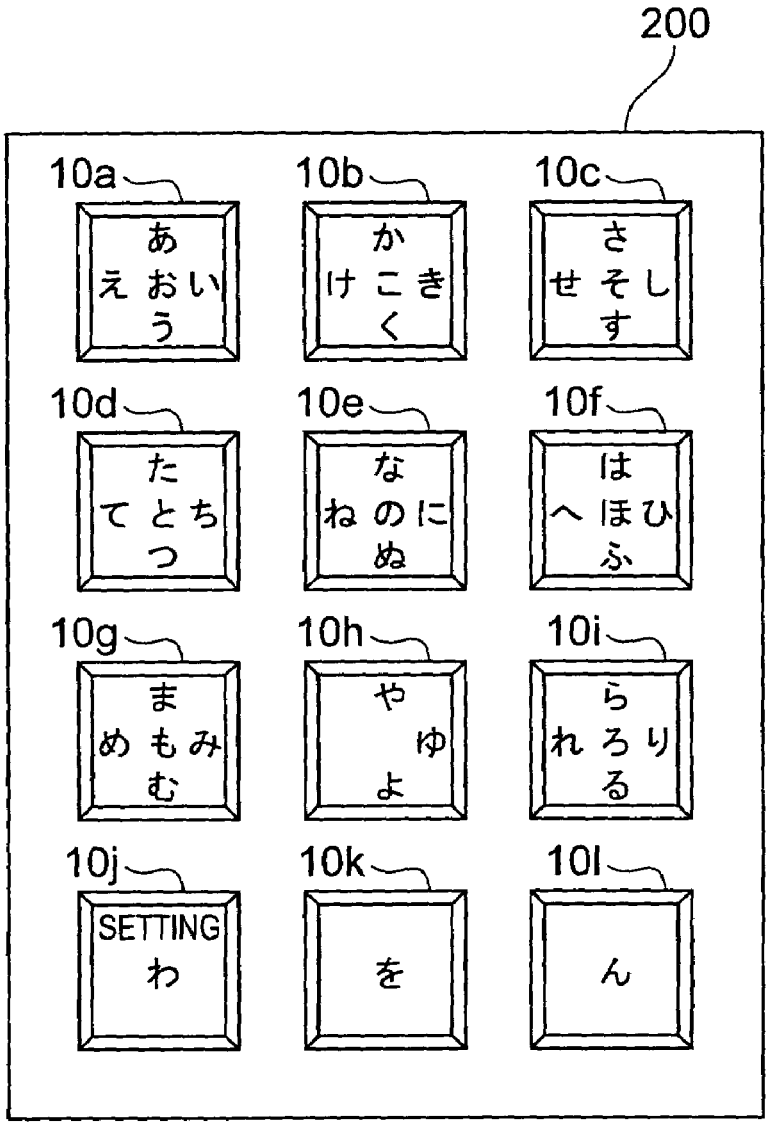
FIG. 1 is an illustration showing an exterior configuration of an input apparatus in each embodiment of the present invention.

FIG. 1 shows an exterior configuration of an input apparatus 200 in the first embodiment. As shown in FIG. 1, the input apparatus 200 is provided with twelve input keys 10 (generically used to refer to input keys 10*a*–101) of 4 vertical and 3 horizontal. Here the input apparatus 200 is used in various portable terminals such as mobile communication terminals typified by cell phones, PDAs (Personal Digital Assistants), and so on.

Each input key 10 is assigned at least one symbol according to a direction of an inclination of a key top. In the description hereinafter, the hiragana writing symbols being one of the Japanese symbol formats will be used as an example of symbols to be inputted through the input keys 10. The Japanese hiragana writing symbols can be classified into a plurality of subgroups, and each subgroup consists of five symbols. These subgroups include the "あ line" group consisting of five symbols (あ, い, う, え, お) corresponding to five basic vowels, the "か line" group consisting of five symbols (か, き, く, け, こ) corresponding to the foregoing five vowels coupled with a specific consonant "K", the "さ line" group consisting of five symbols (さ, し, す, せ, そ) corresponding to the foregoing five vowels coupled with a specific consonant "S", the "た line" group consisting of five symbols (た, ち, つ, て, と) corresponding to the foregoing five vowels coupled with a specific consonant "T", and so on.

For example, the input key 10*a* is assigned a symbol group of the "あ line group" according to directions of force as follows: "あ" in "up"; "い" in "right"; "う" in "down"; "え" in "left"; "お" in "center". In addition, as shown in FIG. 1, indications to display the assignment are provided on the surface of the key top of the input key 10*a*. Similarly, the input key 10*b* is assigned a symbol group of the "か line group", and the input key 10*c* a symbol group of the "さ line group".

Figure 2:
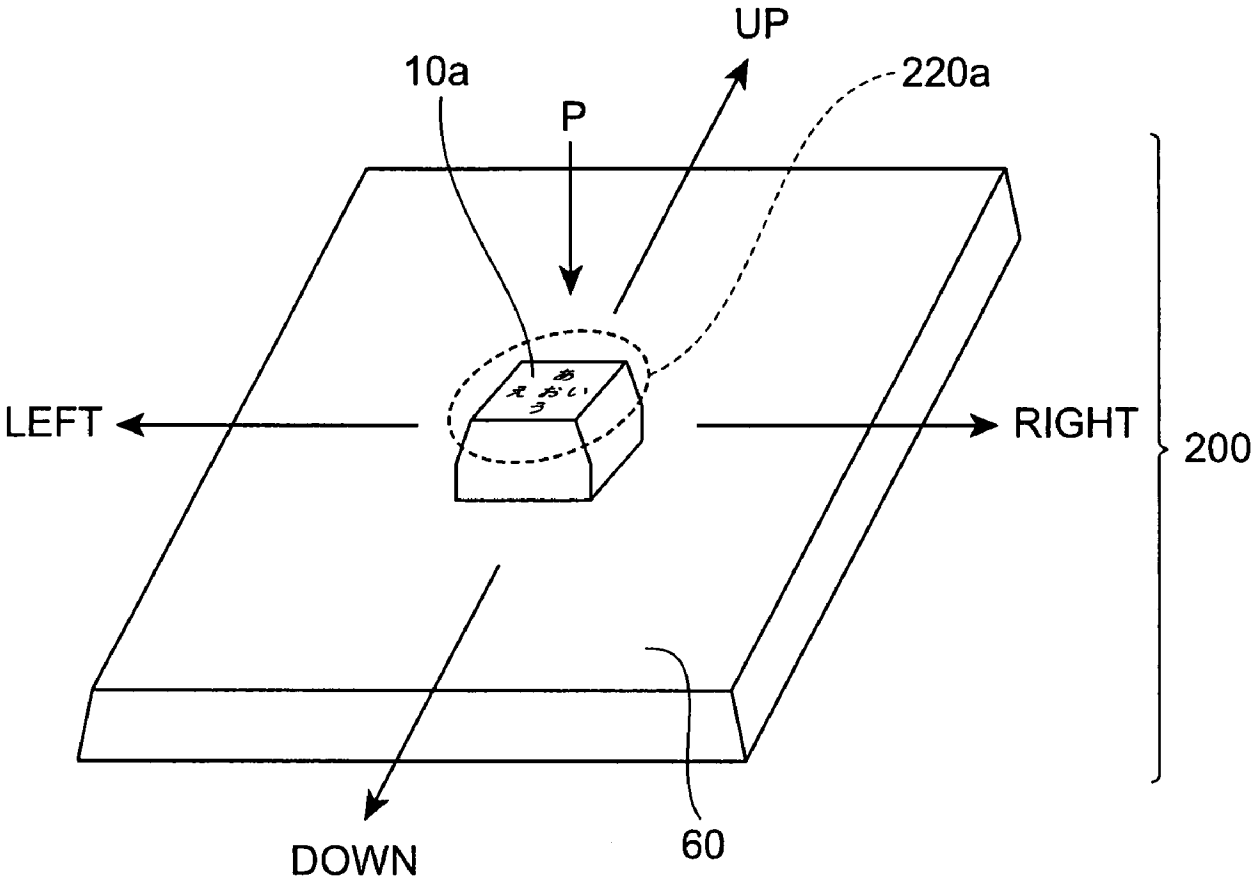
FIG. 2 is an illustration for explaining "directions" in each embodiment.

The "directions" in the present embodiment will be described below with reference to FIG. 2. As shown in FIG. 2, the input key 10*a* is placed on a support plate 60. A "direction" in the present embodiment indicates "up", "down", "left", "right", or "center" with respect to the plane of support plate 60. The "center" refers to a state in which during a push on the input key 10 no force is applied in either direction, i.e., a state in which a force vertical to the support plate 60 is exerted.

Figure 3:
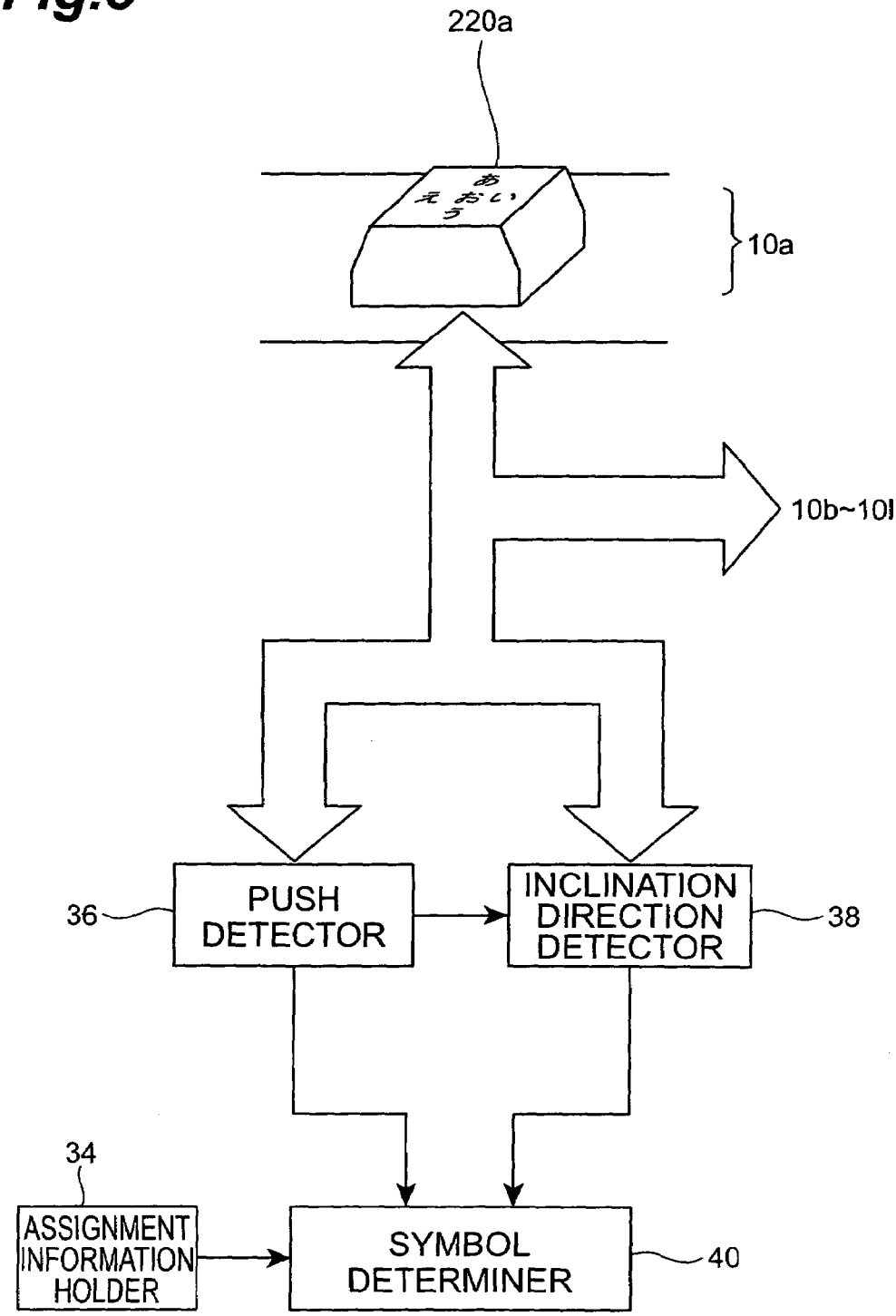
FIG. 3 is a functional block diagram of an input apparatus in each embodiment.

FIG. 3 shows a functional configuration of the input apparatus 200. As shown in FIG. 3, the input apparatus 200 has input keys 10 (only the input key 10*a* shown), an assignment information holder 34, a push detector 36, an inclination direction detector 38, and a symbol determiner 40. The push detector 36 corresponds to the push detecting means according to the present invention, the inclination direction detector 38 to the inclination direction detecting means according to the present invention, and the symbol determiner 40 to the information determining means according to the present invention. The upper part (the part surrounded by a dotted line in FIG. 2) of each input key 10 is a portion which is called a key top 220 and to which force is applied during a push on the input key 10. The assignment information holder 34, push detector 36, inclination direction detector 38, and symbol determiner 40 each may be constructed separately from the input keys 10 or integrally therewith.

When a user of the input apparatus 200 enters a symbol, the user pushes an input key 10. Namely, where the user enters a symbol in the "あ line group", the user exerts a force on the key top 220 of the input key 10*a* to push it. The user can specify a symbol by pushing the key top with an inclination in one direction of "up", "down", "left", or "right" or by pushing the key top in the "center" direction without inclination in any direction when exerting the force on the key top 220 of the input key 10*a*.

The assignment information holder 34 has a symbol conversion table as shown in FIG. 14 and holds the assignment information of each of information items to be inputted, according to inclination directions of the key top 220 in the input key 10. For example, FIG. 14 shows that "お" corresponds to the center direction of the input key 10*a*, "あ" to the up direction, "い" to the right direction, "う" to the down direction, and "え" to the left direction. Similarly, the assignment information holder 34 has symbol conversion tables corresponding to the input keys 10*b* to 101. The symbol conversion tables may be arranged to permit the user to freely set corresponding symbols. The contents of the symbol conversion tables may be arranged to be automatically updated according to statistical results of user's symbol input. For example, a symbol at a high user's input frequency may be automatically assigned to a direction or an input key 10 easier to incline.

The push detector 36 detects a push on an input key 10 (the details of the detection method will be described later). The inclination direction detector 38 has a decision table shown in FIG. 13, and detects a direction of an inclination of the key top 220. The decision table, as shown in FIG. 13, stores conditions corresponding to inclination directions of the key top 220, based on inclination directions and times of the key top 220 detected (the details of which will be described later). The symbol determiner 40 determines a symbol to be inputted, from the detected direction on the basis of the symbol conversion table held by the assignment information holder 34.

Figure 4:
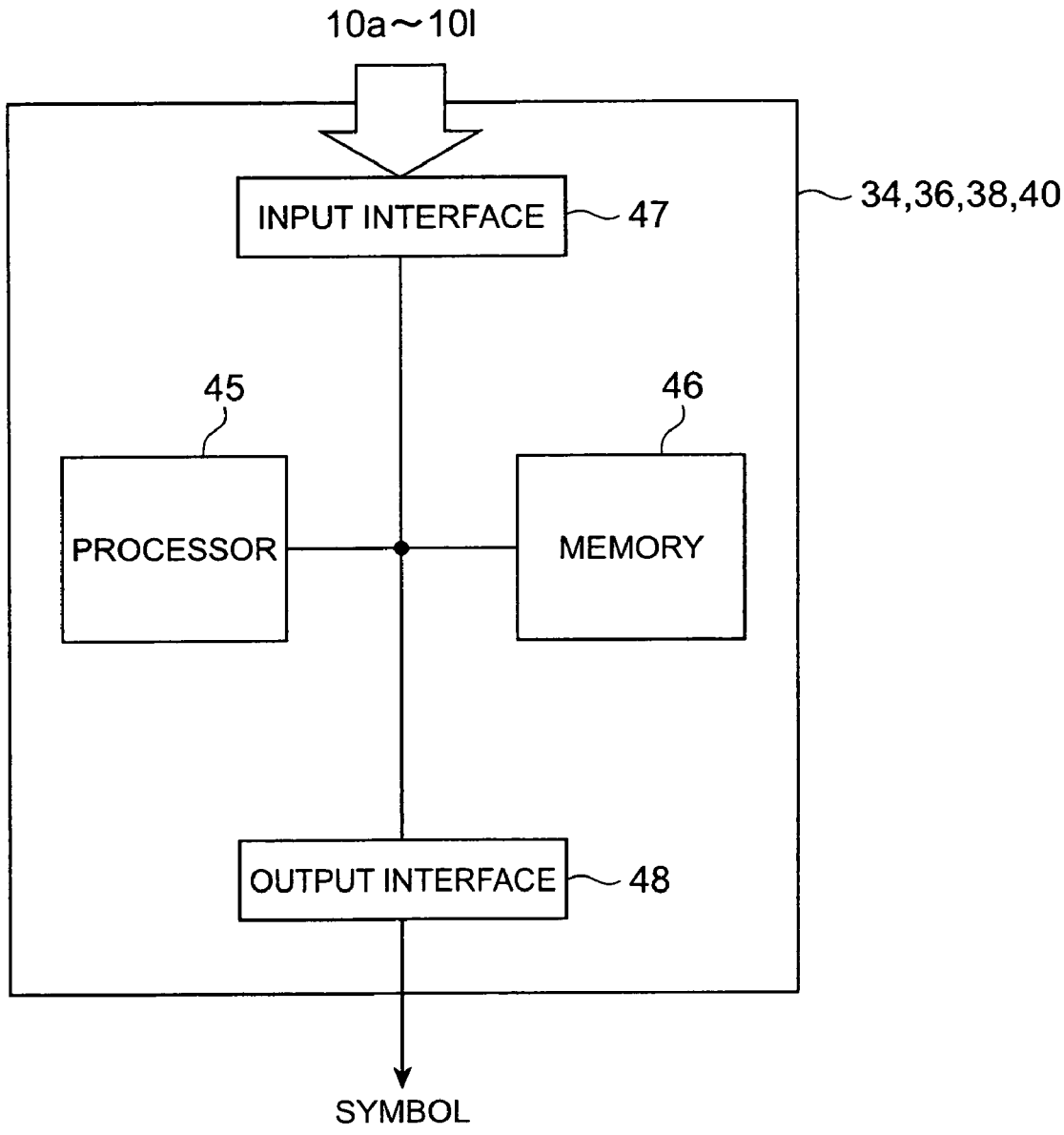
FIG. 4 is a block diagram of an assignment information holder, a push detector, an inclination direction detector, and a symbol determiner.

As shown in FIG. 4, the assignment information holder 34, push detector 36, inclination direction detector 38, and symbol determiner 40 are constructed as an integral device provided with a processor 45, a program executed by the processor 45, a memory 46 storing various tables and various data, an input interface 47 for receiving various signals, and an output interface 48 for outputting a symbol as a determination result to the outside.

Figure 5:
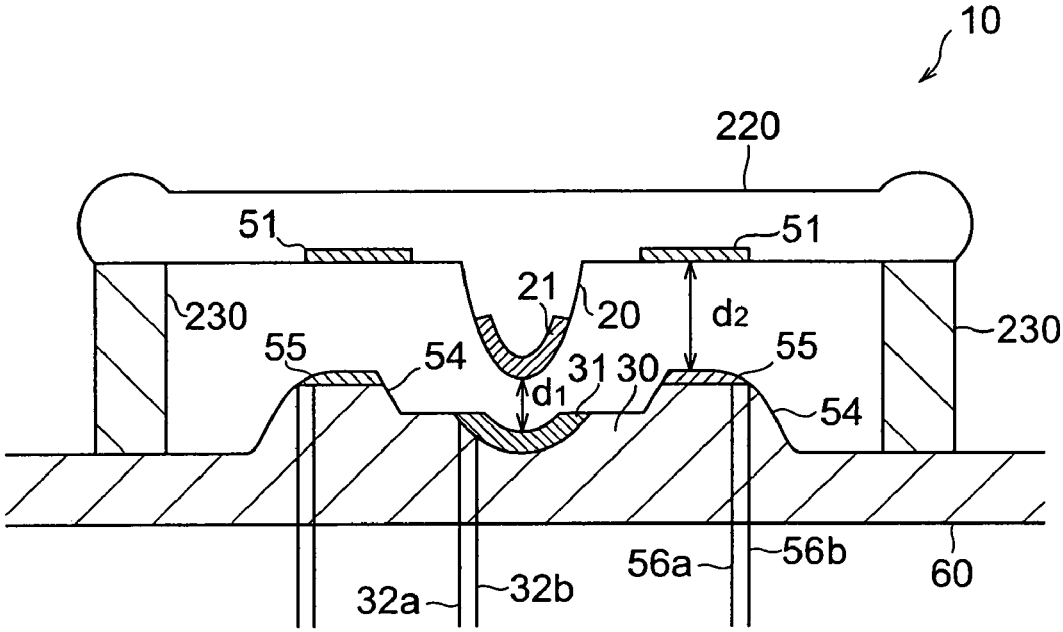
FIG. 5 is a vertical sectional view of an input key in the first embodiment.

FIG. 5 shows a vertical cross section of an input key 10. As shown in FIG. 5, an input key 10 is comprised of a key top 220, a key skirt 230, a key top supported portion 20, a key top supporting portion 30, and four inclination detectors 54 (two of which are illustrated) in the up, down, left, and right directions on a support plate 60, and is provided on the support plate 60.

Figure 10:
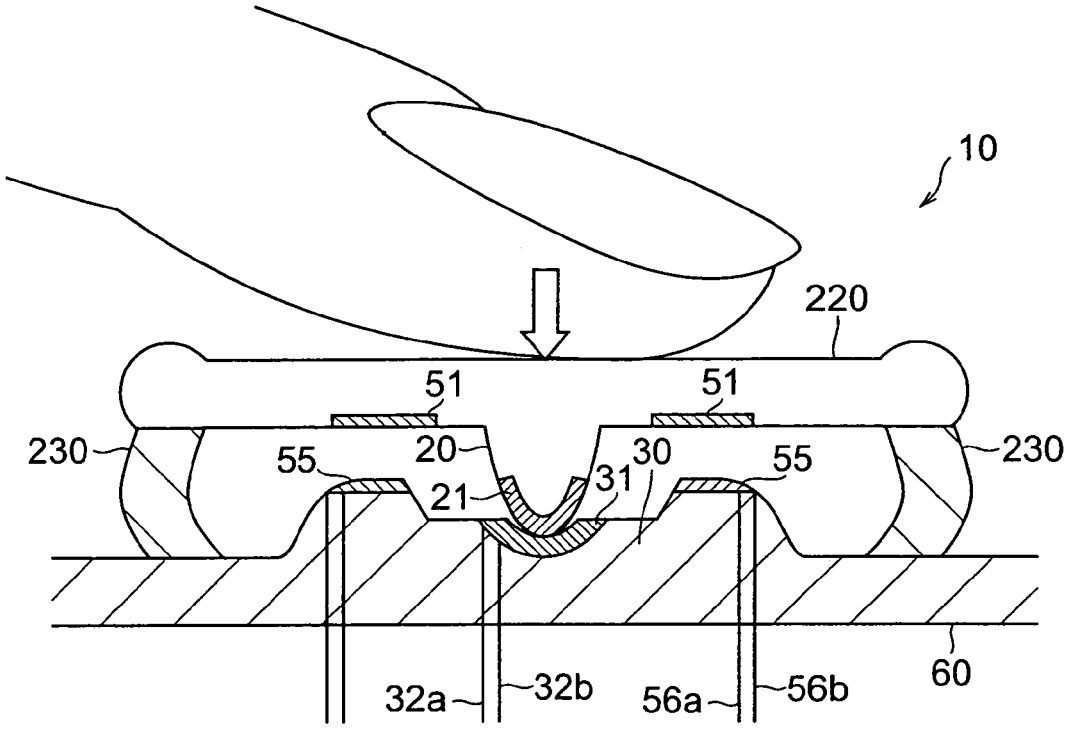
FIG. 10 is an illustration showing an example of a state during a push on an input key in the first embodiment.
Figure 11:
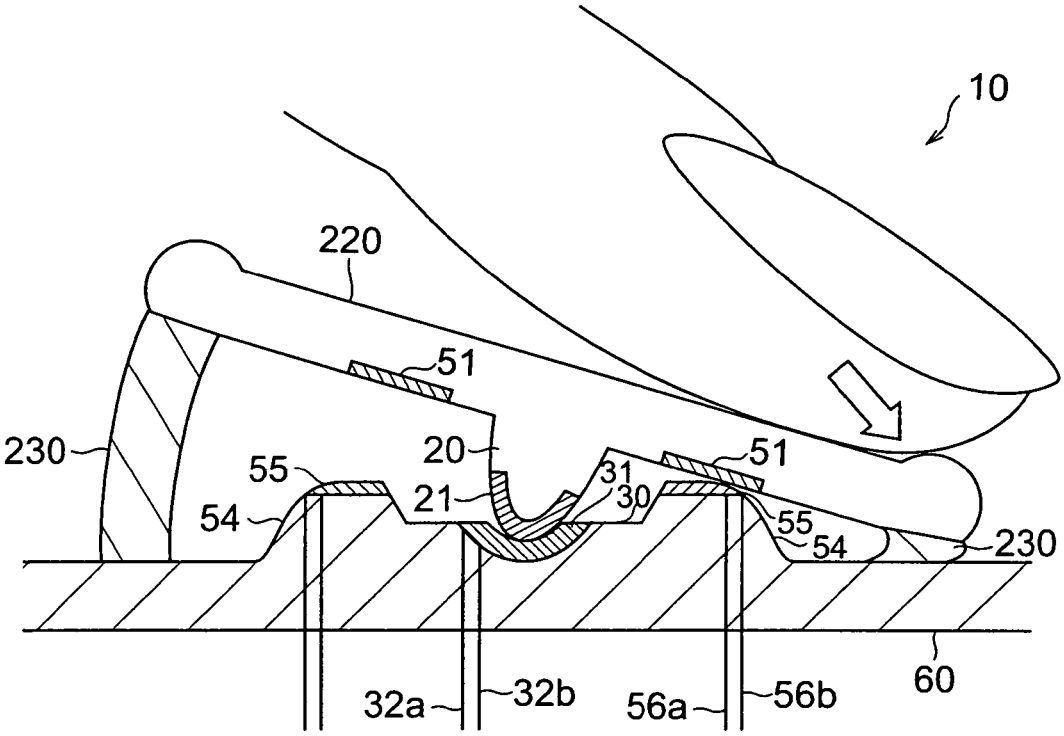
FIG. 11 is an illustration showing an example of a state during a push on an input key in the first embodiment.

The key top 220 is a portion to which force is applied during a push on the input key 10, and is made of a material with some hardness, for example, such as hard plastic or metal, in order to enhance sensation of a push on the input key. The key skirt 230 is connected perpendicularly to the support plate 60 and holds the key top 220 with a constant space from the support plate 60 in a state without force on the key top 220. The key skirt 230 is made of an elastically deformable material, e.g., synthetic rubber, soft plastic, soft vinyl, or the like. As shown in FIGS. 10 and 11, the key skirt 230 is elastically deformed to enable the key top 220 to undergo a push and inclination relative to the support plate 60. The periphery of the upper surface of the key top 220 is of such a bulging structure as to facilitate the inclination with a force applying finger or the like being caught thereon during the inclination of the key top 220.

The key top supported portion 20 is of a protruding shape and is provided in the center on an opposite surface in the key top 220 to the support plate 60. The distal end of the key top supported portion 20 is of a semispherical convex shape and an electrode 21 is attached to that portion. The electrode 21 is made of a uniform conductor such as a metal piece. The key top supporting portion 30 is provided on the support plate 60 so as to rise from the other part of the support plate 60 (as being integral with the support plate 60), and is located with a space to the opposed part of the key top supported portion 20. When the key top 220 is pushed, the key top supporting portion 30 comes into contact with the key top supported portion 20. The contact part of the key top supporting portion 30 is of such a semispherical concave shape as to be able to support the convex part at the distal end of the key top supported portion 20. As shown in FIG.

Figure 7:
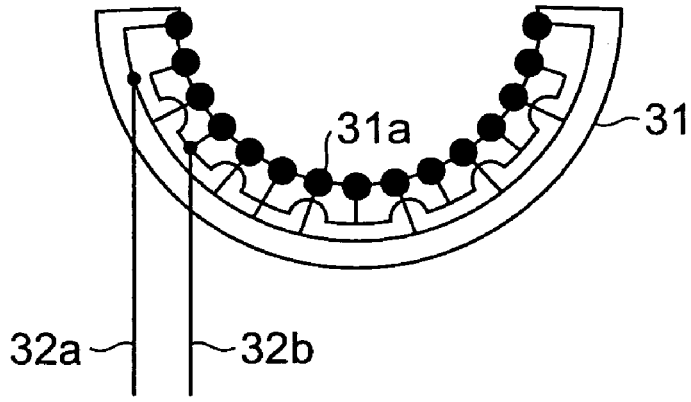
FIG. 7 is a vertical sectional view and a plan view showing an electrode attached to a key top supporting portion in the first embodiment.
Figure 7:
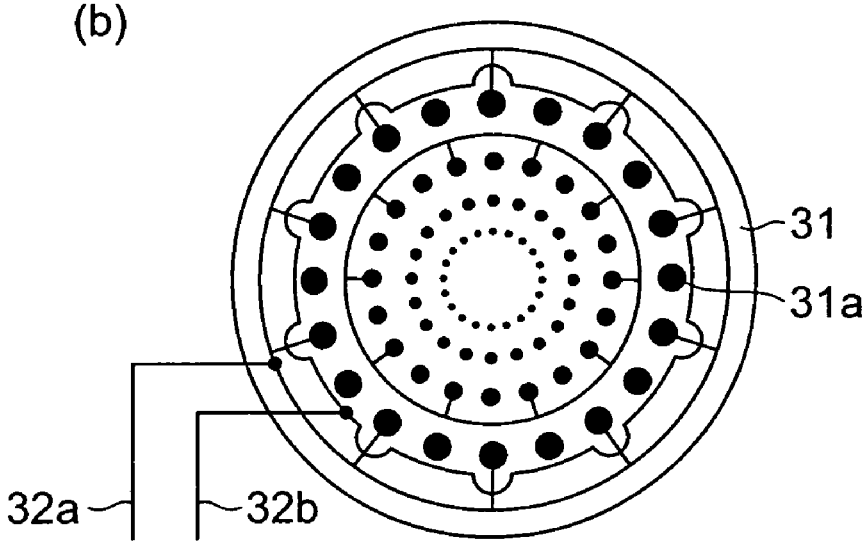

11, the concavo-convex structure of the key top supported portion 20 and the key top supporting portion 30 enables the key top supported portion 20 to incline together with the key top 220 in a state in which the key top 220 is supported on the key top supporting portion 30 while being pushed. An electrode 31 is attached to the concave part of the key top supporting portion 30. FIG. 7(*a*) shows a vertical cross section of the electrode 31 and FIG. 7(*b*) a top plan view of the electrode 31. As shown in FIG. 7, the electrode 31 is provided with a plurality of electric contacts 31*a*, and these contacts 31*a* are connected to either a wiring line 32*a* or a wiring line 32*b*. When the input key 10 is pushed to bring the key top supported portion 20 into contact with the key top supporting portion 30 as shown in FIG. 10, the electrode 21 attached to the key top supported portion 20 comes into contact with a plurality of contacts 31*a* of the electrode 31 attached to the key top supporting portion 30, so that the wiring line 32*a* and the wiring line 32*b* turn into an electrically conducting state through the contacts 31*a* and electrode 21. This causes the push detector 36 to detect the conducting state and thereby detect the push on the input key 10.

Figure 6:
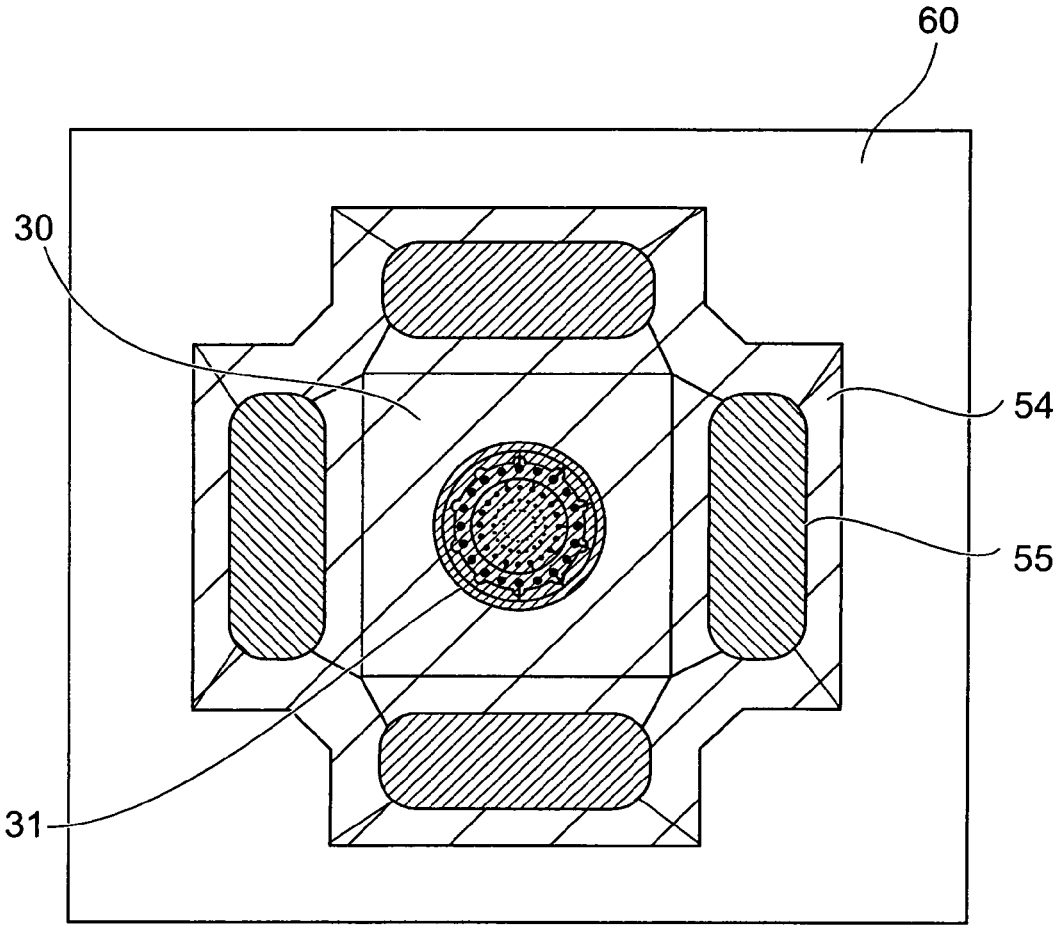
FIG. 6 is a plan view of an opposite surface to a key top in a support plate in the first embodiment.
Figure 8:
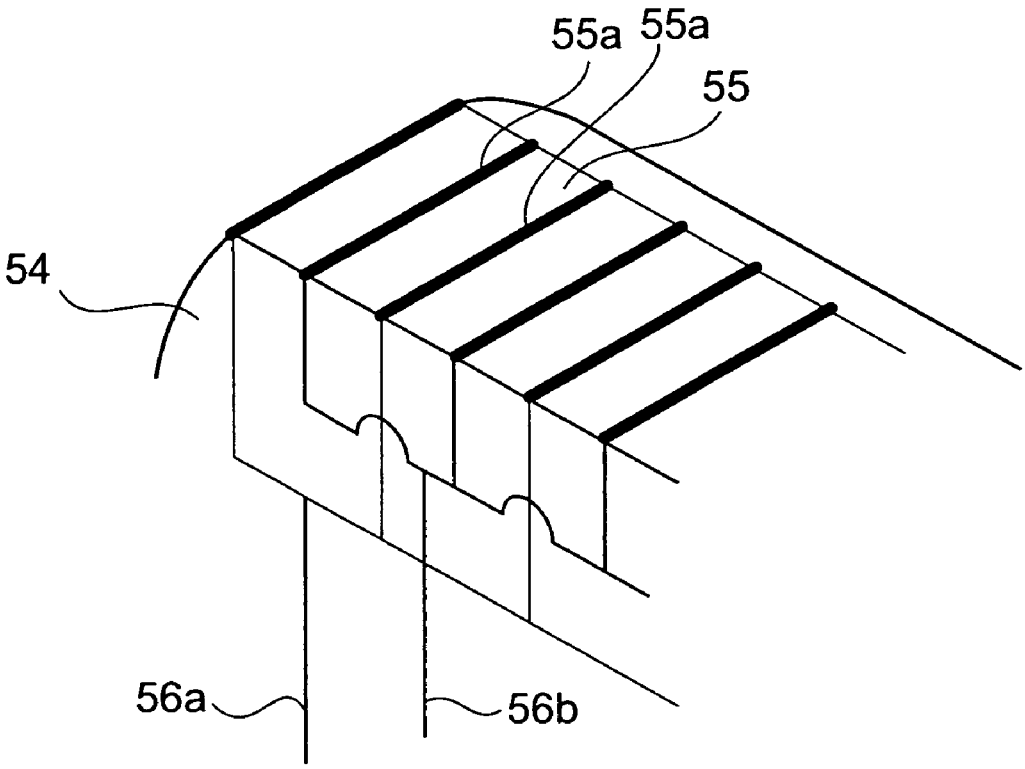
FIG. 8 is an illustration showing an electrode attached to an inclination detector in the first embodiment.

The inclination detectors 54 are provided in the respective directions of up, down, left, and right around the key top supporting portion 30 on the support plate 60 and are arranged to further rise from the key top supporting portion 30. The inclination detectors 54 are of an elongated convex shape as shown in FIGS. 6 and 8, and an electrode 55 is attached to the distal part of each detector. As shown in FIG. 8, an electrode 55 is provided with a plurality of electric contacts 55*a* exposed in the form of a line on the surface of the corresponding inclination detector 54, and those contacts 55*a* are connected to either a wiring line 56*a* or a wiring line 56*b*. FIG. 6 shows the opposite surface in the support plate 60 to the key top 220. As shown in FIG. 6, the electrode 31 attached to the key top supporting portion 30 is located in the center of the opposite surface and the electrodes 55 attached to the inclination detectors 54 are located in the respective directions of up, down, left, and right. When the key top 220 is pushed with inclination, an inclination detector 54 comes into contact with the opposite surface on the key top 220 side, as shown in FIG. 11. Electrode 51 are attached to corresponding portions of the contact of the opposite surface on the key top 220 side. The detection of the contact of the inclination detector 54 with the opposite surface on the key top 220 side is carried out in a manner similar to the detection of the contact of the key top supported portion 20 with the key top supporting portion 30. It is assumed herein that the relation of $d_1<d_2$ is satisfied by the distance $d_1$ between the key top supported portion 20 and the key top supporting portion 30 and the distance $d_2$ between the inclination detectors 54 and the key top 220 in a state without force on the key top 220. This is for assuring establishment of a state in which the key top supported portion 20 comes into contact only with the key top supporting portion 30 when a force vertical to the key top 220 is exerted, and is also for assuring establishment of a state in which the key top supported portion 20 is always supported by the key top supporting portion 30 when an inclination detector 54 is in contact with the key top 220. Namely, this is for assuring establishment of a state in which a clearance is secured for a structure wherein the key top supported portion 20 comes into contact only with the key top supporting portion 30 and an inclination detector 54 is not in contact with the opposite surface when a force vertical to the key top 220 is exerted, and a push vertical to the key top 220 can be achieved surely, and is also for assuring establishment of a state in which the key top supported portion 20 supported on the key top supporting portion 30 is made to function as a fulcrum of inclination during the inclination of the key top 220.

The detection of the contact may also be implemented by any other method, e.g., a method of detecting the contact by a button, a switch, or the like set in the contact part, instead of the method of attaching the electrodes to the contact parts as described above.

Figure 9:
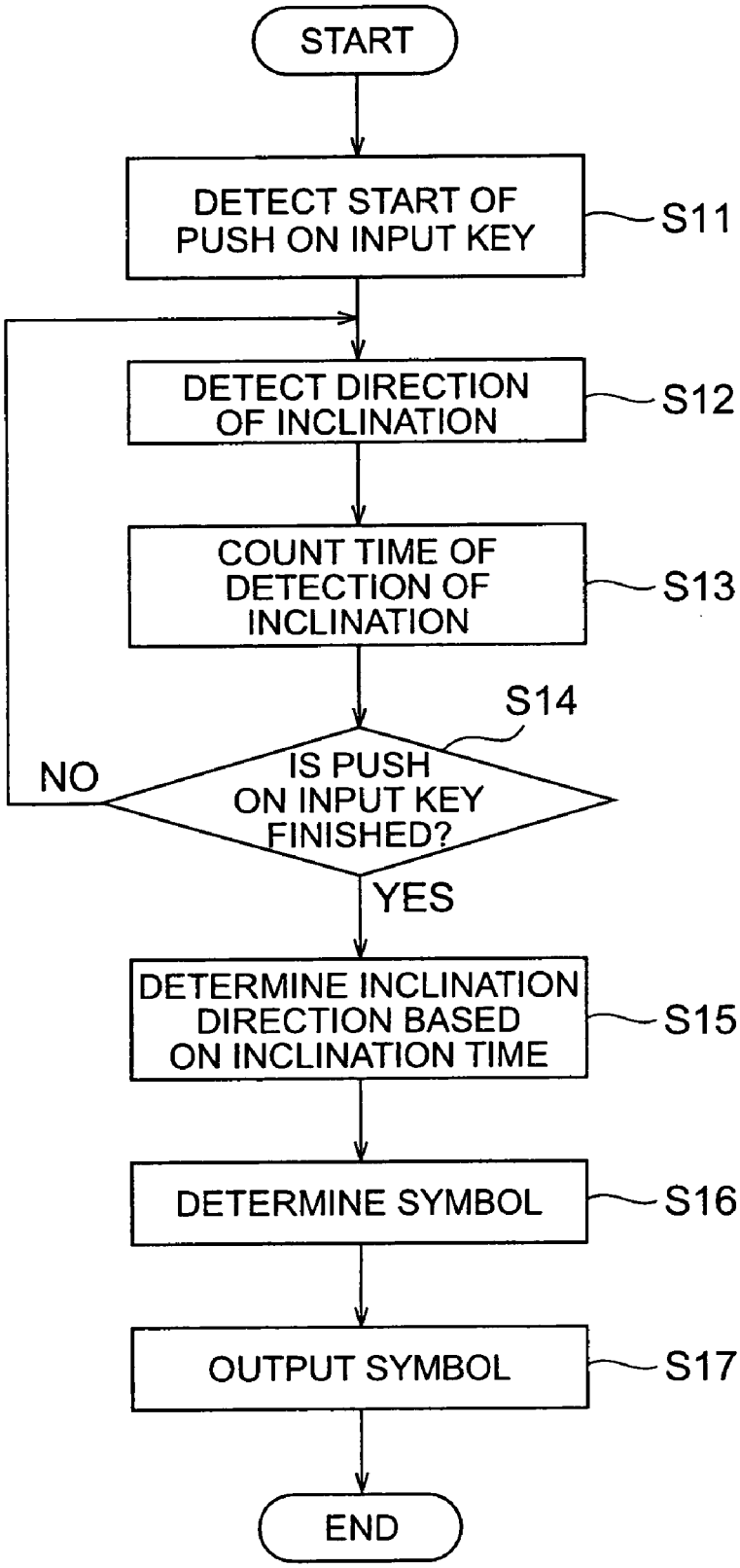
FIG. 9 is a flowchart showing processing in the first embodiment.

The processing executed in the input apparatus 200 according to the present embodiment will be described below with reference to the flowchart of FIG. 9.

When the user pushes an input key 10, the processing is started. The user pushes an input key 10 assigned a symbol to be inputted, while exerting a force so as to incline the key top 220 in a direction corresponding to the symbol to be inputted. For example, when the user desires to enter a symbol of "ﾚﾝ", the user pushes the input key 10*a* assigned "ﾚﾝ", while applying a force so as to incline the key top 220 in the right direction corresponding to "ﾚﾝ" as shown in FIG. 11. Here how to incline the key top 220 in a direction corresponding to a symbol to be inputted is a method of once pushing the key top 220 vertically and then inclining the key top in a state in which the key top supported portion 20 is supported by the key top supporting portion 30. It is also possible to adopt a method of pushing the key top 220 while directly inclining it. In that case, the key top supported portion 20 comes into contact with the key top supporting portion 30 at an initial stage of a push to be supported, and the subsequent inclination is implemented in a state in which the key top supported portion 20 is supported by the key top supporting portion 30. This inclination method permits the user to perform the push and inclination as a continuous operation, without being conscious of the two-step operations of the push and inclination. In either of the inclination methods, the inclination is performed in a stable state in which the key top supported portion 20 supported by the key top supporting portion 30 serves as a fulcrum.

With the push, as shown in FIGS. 10 and 11, the electrode 21 attached to the key top supported portion 20 comes into contact with the electrode 31 attached to the key top supporting portion 30, whereby the line 32*a* and the line 32*b* turn into the electrically conducting state through the contacts 31*a* and electrode 21. This causes the push detector 36 to detect the conducting state and to detect a start of the push on the input key 10 to start counting a continuation duration of the push (S11).

Subsequently, the inclination direction detector 38 detects an inclination of the key top 220 as shown in FIG. 11, in a manner similar to the method of the detection of the push (S12), and counts a continuation duration of the inclination (S13). The directions of the inclination are defined by "A" for the center, "B" for the left direction, "C" for the right direction, "D" for the up direction, and "E" for the down direction, as shown in FIG. 12, and the continuation durations of the inclination will be denoted by $t_A$, $t_B$, $t_C$, $t_D$, and $t_E$, respectively. The unit of time herein is an extremely small time unit, e.g., millisecond.

Subsequently, the push detector 36 detects an end of the push on the input key 10. The detection of the push end on the input key 10 is implemented by determining whether a duration to of a non-conducting state in which the electrode 21 attached to the key top supported portion 20 stays away from the electrode 31 attached to the key top supporting portion 30, exceeds a given value $T_0$ (>0) (S14). When the push on the input key 10 is not finished, the processes of S12 to S14 are continuously performed. The determination on the duration of the non-conducting state is preferably carried out at very short time intervals, e.g., on the millisecond time scale.

When the push on the input key 10 is finished, the inclination direction detector 38 determines an inclination direction of the key top 220 in a manner as described below, from values $t_A$ to $t_E$ of the continuation durations of the inclination directions obtained as described above, based on the decision table (S15).

First, a decision on a push in the center direction (a push in a state in which the key top 220 does not incline in either direction) is made as follows. Values of $r_{AB}=t_B/t_A$ and others are derived from the duration $t_A$ of the push in the center direction and the duration $t_B$ of the inclination in the left direction and others ($r_{XY}$ hereinafter refers to $t_Y/t_X$ (X, Y=any two of A to E). Using these values, it is determined that the push in the center direction was made, if the following conditions are satisfied, as in the decision table shown in FIG. 13.

(1) $t_A>T_A$ (2) $r_{AB}\leqq R_A$ and $r_{AC}\leqq R_A$ and $r_{AD}\leqq R_A$ and $r_{AE}\leqq R_A$ Here $T_A$ and $R_A$ are positive constant values. The condition of (1) indicates that the push in the center direction continues over the constant time. Therefore, $T_A$ is an appropriate value to assume a push. The condition of (2) indicates that the durations of inclination in all the directions are not more than the fixed ratio to the duration of the push in the center direction. Therefore, $R_A$ is preferably a value such as 0.05 (a duration of inclination in any direction is 5% of the duration of the push in the center direction). This condition is given for eliminating a chance of determining that some shake in the up, down, left, and right directions with the intension of the push in the center direction is an inclination in one direction.

Next, a decision on an inclination in one direction of the key top 220 during a push on the input key 10 is made as follows. A case of the inclination in the right direction will be described as an example. Just as in the above case, it is determined that the key top was inclined in the right direction, if the following conditions are satisfied, as in the decision table shown in FIG. 13.

(1) $t_C>T_C$ (2) $r_{AC}>\alpha$ (3) $r_{CB}\leqq R_C$ and $r_{CD}\leqq R_C$ and $r_{CE}\leqq R_C$ Here $T_C$, $\alpha$, and $R_C$ are positive constant values. The condition of (1) indicates that the inclination in the right direction continues over the constant time. Therefore, $T_C$ is set to an appropriate value to assume an inclination. The condition of (2) indicates that the duration of the inclination in the right direction exceeds the constant ratio to the duration of the push in the center direction. This is because the key top supported portion 20 is in contact with the key top supporting portion 30 even during the inclination of the key top 220 in any direction and the push in the center direction is also detected. Therefore, $\alpha$ is preferably a value of approximately 0.70 (the duration of the inclination in the right direction is 70% of the duration of the push in the center direction). The appropriate value of $\alpha$ differs depending upon the operation speed or the like from familiarity to the push operation. For this reason, $\alpha$ is preferably determined according to the operation speed or the like from familiarity to the push operation. The condition of (3) indicates that the durations of inclination in all the directions except for the right direction are not more than the constant ratio to the duration of inclination in the right direction. Therefore, $R_C$ is preferably set to a value of about 0.05 (the duration of inclination in any direction except for the right direction is 5% of the duration of inclination in the right direction). This condition is given for eliminating a chance of determining that some shake in the other directions with the intension of the inclination in the right direction is an inclination in one direction except for the right direction. Inclinations in the other directions are also determined in similar fashion.

Subsequently, the symbol determiner 40 determines a symbol to be inputted, based on the symbol conversion table as shown in FIG. 14, which is held in the assignment information holder 34, from the information about the detected direction and the input key 10 pushed (S16). For example, in a case where the detected direction is "right" and where the input key 10 pushed is "key 10*a*", the symbol to be inputted is determined to be "ゐ", based on the symbol conversion table corresponding to the key 10*a* as shown in FIG. 14.

Subsequently, the symbol determiner 40 outputs the symbol thus determined (S17).

As described above, the input apparatus 200 of the present embodiment enables stabler input based on the inclination of the key top 220 around the axis on the key top supported portion 20 in the input key 10. This makes it feasible to substantialize the input apparatus 200 superior in terms of operability. The key top 220 can be made in simpler structure, without need for providing the key top 220 with a plurality of projections, so that it becomes feasible to facilitate the production of input apparatus 200 and to decrease the cost of production.

Figure 27:
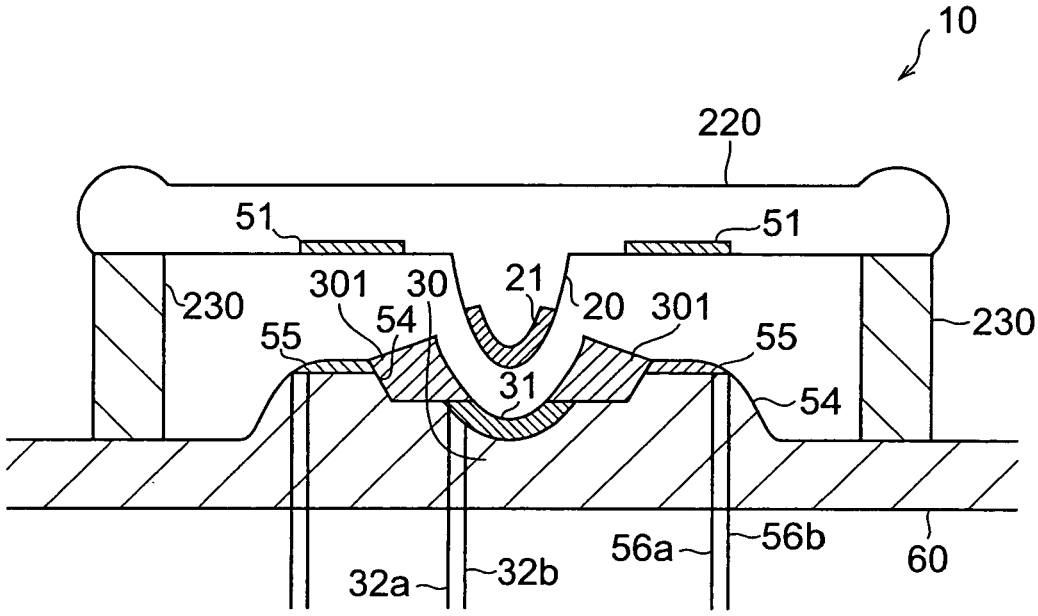
FIG. 27 is a vertical sectional view of an input key in another example in the first embodiment.
Figure 28:
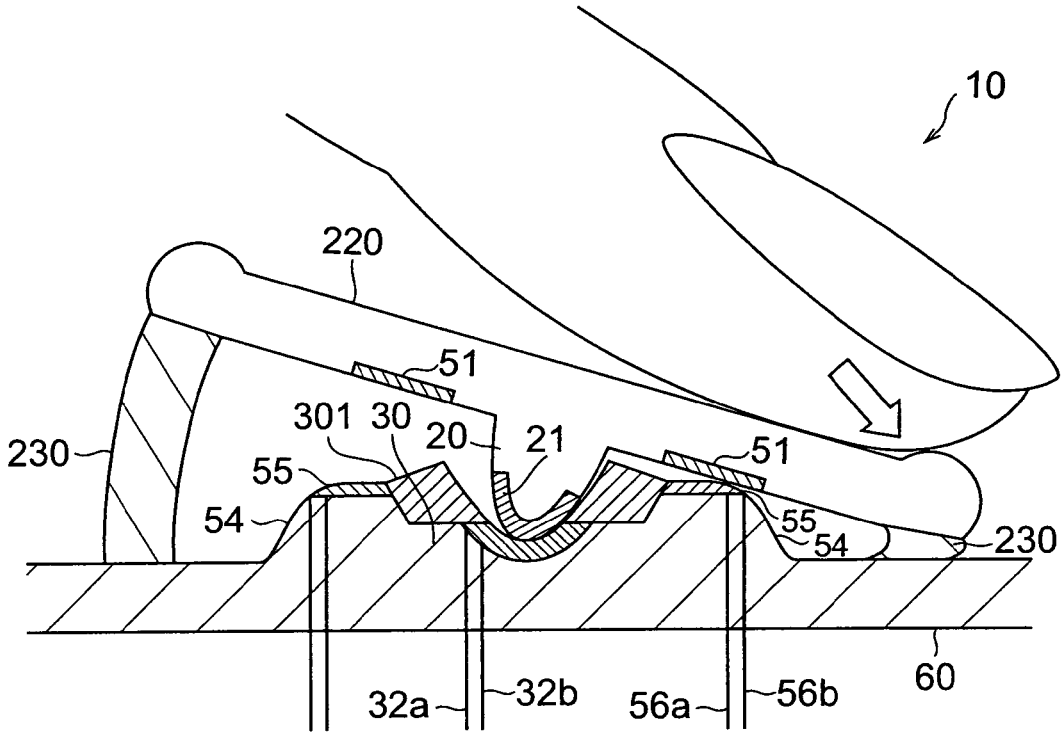
FIG. 28 is an illustration showing an example of a state during a push on an input key in another example in the first embodiment.

In the present embodiment, as shown in FIGS. 27 and 28, a guard portion 301 bulging high so as to implement easier support of the key top supported portion 20 may be provided around the part to support the key top supported portion 20, in the key top supporting portion 30. In this configuration, the distal end of the key top supported portion 20 is arranged to be lower with respect to the plane of the support plate 60 than the distal end of the guard portion 301 in a state in which the input key 10 is not pushed. However, the height of the guard portion 301 should be determined so as to prevent the key top supported portion 301 from hitting the guard portion 301 during inclination of the key top 220 to impede the inclination detector 54 from coming into contact with the key top 220. The guard portion 301 is made of a material so hard as to function as a guard and, normally, may be made of a material similar to the support plate 60.

Figure 15:
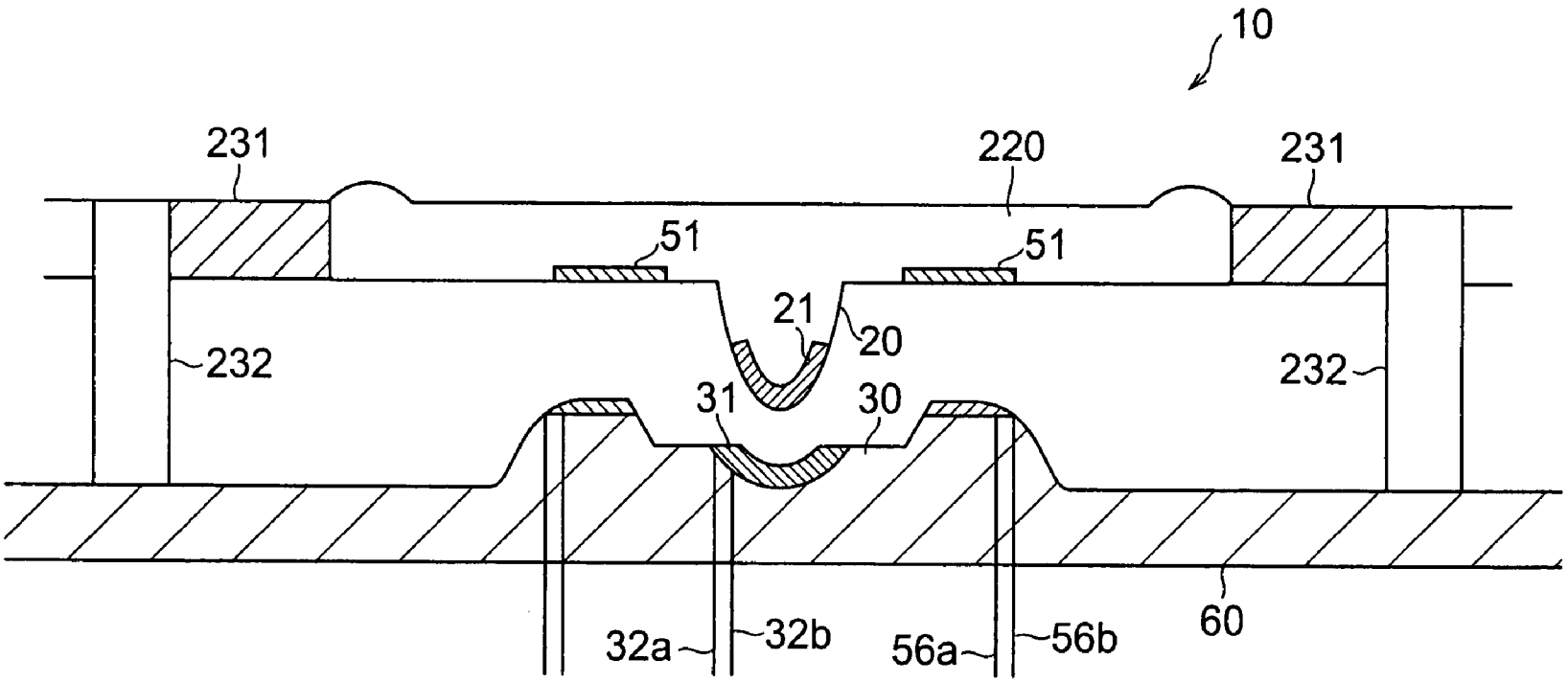
FIG. 15 is a vertical sectional view of an input key in another example in the first embodiment.

In the present embodiment, as shown in FIG. 15, it is possible to adopt a configuration wherein a key top periphery support 231 made of an elastically deformable material such as a spring, synthetic rubber, soft plastic, or soft vinyl horizontally supports the key top 220, instead of the key skirt 230.

Figure 25:
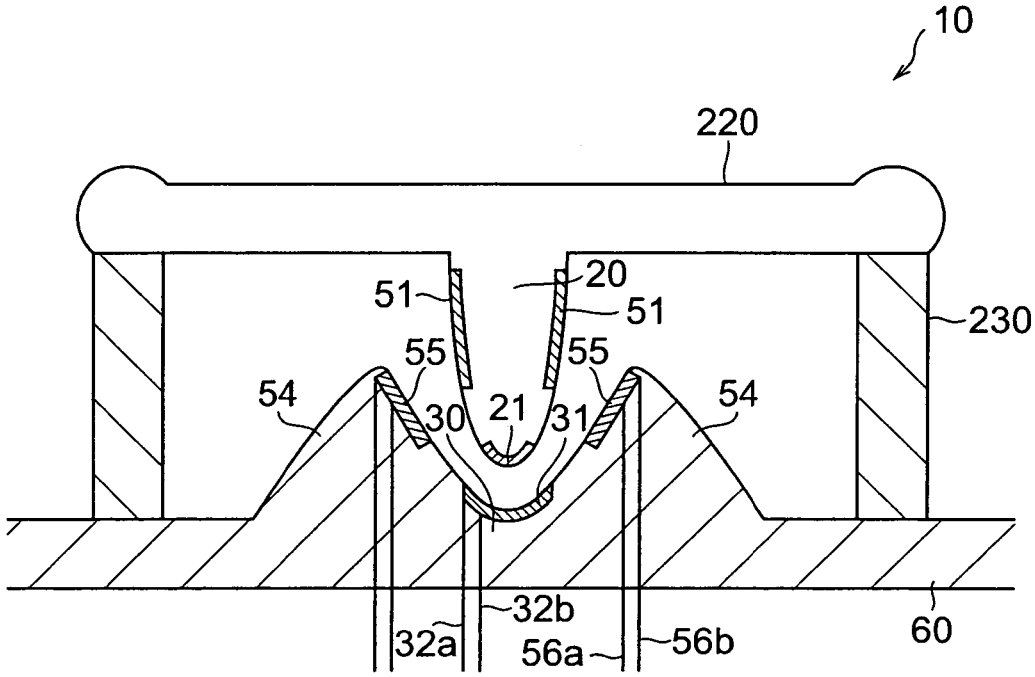
FIG. 25 is a vertical sectional view of an input key in another example in the first embodiment.

In the present embodiment, as shown in FIG. 25, it is also possible to adopt a structure wherein during an inclination of the key top 220 an inclination detector 54 comes into contact with the key top supported portion 20. In the case of this structure, the electrodes 51, which were attached to the key top 220 in the configuration described above, are attached to the side part in the key top supported portion 20 to come into contact with the inclination detectors 54, in fit with the shape of that part, so as to detect the inclination direction of the key top 220. In this case, in order to securely support the key top supported portion 20 on the key top supporting portion 30, the distal end of the key top supported portion 20 is set to be lower with respect to the plane of the support plate 60 than the distal portion of the inclination detectors 54 in a state in which the input key 10 is not pushed. In order to prevent the electrode 21 attached to the tip of the key top supported portion 20 from touching the electrodes 55 of the inclination detectors 54, the electrode 21 is set to be lower with respect to the plane of the support plate 60 than the electrodes 55 in a state in which the input key 10 is not pushed. The input key is constructed in the structure capable of securing an appropriate distance enough to avoid contact between the electrodes 51 on the side of the key top supported portion 20 and the electrodes 55 of the inclination detectors 54 even with some shake of the key top during the push in the center direction on the key top 220.

Figure 16:
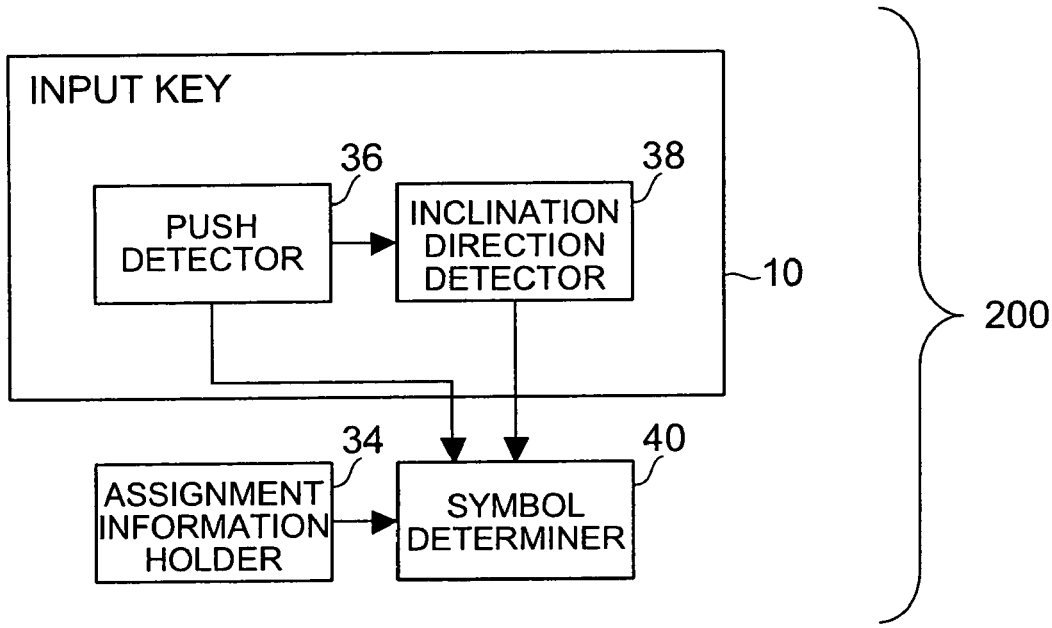
FIG. 16 is another example of a functional block diagram of an input apparatus in the first embodiment.

In the present embodiment the push detector 36 and the inclination direction detector 38 are constructed separately from the input key 10, but they may be constructed integrally with the input key 10 as shown in FIG. 16.

The above system adopts the key input based on one symbol per push, but it is also possible to adopt continuous input of symbols based on continuation of a push state on the input key 10 as described below.

In the above-stated system, the inclination direction of the key top 220 was determined when the push on the input key 10 was finished, that is, when the duration to of the non-conducting state exceeded the constant value $T_0$ (>0). Then the inclination direction is also determined if the following condition is satisfied.

$t_i > C_i$ (i=any one of A to E)

Here $C_i$ is a positive constant value and is an appropriate time enough to assume that the input key 10 was pushed, e.g., a value of two to several seconds. When the push state on the input key 10 further continues after satisfying the above condition, the inclination direction is determined every time the following condition is met.

$t_i > C_i + nDC_i$ (i=any one of A to E) (n=1, 2, . . . )

Here $DC_i$ is a positive constant value and value indicating an appropriate time enough to assume that a symbol was entered continuously twice or more times through the input key 10. Since that time is normally a time shorter than that of the first input, it is preferable to set $C_i > DC_i$.

As the inclination direction is also determined where the above conditions are met, the inclination direction of the key top 220 is determined during continuation of the push state, at appropriate intervals during the continuation, thus enabling the continuous input on the key.

Incidentally, the above embodiment showed the input example of the Japanese hiragana writing symbols with FIG. 1, and in practice Japanese input requires input of several types of symbols including the katakana writing symbols, numerals, and alphabet, in addition to the hiragana writing symbols. In connection therewith, the following will describe an example of input of several types of symbols, using an extra key (hereinafter referred to as a "symbol type designation key") provided for designating a type of a symbol to be inputted.

Figure 48:
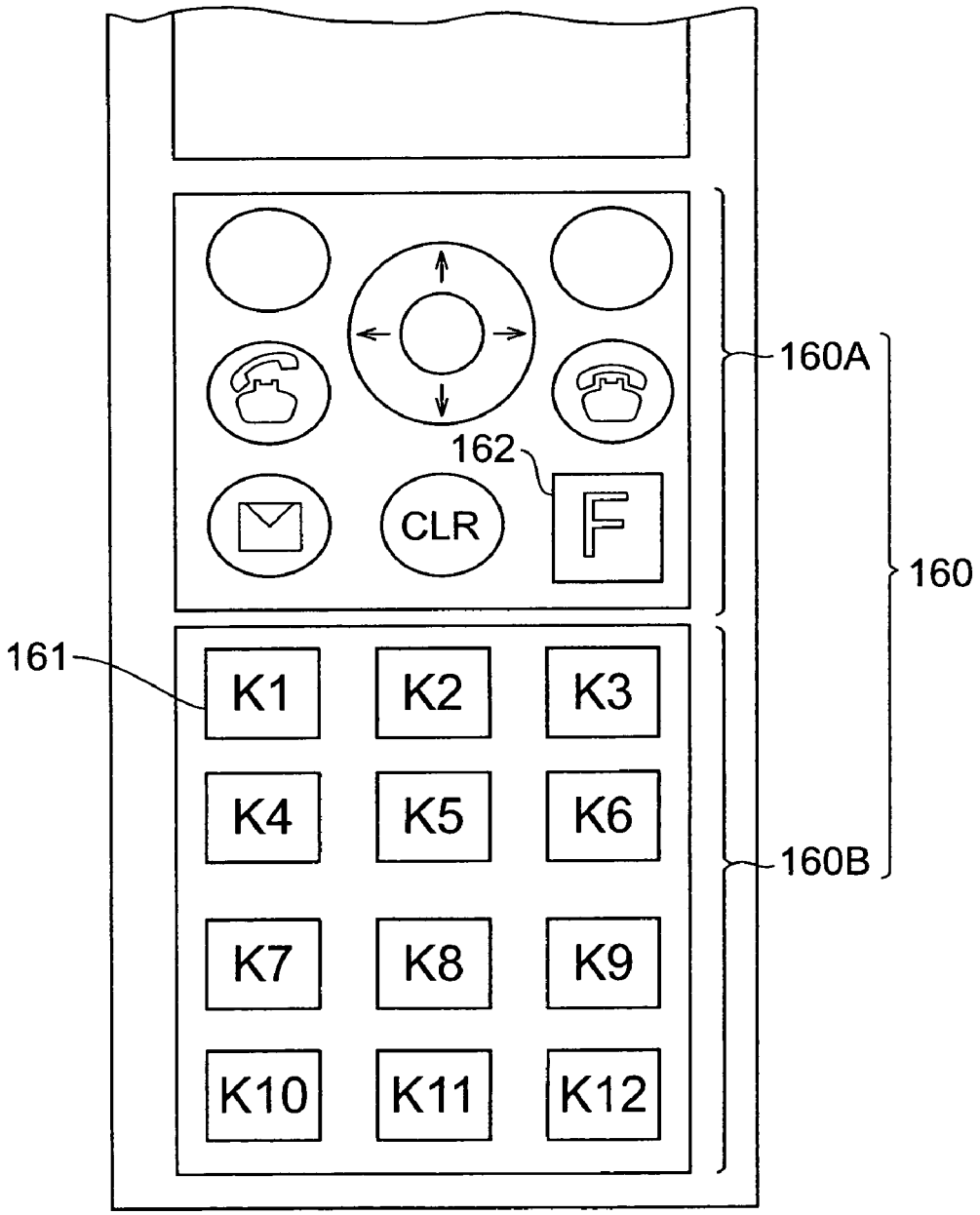
FIG. 48 is a configuration diagram of an input part of a cell phone in an example of implementing input of plural types of symbols.

For example, as shown in FIG. 48, an input portion 160 of a cell phone is composed of a special key arrangement part 160A and a symbol input key arrangement part 160B, wherein the symbol input key arrangement part 160B includes twelve (three horizontal×four vertical) keys 161 and wherein the special key arrangement part 160A includes a symbol type designation key (hereinafter abbreviated as an "F key") 162.

Figure 49:
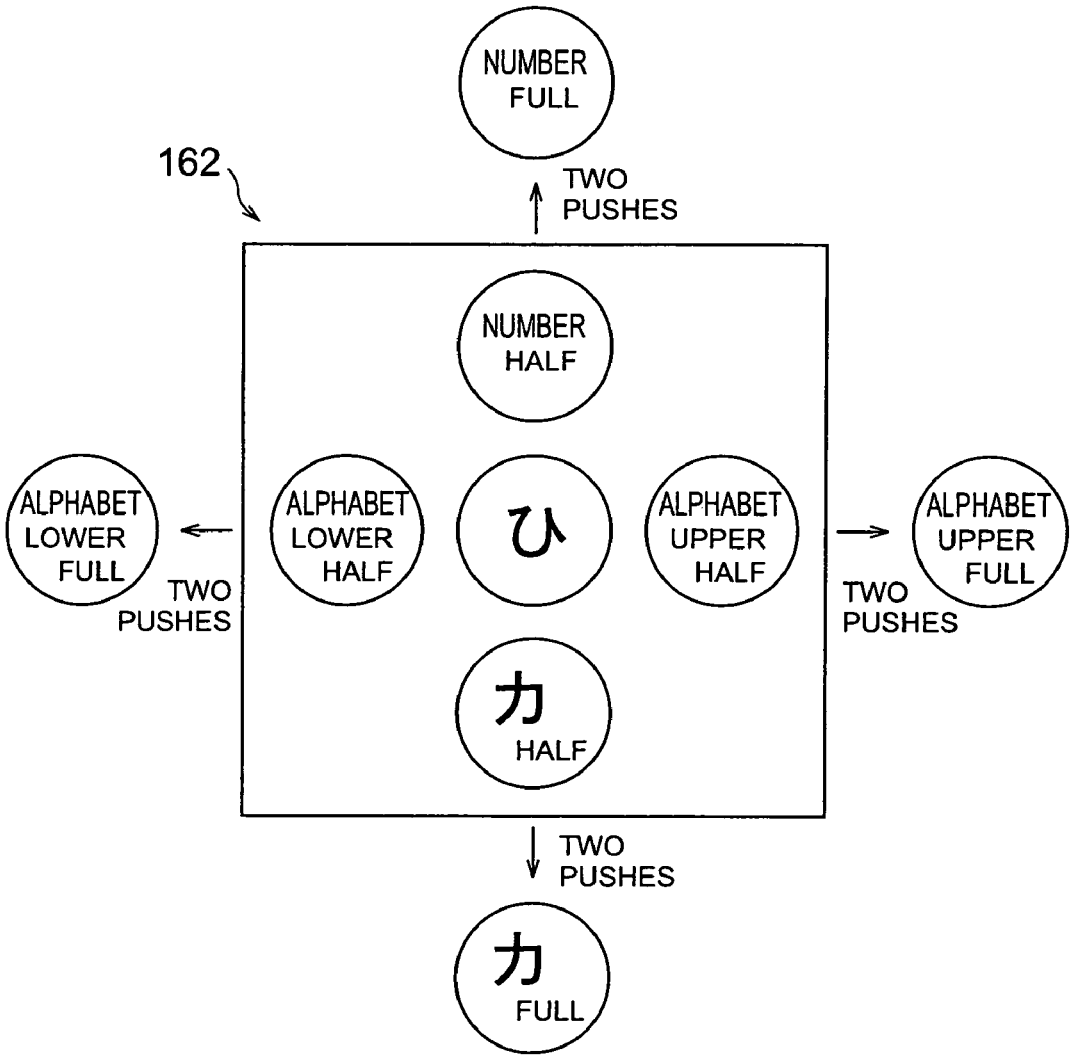
FIG. 49 is an illustration for explaining designation of symbol types assigned to an F key.

As shown in FIG. 49, the F key 162 is assigned symbol type designations for respective moving directions as follows. The F key 162 is so arranged that symbol types tending to be frequently inputted can be designated by one operation (a movement of a finger), for example, center (still)-hiragana writing symbols, upward-half-width (one byte) numbers, leftward-half-width English lower-case symbols, downward-half-width katakana writing symbols, and rightward-half-width English upper-case symbols. The F key 162 is so configured that the symbol types other than the above can be designated by two operations. Namely, as shown in the space outside the frame of the F key 162 in FIG. 49, the symbol type of full-width (two bytes) numbers can be designated by two continuous upward movements of a finger, and the symbol type of full-width English lower-case symbols by two continuous leftward movements of a finger. The symbol type of full-width katakana writing symbols can be designated by two continuous downward movements of a finger, and the symbol type of full-width English upper-case symbols by two continuous rightward movements of a finger. In this manner two continuous movements of a finger in a specific direction enable designation of a symbol type different from that designated by only one movement of a finger in that specific direction, thus providing expandability about designation of symbol types.

The symbol assignment to the twelve keys 161 in the symbol input key arrangement part 160B is, for example in the case of the hiragana writing symbols, that as shown in FIG. 50. Since the hiragana writing symbols can be classified under the symbol groups each consisting of five symbols like "five symbols in the あline group", "five symbols in the かline group" . . . , as described previously, one symbol group (five symbols) can be assigned to one key 161. As shown in the table format of FIG. 50, the key K1 is assigned the "five symbols (あ, い, う, え, お) in the あ line group", and the key K2 the "five symbols (か, き, く, け, こ) in the かline group". In this manner, one symbol group (five symbols) can be assigned to one key 161.

As shown in the assignment to the keys K10, K11 in the table of FIG. 50, frequently input marks (cho-on (long sound), kuten (Japanese period), touten (Japanese comma), etc.) other than the hiragana writing symbols can also be assigned.

Furthermore, the special symbols among the hiragana writing symbols include an example of display of symbols in size smaller than usual (e.g., "や", "つ", etc.), an example of display of voiced consonants (e.g., "ざ", "が", etc.), and an example of display of p-sounds (e.g., "ぱ", "ぴ", etc.). In addition, the hiragana writing symbols are often converted into katakana small symbols or katakana large symbols. Therefore, as shown in the assignment to the key K12 in the table of FIG. 50, it is also possible to assign the above-described functions of "conversion to small symbol", "conversion to voiced consonant", "conversion to p-sound", "conversion to katakana small symbol", and "conversion to katakana large symbol".

The above described the key assignment about the input of the Japanese hiragana writing symbols, but the present invention, which facilitates the input operation by assigning a plurality of symbols, marks, or functions to one key as shown in FIG. 50 and decreasing the number of key input operations, can also be applied to input of symbols in the other languages. Examples of application of the present invention to input of English, German, French, Chinese, and Korean symbols will be described below.

Figure 52:
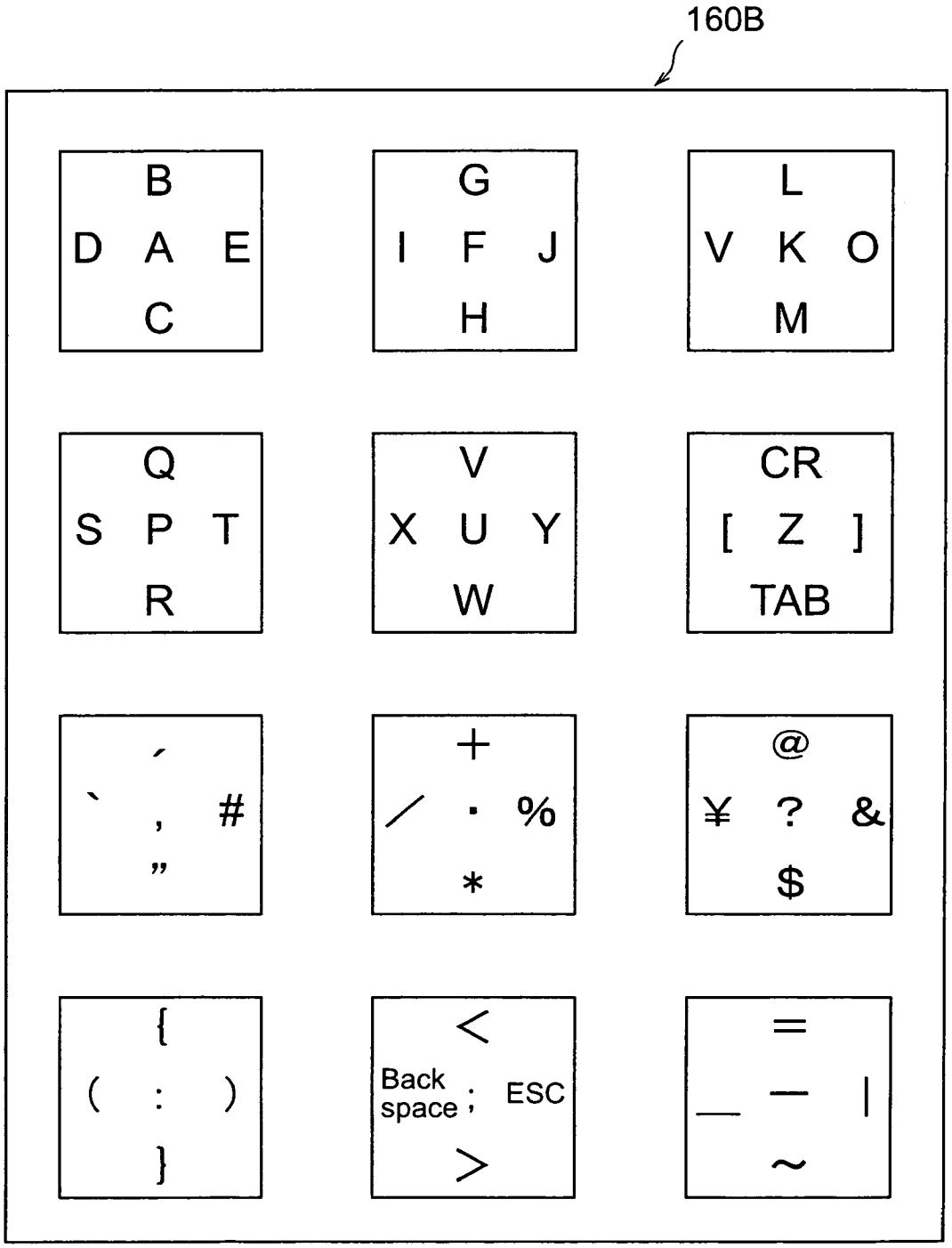
FIG. 52 is an illustration showing a state in which alphabet letters and marks are assigned to each of keys on the basis of the assignment table of FIG. 51.

First, an example of application of the present invention to input of English symbols will be described. The English symbols (alphabet) include twenty six symbols in total, and are not grouped into symbol groups each consisting of five symbols, different from the Japanese hiragana writing symbols. Thus a conceivable method is to assign five symbols to each key in order from the top of the alphabet (A, B, C, . . . ), as shown in FIG. 51. In that case, the keys K1–K6 are enough to assign all the twenty six symbols, and many keys are still left. Therefore, many marks (e.g., return (CR), tab ($T_{AB}$), . . . ) can be assigned to the remaining keys. The assignment table of FIG. 51 shows the assignment of the alphabet and marks to the keys (K1–K12), and FIG. 52 shows an example of actual assignment to each of the keys (K1–K12) in the symbol input key arrangement part 160B (cf. FIG. 48), based on the assignment table.

This enables one to input the symbol types equivalent to those through the full keyboard by one operation (a movement of a finger). Namely, the function equivalent to that of the full keyboard can be substantialized by the smaller number of input keys, and the input of symbols can be implemented by the reduced number of input operations, thus dramatically improving the efficiency of input operation.

A switchover among four symbol types of half-width English lower-case symbols, full-width English lower-case symbols, half-width English upper-case symbols, and full-width English upper-case symbols can be implemented by manipulating the F key 162 in FIG. 48. FIG. 49 shows the F key 162 in Japanese, and, since the English does not include the hiragana and katakana writing symbols, all the four symbol types can be assigned to the four directions of the F key 162 in FIG. 48, whereby one can designate a desired English symbol type by one operation on the F key 162.

The assignment of the alphabet and marks to each of the keys (K1–K12) in FIG. 51 can also be applied to input of English symbols in Japanese.

Next, an example of application of the present invention to input of the German symbols will be described. For input of the German symbols, it is necessary to input peculiar symbols such as symbols with the Umlaut mark (e.g., Ä, Ö, Ü, etc.) and β (Eszett), in addition to the input of the same alphabet as in English.

Thus the peculiar symbols as described above can replace the mark-assigned portions in the assignment table of FIG. 51, whereby the input of the symbol types equivalent to those through the full keyboard can be implemented by one operation (a movement of a finger). Namely, the function equivalent to that of the full keyboard can be substantialized by the smaller number of input keys, and the input of symbols can be implemented by the reduced number of input operations, thus dramatically improving the efficiency of input operation.

Next, an example of application of the present invention to input of the French symbols will be described. In order to input the French symbols, it is necessary to input the peculiar symbols as described below, in addition to the input of the same alphabet as in English. Namely, the peculiar symbols are é (accent aigu), à, è, ù (accent grave), â, î, û, ê, ô (accent circonflexe), ï, ü, ë (tréma), c (cédille), œ (o e composé), and so on.

Thus the peculiar symbols as described above can replace the mark-assigned portions in the assignment table of FIG. 51, whereby the input of the symbol types equivalent to those through the full keyboard can be implemented by one operation (a movement of a finger), as in the case of the English input. Namely, the function equivalent to that of the full keyboard can be substantialized by the smaller number of input keys, and the symbol input can be implemented by the reduced number of input operations, thus dramatically improving the efficiency of input operation.

Next, an example of application of the present invention to input of the Chinese symbols will be described. A common Chinese symbol input method is the pin-yin input system of inputting an alphabet sequence (pin-yin) equivalent to the reading (pronunciation) of a symbol as an input object. This pin-yin input system is classified under two input methods of complete pin input and bi-pin input.

The complete pin input uses the English keyboard as it is, and pin-yin is inputted in each symbol unit according to the alphabetical notation on the keyboard. For example, where Chinese "今天晴" corresponding to "今日は晴れです (sunny today)" is inputted, an alphabet sequence "JIN" corresponding to the reading (pronunciation) of "今", an alphabet sequence "TIAN" corresponding to the reading (pronunciation) of "天", and an alphabet sequence "QING" corresponding to the reading (pronunciation) of "晴" are inputted in order according to the alphabet notation on the English keyboard. Therefore, the key assignment as shown in FIG. 51 and FIG. 52 can be adopted for the complete pin input, as in the case of the aforementioned example of application of the present invention to the English symbol input, and it becomes feasible to input the symbol types equivalent to those through the full keyboard by one operation (a movement of a finger), thus dramatically improving the efficiency of symbol input operation.

On the other hand, the bi-pin input is a way of inputting each symbol by separate use of Chinese 声母(head consonant) and 韻母(subsequent vowel component). Here the "声母" means a consonant at the head of a syllable, and "韻母" means a portion except for the head consonant in the syllable, the "韻母" always containing a vowel. In the bi-pin input, symbols are inputted by switching in an order of 声母(consonant)→韻母 (vowel component)→声母 (consonant)→ 韻母(vowel component). Namely, this input method involves a device of reducing the number of typing operations on the keyboard by the separate use of 声母 and 韻母, and, once one learns the keyboard arrangement of the bi-pin input, he or she can input symbols by the smaller number of input operations than by the aforementioned complete pin input, so as to realize efficient symbol input.

The bi-pin input of this type requires two key assignments, 声母(head consonant) key assignment for input of 声母 and 韻母(subsequent vowel component) key assignment for input of 韻母. The present invention can be applied to these 声母key assignment and 韻母key assignment. For example, FIG. 53(*a*) shows an example of the 声母key assignment. The key K1 is assigned five 声母(consonants) (b, c, ch, f, g), and which consonant was inputted can be determined by a moving direction of a finger on the key K1. The keys K2–K5 can also be assigned consonants in similar fashion. FIG. 53(*b*) shows an example of the 韻母key assignment. The key K1 is assigned five 韻母(vowel components) (a, ai, an, ang, ao), and which vowel component was inputted can be determined by a moving direction of a finger on the key K1. The keys K2–K7 can also be assigned vowel components in similar fashion.

In the bi-pin input, symbols are inputted by switching in the order of consonant→vowel component→consonant→vowel component as described above, and the key assignment is arranged to become the consonant key assignment of FIG. 53(*a*) upon input of a consonant and to become the vowel component key assignment of FIG. 53(*b*) upon input of a vowel component.

In the bi-pin input, as described above, the consonant and vowel component key assignments as shown in FIG. 53 enable one to input the symbol types equivalent to those through the full keyboard by one operation (a movement of a finger). Namely, the function equivalent to that of the full keyboard can be substantialized by the smaller number of input keys, and the symbol input can be implemented by the reduced number of input operations, thereby dramatically improving the efficiency of input operation.

In the Chinese input, the marks (e.g., !, ?, etc.) other than the symbols are also often inputted. It is thus desirable to assign the various types of marks to the remaining portions in the key assignments of FIG. 53, just as in the case of the assignment example of the English symbols in FIG. 51, thereby achieving efficient input as to input of marks as well.

Lastly, an example of application of the present invention to input of the Korean symbols will be described. Each Korean symbol (hangul symbol) is composed of a combination of a consonant with a vowel. Therefore, for symbol input, it is necessary to input a consonant-indicating part and a vowel-indicating part for each symbol. There are nineteen consonants and twenty one vowels, and forty portions indicating the total of these forty sounds are assigned to keys. An example of this assignment is presented in FIG. 54. In FIG. 54, portions surrounded by thick line 163 represent the nineteen portions indicating the consonants, and the other twenty one portions correspond to the portions indicating the vowels.

Since the keys can be assigned the forty portions indicating the respective sounds, the forty sounds in total including the nineteen consonants and twenty one vowels, as described above, it becomes feasible to input the symbol types equivalent to those through the full keyboard by one operation (a movement of a finger). Namely, the function equivalent to that of the full keyboard can be substantialized by the smaller number of input keys, and the symbol input can be implemented by the reduced number of input operations, thereby dramatically improving the efficiency of input operation.

In the Korean input, the marks (e.g., !, ?, etc.) other than the symbols are also often inputted. It is thus desirable to assign the various types of marks to the remaining keys (keys K9–Kl2) in the key assignment of FIG. 54, just as in the case of the assignment example of the English symbols in FIG. 51, thereby achieving efficient input as to the input of marks as well.

As described above, the present invention is applicable to input of symbols in various languages, and achieves the excellent effects of substantializing the function equivalent to that of the full keyboard by the smaller number of input keys and enabling the symbol input by the reduced number of input operations, thereby dramatically improving the efficiency of input operation.

Second Embodiment

Figure 17:
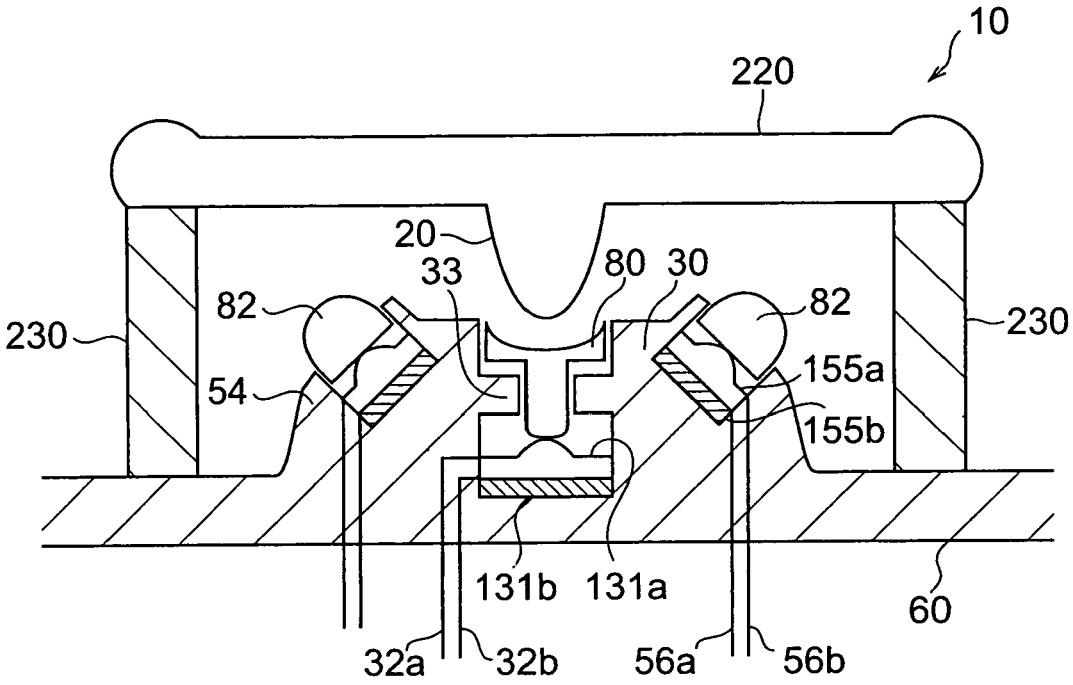
FIG. 17 is a vertical sectional view of an input key in the second embodiment.

FIG. 17 shows a vertical cross section of an input key 10 in the second embodiment. The exterior configuration and the functional configuration of input apparatus 200, the flow of processing, etc. are similar to those in the first embodiment unless otherwise stated.

As shown in FIG. 17, the key top supported portion 20 of a protruding shape is provided in the center on the opposite surface in the key top 220 to the support plate 60. In the present embodiment, the key top supported portion 20 is not provided with an electrode, different from the first embodiment.

Figure 18:
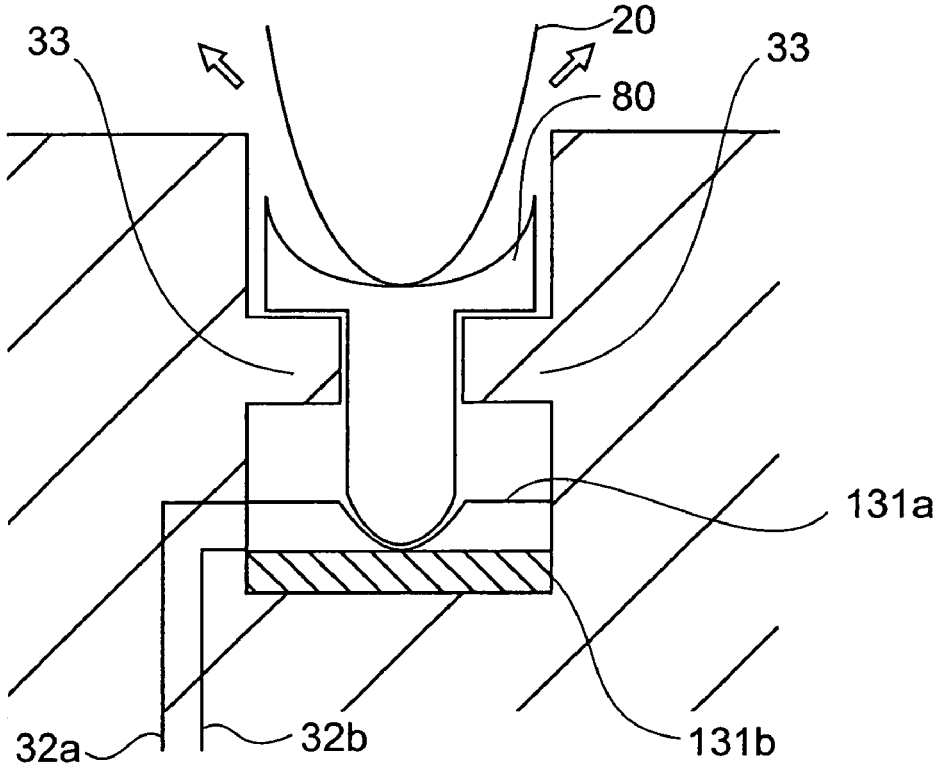
FIG. 18 is an illustration showing a piston part in a push on an input key in the second embodiment.

As shown in FIG. 17, the key top supporting portion 30 is provided on the support plate 60. The key top supporting portion 30 rises from the other part of the support plate 60 and is located with a clearance to the opposed part of the key top supported portion 20. A piston 80 is provided in a part of the key top supporting portion 30 to come into contact with the key top supported portion 20. The piston 80 is constructed so that a part thereof to come into contact with the key top supported portion 20 is of a semispherical concave shape in accordance with the distal shape of the key top supported portion 20, and is arranged to be able to support the key top 220 with the key top supported portion 20 serving as a fulcrum during a push on the input key 10, as shown in FIG. 18. The key top supporting portion 30 has an embossed structure portion 131*a* made of an embossed sheet or the like in the part pushed by the piston 80 under pressure from the key top supported portion 20, and an electrode 131*b* is located with a clearance below the embossed structure portion 131*a*. The embossed structure portion 131*a* is provided with an electrode, and is constructed in a configuration wherein when the embossed structure portion 131*a* becomes dented to the lower side under force through the key top supported portion 20 and piston 80 during a push on the key top 220, the electrode part comes into contact with the electrode 131*b* provided below. This contact brings the wiring line 32*a* connected to the electrode of the embossed structure portion 131*a* and the wiring line 32*b* connected to the electrode 131*b* provided below the embossed structure portion 131*a*, through those electrodes into an electrically conducting state, whereby the push detector 36 detects the conducting state and detects a push on the input key 10. As shown in FIG. 18, the key top supporting portion 30 is provided with a stopper 33 against the piston 80 in order to prevent the piston 80 from applying the pressure more than necessary to the embossed structure portion 131*a*. The inclination detectors 54 in the respective directions of up, down, left, and right in the support plate 60 are also constructed in structure similar to that of the above key top supporting portion 30, while each being provided with a piston 82, an embossed structure portion 155*a*, an electrode 155*b*, and wiring lines 56*a*, 56*b*, as shown in FIG. 17. A contact of an inclination detector 54 with the key top 220 is also detected in a manner similar to the above.

When the user pushes the input key 10, the key top is subject to reaction from the embossed structure portion 131*a* of the key top supporting portion 30 before the force of the push reaches a given level. Once the force applied exceeds the given level, the embossed structure portion 131*a* collapses at a stretch to become dented, so as to decrease the reaction at a breath. When the user pushes the input key 10 with a finger, the user can sense the decrease of the reaction at a fingertip. As the user lifts the finger from the input key 10, the embossed structure portion 131*a* gradually returns from the dented state of the central bulging portion to the original state, to elevate the input key 10. When the embossed structure portion returns to a certain shape, the central bulging portion suddenly generates a strong restoring force to quickly increase the force to lift the input key 10. In the dented state of the embossed structure portion 131*a*, the line 32*a* and the line 32*b* are in the conducting state through the electrodes as described above to detect a push on the input key 10. When the push force is eliminated, the central bulging portion of the embossed structure portion 131*a* recovers, and a non-conducting state is established, whereby an end of the push is detected.

In the dented state of the embossed structure portion 131*a* during a push on the input key 10, the key top supported portion 20 is supported by the embossed structure portion 131*a*, and thus the inclination of the key top 220 is made in a stable state in which the key top supported portion 20 in the supported state functions as a fulcrum.

The detection of the inclination of the key top 220 is also carried out in a manner similar to the detection of the push by the structure of the inclination detectors 54.

As described above, the input apparatus 200 of the present embodiment enables stabler input, and permits the user to have a touch of a push and inclination of the key top 220, so called a "click feel". There is no need for provision of electrodes or the like on the key top 220, which can further simplify the structure of the key top 220.

Figure 29:
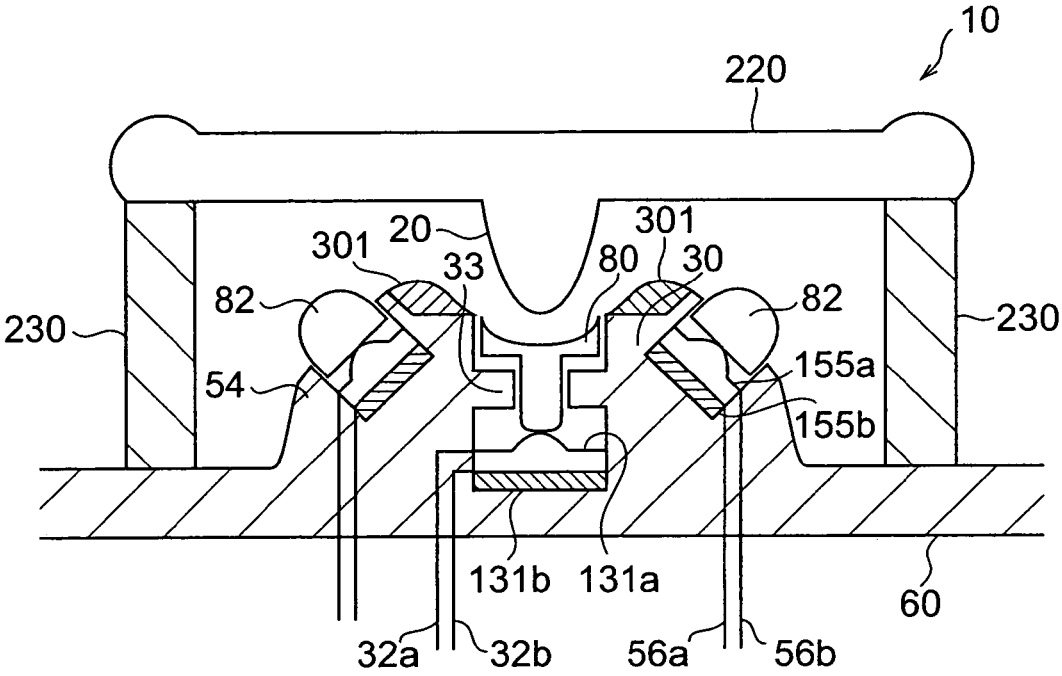
FIG. 29 is a vertical sectional view of an input key in another example in the second embodiment.

In the present embodiment, as shown in FIG. 29, a guard portion 301 bulging high so as to achieve easier support of the key top supported portion 20 may be provided around the part to support the key top supported portion 20, in the key top supporting portion 30.

Figure 26:
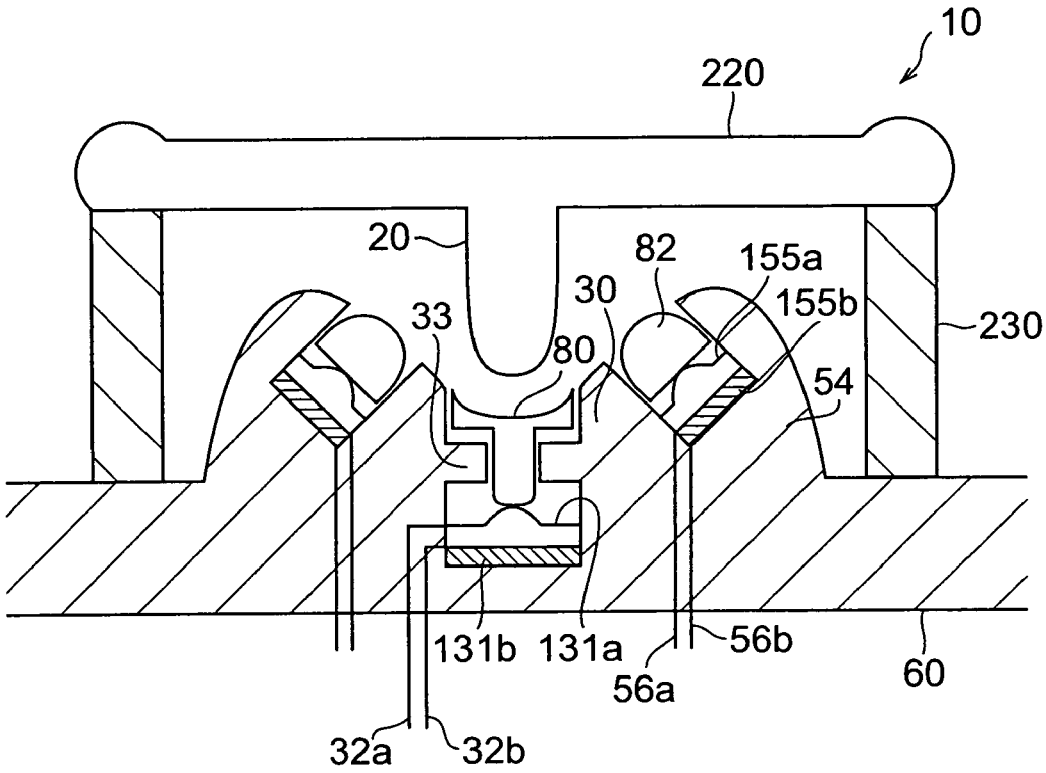
FIG. 26 is a vertical sectional view of an input key in another example in the second embodiment.

In the present embodiment, as shown in FIG. 26, it is also possible to adopt a structure wherein during an inclination of the key top 220 a piston 82 of an inclination detector 54 comes into contact with the key top supported portion 20 to be pushed.

Third Embodiment

Figure 19:
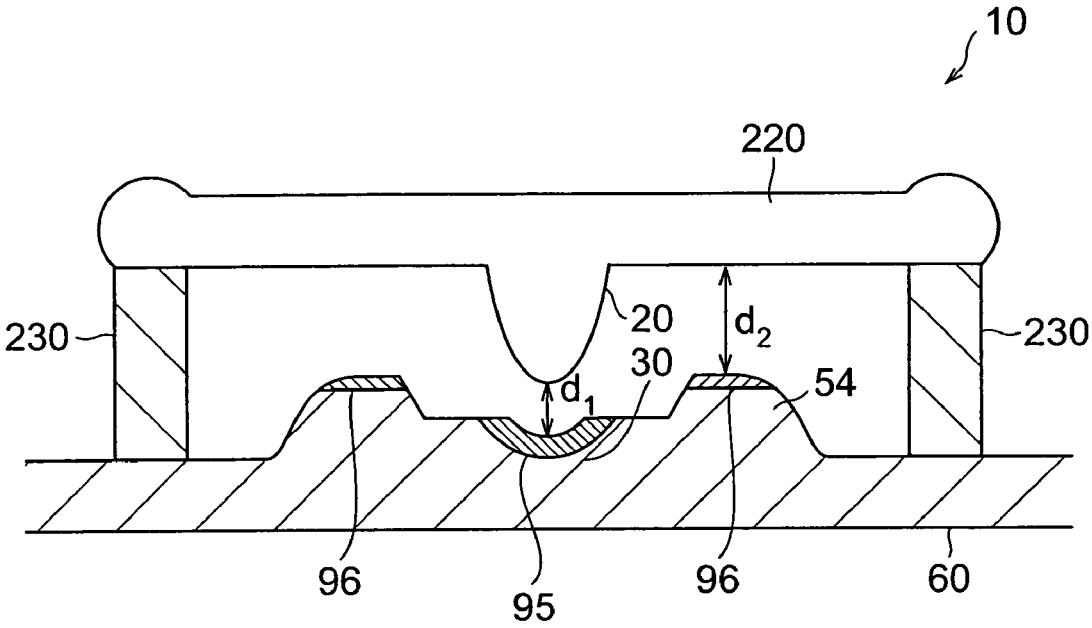
FIG. 19 is a vertical sectional view of an input key in the third embodiment.

FIG. 19 is a vertical cross section of an input key 10 in the third embodiment. The exterior configuration and the functional configuration of input apparatus 200, the flow of processing, etc. are similar to those in the first embodiment unless otherwise stated.

As shown in FIG. 19, the key top supported portion 20 of a protruding shape is provided in the center on the opposite surface in the key top 220 to the support plate 60. In the present embodiment, different from the first embodiment, the key top supported portion 20 is provided with no electrode.

The key top supporting portion 30 is provided so as to rise from the other part of the support plate 60, on the support plate 60 (as being integral with the support plate 60), and is located with a clearance to the opposed portion of the key top supported portion 20. When the key top 220 is pushed, the key top supporting portion 30 comes into contact with the key top supported portion 20. The contact part of the key top supporting portion 30 is of a semispherical concave shape so as to be able to support the convex part at the tip of the key top supported portion 20.

The inclination detectors 54 are provided in the respective directions of up, down, left, and right around the key top supporting portion 30 on the support plate 60 and are arranged to further rise from the key top supporting portion 30.

Pressure detecting sheets 95, 96 are attached to the concave part of the key top supporting portion 30 and to the distal ends of inclination detectors 54, respectively. The pressure detecting sheets 95, 96 have a plurality of piezoelectric devices embedded therein, and are able to detect pressure of contact when the key top 220 is pushed and inclined to bring the key top supported portion 20 or the key top 220 into contact with the key top supporting portion 30 or with the inclination detector 54. This enables detection of the push and inclination of the key top 220. The support plate 60 itself is made of an elastically deformable material.

When the user pushes the key top 220, the key top supported portion 20 comes into contact with the pressure detecting sheet 95 to push the pressure detecting sheet 95. This push generates a voltage in a piezoelectric device in the pushed part, buried in the pressure detecting sheet 95, and the push is detected by sensing the voltage.

Figure 20:
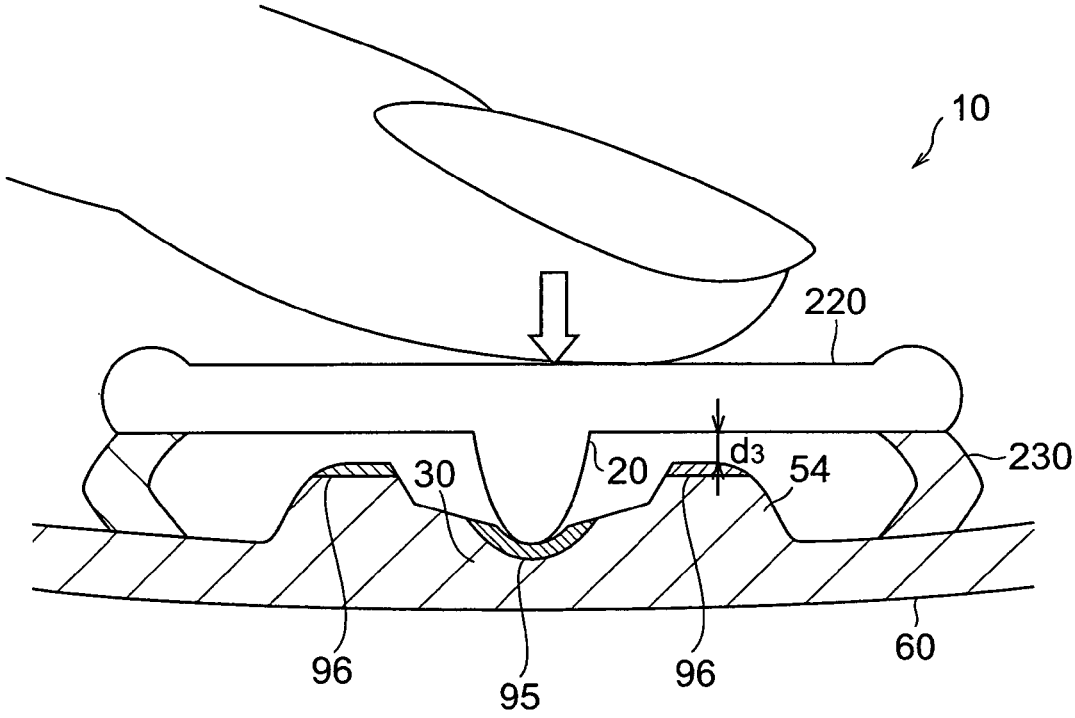
FIG. 20 is an illustration showing an example of a state during a push on an input key in the third embodiment.
Figure 21:
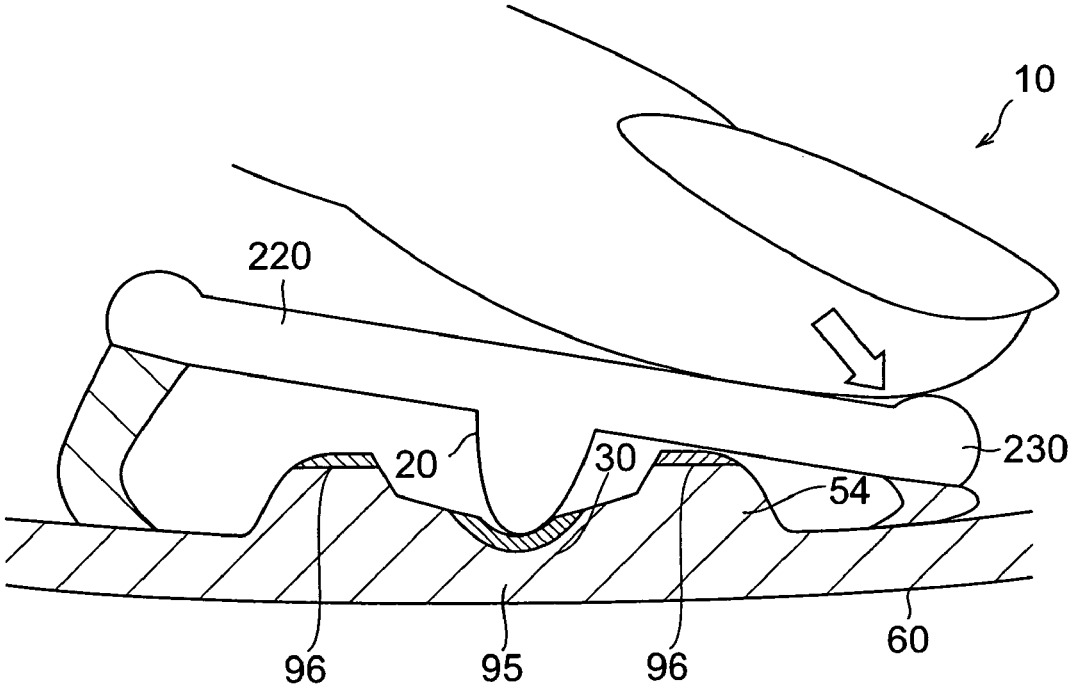
FIG. 21 is an illustration showing an example of a state during a push on an input key in the third embodiment.

Since the support plate 60 is made of an elastically deformable material, it deforms so as to become dented in the pushed part as shown in FIG. 20 when pushed by the key top supported portion 20. When deformed as described above, the distance $d_3$ between the inclination detectors 54 and the key top 220 becomes smaller than the distance in a state in which the support plate 60 is not elastically deformed (i.e., the distance of $(d_2-d_1)$ in FIG. 19). Therefore, as shown in FIG. 21, the amount of the inclination of the key top 220 becomes smaller, so as to facilitate the inclination of key top 220. The inclination is made in a stable state in which the key top supported portion 20 supported in the concave dent part of the key top supporting portion 30 functions as a fulcrum.

When the key top 220 is inclined to bring the key top 220 into contact with an inclination detector 54, the inclination can be detected in a manner similar to the above by the pressure detecting sheet 96.

As described above, the input apparatus 200 of the present embodiment enables stabler input in the simpler structure. The inclination of the key top 220 for information input becomes easier.

Fourth Embodiment

Figure 22:
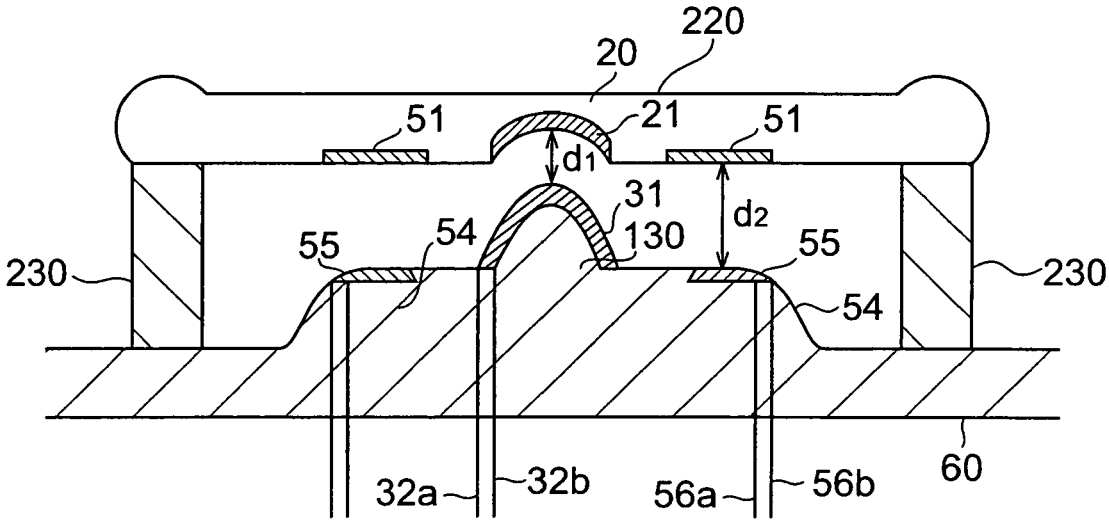
FIG. 22 is a vertical sectional view of an input key in the fourth embodiment.

FIG. 22 shows a vertical cross section of an input key 10 in the fourth embodiment. The exterior configuration and functional configuration of input apparatus 200, the flow of processing, etc. are similar to those in the first embodiment unless otherwise stated.

As shown in FIG. 22, the key top supported portion 20 of a smoothly concave dent shape in the center is provided on the opposite surface in the key top 220 to the support plate 60. An electrode 21 is attached to the concave surface part of the key top supported portion 20. The key top supporting portion 30 is of a protruding shape, is provided on the support plate 60 so as to rise from the other part of the support plate 60 (as being integral with the support plate 60), and is located with a clearance to the opposed part of the key top supported portion 20. When the key top 220 is pushed, the key top supporting portion 30 comes into contact with the key top supported portion 20. The contact part of the key top supporting portion 30 is of a semispherical convex shape so as to be able to support the concave part at the tip of the key top supported portion 20. The concavo-convex structure of the key top supported portion 20 and the key top supporting portion 30 enables the key top supported portion 20 to incline together with the key top 220 in a state in which the key top 220 is pushed to be supported on the key top supporting portion 30. An electrode 31 is attached to the convex part of the key top supporting portion 30. The wiring line 32*a* and wiring line 32*b* are connected to the electrode 31 to detect a push on the input key 10 as described in the first embodiment.

As described in the first embodiment, the inclination detectors 54 are provided in the respective directions of up, down, left, and right around the key top supporting portion 30 on the support plate 60 and are able to detect an inclination of the key top 220. It is assumed herein that the relation of $d_1<d_2$ is satisfied by the distance $d_1$ between the key top supported portion 20 and the key top supporting portion 30 and the distance $d_2$ between the inclination detectors 54 and the key top 220 in a state in which no force is applied to the key top 220. This is for assuring establishment of a state in which the key top supported portion 20 comes into contact only with the key top supporting portion 30 when a force vertical to the key top 220 is exerted, and is also for assuring establishment of a state in which the key top supported portion 20 is always supported by the key top supporting portion 30 when an inclination detector 54 is in contact with the key top 220. Namely, this is for assuring establishment of a state in which a clearance is secured for a structure wherein the key top supported portion 20 comes into contact only with the key top supporting portion 30 and an inclination detector 54 is not in contact with the opposite surface when a force vertical to the key top 220 is exerted, and a push vertical to the key top 220 can be achieved surely, and is also for assuring establishment of a state in which the key top supported portion 20 supported on the key top supporting portion 30 is made to function as a fulcrum of inclination during the inclination of the key top 220.

As described above, the input apparatus 200 of the present embodiment enables stabler input, without providing the key top 220 with the protruding portion.

Figure 23:
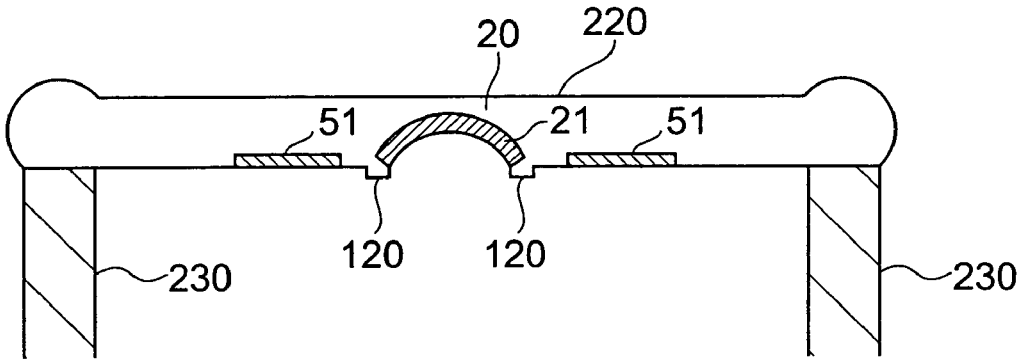
FIG. 23 is an illustration showing an example of a key top in the fourth embodiment.

In the present embodiment, in order to achieve easier support of the key top supported portion 20 by the key top supporting portion 30, a guard portion 120 may be provided around the concave depression of the key top supported portion 20 as shown in FIG. 23.

Figure 24:
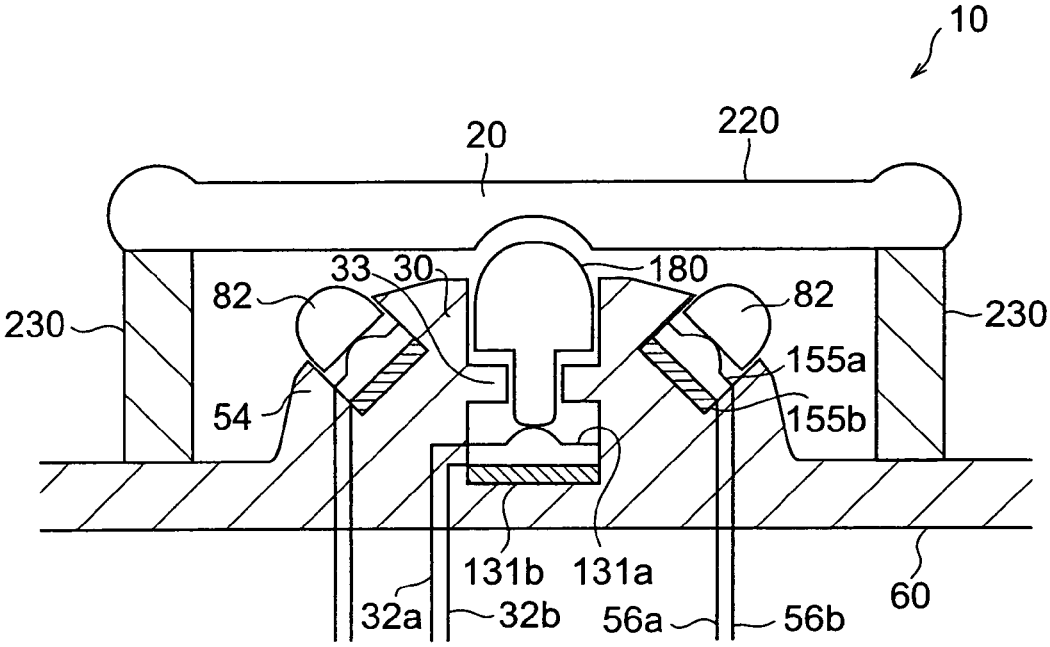
FIG. 24 is a vertical sectional view of an input key in another example in the fourth embodiment.
Figure 30:
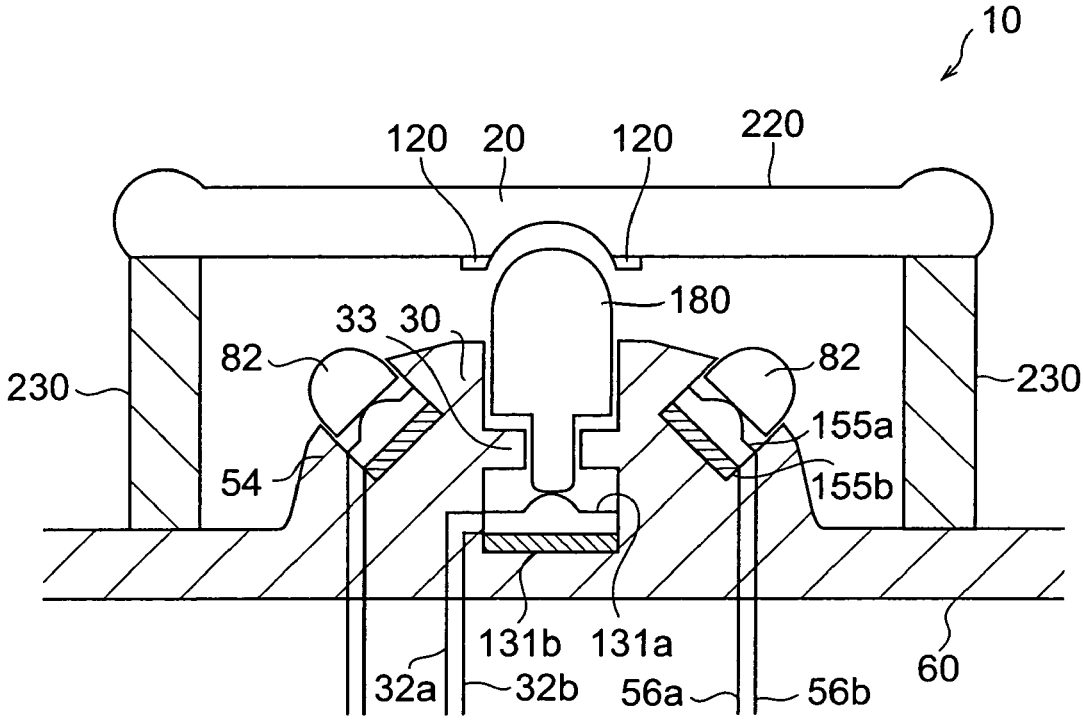
FIG. 30 is a vertical sectional view of an input key in another example in the fourth embodiment.

In the present embodiment, it is also possible to adopt a structure using a piston 180 as shown in FIG. 24. This structure obviates the need for providing the key top 220 with an electrode, so that the key top 220 can be constructed in simpler structure. Furthermore, as shown in FIG. 30, a guard portion 120 bulging high so as to achieve easier support of the key top supported portion 20 may be provided around the part supported by the key top supporting portion 30, in the key top supported portion 20.

Fifth Embodiment

The fifth to seventh embodiments hereinafter will successively describe configurations wherein the inclination detectors of the input key according to the present invention are provided in protruding shape on the key top (i.e., on the opposite surface to the support plate). The configuration of input apparatus 200 in the fifth embodiment is much the same as that of the input apparatus 200 in the first embodiment. Namely, the exterior configuration of input apparatus 200 is the aforementioned configuration of FIG. 1, and the functional configuration of the input apparatus 200 is the aforementioned configuration of FIGS. 3 and 4. Therefore, redundant description will be omitted herein.

Figure 31:
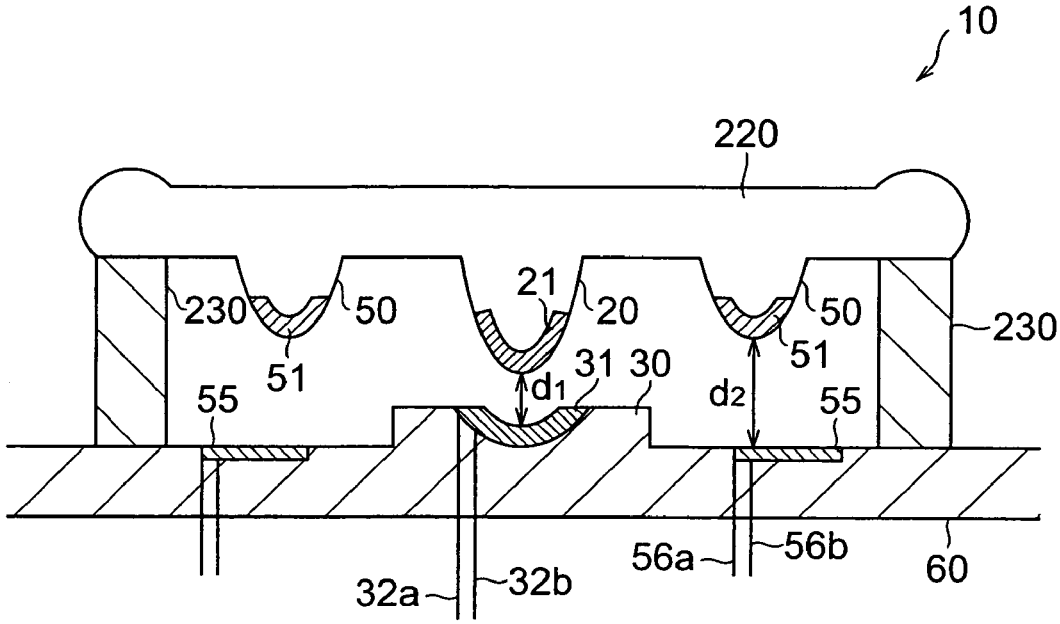
FIG. 31 is a vertical sectional view of an input key in the fifth embodiment.

FIG. 31 shows a vertical cross section of an input key 10 in the fifth embodiment. As shown in FIG. 31, an input key 10 is comprised of a key top 220, a key skirt 230, a key top supported portion 20, a key top supporting portion 30, and four inclination detectors 50 (two of which are shown) in the up, down, left, and right directions and is provided on a support plate 60.

Figure 33:
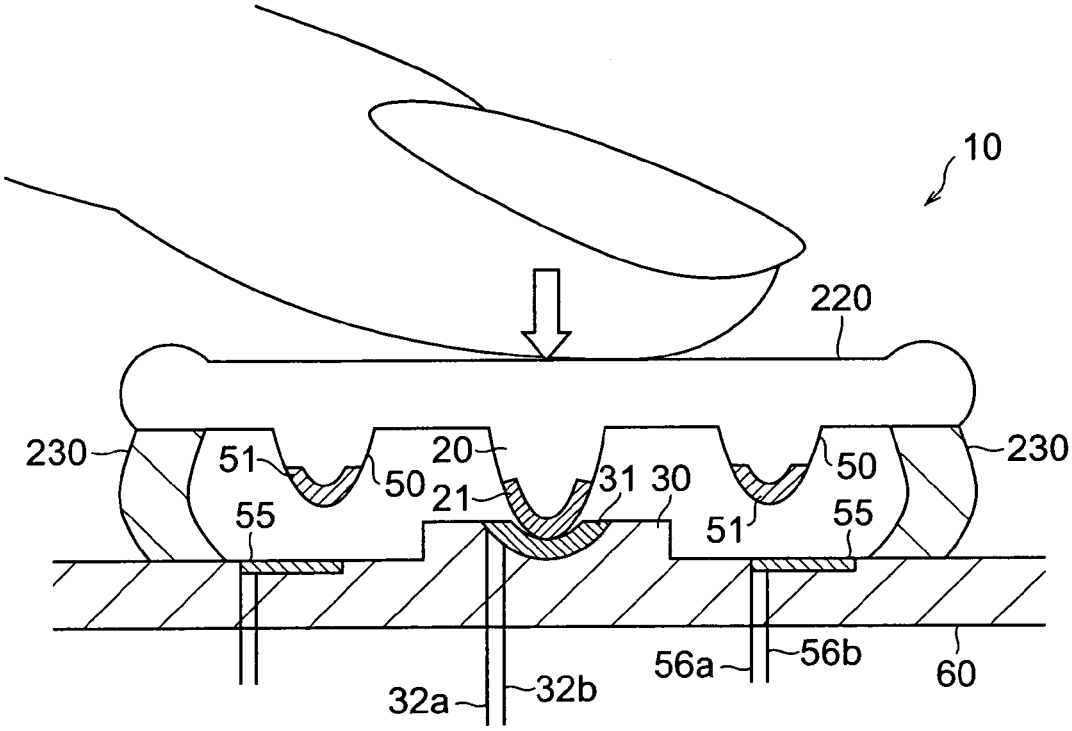
FIG. 33 is an illustration showing an example of a state during a push on an input key in the fifth embodiment.
Figure 34:
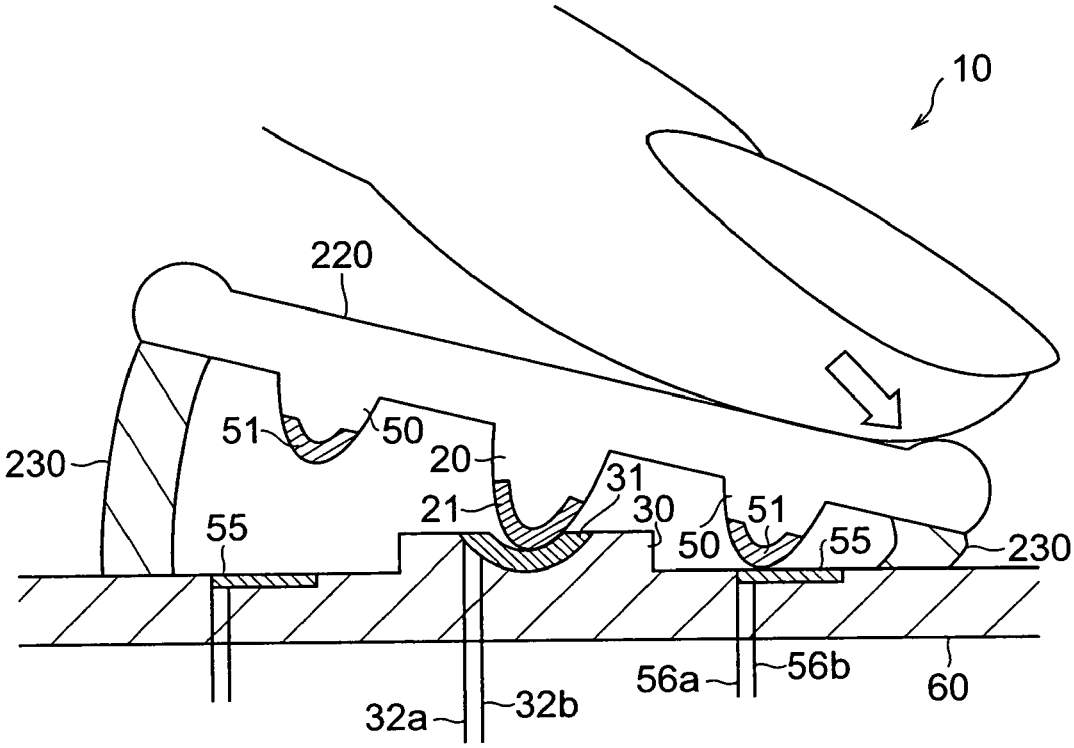
FIG. 34 is an illustration showing an example of a state during a push on an input key in the fifth embodiment.

The key top 220 is a part on which force is exerted during a push on the input key 10 and is made of a material with some hardness, e.g., hard plastic, metal, or the like, in order to enhance the sensation of the push on the key. The key skirt 230 is connected vertically to the support plate 60 and holds the key top 220 with a certain space from the support plate 60 in a state in which no force is exerted on the key top 220. The key skirt 230 is made of an elastically deformable material, e.g., synthetic rubber, soft plastic, soft vinyl, or the like. As shown in FIGS. 33 and 34, the elastic deformation of the key skirt 230 enables the key top 220 to undergo a push and inclination relative to the support plate 60. The periphery in the top surface of the key top 220 is of a bulging structure, in order to facilitate the inclination with a force applying finger or the like being caught during the inclination of the key top 220.

The key top supported portion 20 is provided in the center on the opposite surface in the key top 220 to the support plate 60. The distal end of the key top supported portion 20 is of a semispherical convex shape and an electrode 21 is attached to that part. The electrode 21 is made of a uniform conductor such as a metal piece. The key top supporting portion 30 is provided on the support plate 60 so as to rise from the other part of the support plate 60 (as being integral with the support plate 60) and is located with a clearance to the opposed part of the key top supported portion 20. When the key top 220 is pushed, the key top supporting portion 30 comes into contact with the key top supported portion 20. The contact part of the key top supporting portion 30 is of a semispherical concave shape so as to be able to support the convex part at the tip of the key top supported portion 20. As shown in FIG. 34, the concavo-convex structure of the key top supported portion 20 and the key top supporting portion 30 enables the key top supported portion 20 to incline together with the key top 220 in a state in which the key top 220 is pushed to be supported on the key top supporting portion 30. An electrode 31 is attached to the concave part of the key top supporting portion 30. As in the first embodiment, FIG. 7(*a*) shows a vertical cross section of the electrode 31, and FIG. 7(*b*) a top plan view of the electrode 31. As shown in FIGS. 7(*a*) and (*b*), the electrode 31 is provided with a plurality of electric contacts 31*a*, and those contacts 31*a* are connected to either the wiring line 32*a* or the wiring line 32*b*. When the input key 10 is pushed to establish contact between the key top supported portion 20 and the key top supporting portion 30 as shown in FIG. 33, the electrode 21 attached to the key top supported portion 20 comes into contact with a plurality of contacts 31*a* of the electrode 31 attached to the key top supporting portion 30, so that the wiring line 32*a* and the wiring line 32*b* turn into an electrically conducting state through the contacts 31*a* and electrode 21. This causes the push detector 36 to detect the conducting state and thereby detect a push on the input key 10.

Figure 32:
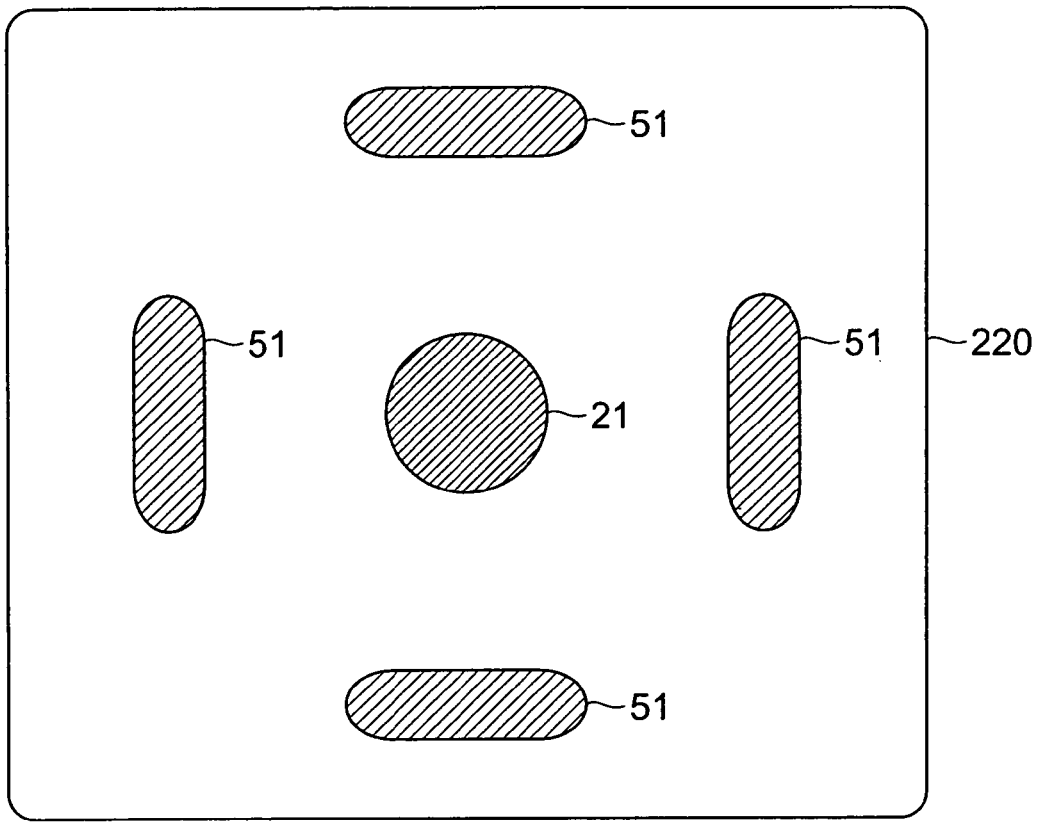
FIG. 32 is a plan view of an opposite surface in a key top to a support plate in the fifth embodiment.

The inclination detectors 50 are provided in the respective directions of up, down, left, and right on the opposite surface in the key top 220 to the support plate 60. The distal end of the inclination detectors 50 is of a semispherical convex shape and an electrode 51 is attached to that part of each detector as in the case of the key top supported portion 20. FIG. 32 shows the opposite surface in the key top 220 to the support plate 60. As shown in FIG. 32, the electrode 21 attached to the key top supported portion 20 is located in the center of the opposite surface, while the electrodes 51 attached to the inclination detectors 50 are located in the respective directions of up, down, left, and right. The inclination detectors 50 are arranged to come into contact with the support plate 60, as shown in FIG. 34, during a push with an inclination of the key top 220. Electrodes 55 are attached to portions of the contact in the support plate 60.

The electrodes 55 have the structure similar to the electrode 31 attached to the key top supporting portion 30 and detect contact of an inclination detector 50 with the support plate 60 in a manner similar to the detection of the contact between the key top supported portion 20 and the key top supporting portion 30. It is assumed herein that the relation of $d_1<d_2$ is satisfied by the distance $d_1$ between the key top supported portion 20 and the key top supporting portion 30 and the distance $d_2$ between the inclination detectors 50 and the support plate 60 in a state in which no force is exerted on the key top 220. This is for assuring establishment of a state in which the key top supported portion 20 comes into contact only with the key top supporting portion 30 when a force vertical to the key top 220 is exerted, and is also for assuring that the supported state of the key top supported portion 20 is always supported by the key top supporting portion 30 when an inclination detector 50 is in contact with the support plate 60. Namely, this is for assuring establishment of a state in which a clearance is secured for a structure wherein the key top supported portion 20 comes into contact only with the key top supporting portion 30 and an inclination detector 50 is not in contact with the opposite surface when a force vertical to the key top 220 is exerted, and a push vertical to the key top 220 can be achieved surely, and is also for assuring establishment of a state in which the key top supported portion 20 supported on the key top supporting portion 30 is made to function as an axis of an inclination during the inclination of the key top 220. In the present embodiment, the inclination detectors 50 are shorter than the key top supported portion 20, in order to satisfy this condition.

The detection of the contact may be implemented by any other method, e.g., a method of setting a button, a switch, or the like in the contact part and detecting the contact thereby, instead of the method of attaching the electrodes to the respective contact portions as described above.

The processing executed in the input apparatus 200 of the present embodiment will be described below with reference to the flowchart of FIG. 9.

When the user pushes the input key 10, the processing is started. The user pushes an input key 10 assigned a symbol to be inputted, while exerting a force on the key top 220 so as to incline it in a direction corresponding to the symbol to be inputted. For example, where the user desires to enter a symbol of "ゝ", the user pushes the input key 10*a* assigned "ゝ", while exerting the force so as to incline the key top 220 in the right direction corresponding to "ゝ" as shown in FIG. 34. Here how to incline the key top 220 in the direction corresponding to the symbol to be inputted is a method of once pushing the key top 220 vertically and then inclining the key top in a state in which the key top supported portion 20 is supported on the key top supporting portion 30. The user may push the key top 220 while directly inclining it. In that case, the key top supported portion 20 goes at an initial stage of a push into a state in which the key top supported portion 20 is supported in contact with the key top supporting portion 30, and the inclination thereafter is made in a state in which the key top supported portion 20 is supported on the key top supporting portion 30. This inclination method permits the user to perform a continuous operation, without being conscious of two-step operations of the push and inclination. In either of the two inclination methods, the inclination is achieved in a stable state in which the key top supported portion 20 supported on the key top supporting portion 30, functions as an axis.

The push establishes contact between the electrode 21 attached to the key top supported portion 20 and the electrode 31 attached to the key top supporting portion 30, as shown in FIGS. 33 and 34, whereby the line 32*a* and the line 32*b* turn into an electrically conducting state through contacts 31*a* and electrode 21. This causes the push detector 36 to detect the conducting state, to detect a start of the push on the input key 10, and to start counting a duration of the push (S11).

Subsequently, the inclination direction detector 38 detects an inclination of the key top 220 as shown in FIG. 34, in a manner similar to the method of the detection of the push (S12), and a duration of the inclination is counted (S13). The directions of the inclination are defined by "A" for the center, "B" for the left direction, "C" for the right direction, "D" for the up direction, and "E" for the down direction, as shown in FIG. 12, and the foregoing durations will be denoted by $t_A$, $t_B$, $t_C$, $t_D$, and $t_E$, respectively. The unit of time herein is a very small time unit, e.g., millisecond.

Subsequently, the push detector 36 detects an end of the push on the input key 10. The detection of the push end on the input key 10 is carried out by determining whether a duration $t_0$ of a non-conducting state after separation between the electrode 21 attached to the key top supported portion 20 and the electrode 31 attached to the key top supporting portion 30 exceeds a given value $T_0$ (>0) (S14). When the push on the input key 10 is not finished, the processes of S12 to S14 are continuously carried out. The determination on the duration of the non-conducting state is preferably carried out at very short time intervals, e.g., on the millisecond time scale.

When the push on the input key 10 is finished, the inclination direction detector 38 determines the inclination direction of the key top 220 as described below, from the values $t_A$ to $t_E$ of the durations in the inclination directions determined as described above, based on the decision table (S15).

First, a decision on a push in the center direction (a push in a state in which the key top 220 does not incline in either direction) is made as follows. Values of $r_{AB}=t_B/t_A$ and others are derived from the duration $t_A$ of the push in the center direction and the duration $t_B$ of the inclination in the left direction and others ($r_{XY}$ hereinafter refers to $t_Y/t_X$ (X, Y=any two of A to E). Using these values, it is determined that the push in the center direction was made, if the following conditions are satisfied, as in the decision table shown in FIG. 13.

(1) $t_A>T_A$ (2) $r_{AB}\leqq R_A$ and $r_{AC}\leqq R_A$ and $r_{AD}\leqq R_A$ and $r_{AE}\leqq R_A$ Here $T_A$ and $R_A$ are positive constant values. The condition of (1) indicates that the push in the center direction continues over the constant time. Therefore, $T_A$ is an appropriate value to assume a push. The condition of (2) indicates that the durations of inclination in all the directions are not more than the fixed ratio to the duration of the push in the center direction. Therefore, $R_A$ is preferably a value such as 0.05 (a duration of inclination in any direction is 5% of the duration of the push in the center direction). This condition is given for eliminating a chance of determining that some shake in the up, down, left, and right directions with the intension of the push in the center direction is an inclination in one direction.

Next, a decision on an inclination in one direction of the key top 220 during a push on the input key 10 is made as follows. A case of the inclination in the right direction will be described as an example. Just as in the above case, it is determined that the key top was inclined in the right direction, if the following conditions are satisfied, as in the decision table shown in FIG. 13.

(1) $t_C > T_C$ (2) $r_{AC} > \alpha$ (3) $r_{CB} \leqq R_C$ and $r_{CD} \leqq R_C$ and $r_{CE} \leqq R_C$ Here $T_C$, $\alpha$, and $R_C$ are positive constant values. The condition of (1) indicates that the inclination in the right direction continues over the constant time. Therefore, $T_C$ is set to an appropriate value to assume an inclination. The condition of (2) indicates that the duration of the inclination in the right direction exceeds the constant ratio to the duration of the push in the center direction. This is because the key top supported portion 20 is in contact with the key top supporting portion 30 even during the inclination of the key top 220 in any direction and the push in the center direction is also detected. Therefore, $\alpha$ is preferably a value of approximately 0.70 (the duration of the inclination in the right direction is 70% of the duration of the push in the center direction). The appropriate value of $\alpha$ differs depending upon the operation speed or the like from familiarity to the push operation. For this reason, $\alpha$ is preferably determined according to the operation speed or the like from familiarity to the push operation. The condition of (3) indicates that the durations of inclination in all the directions except for the right direction are not more than the constant ratio to the duration of inclination in the right direction. Therefore, $R_C$ is preferably set to a value of about 0.05 (the duration of inclination in any direction except for the right direction is 5% of the duration of inclination in the right direction). This condition is given for eliminating a chance of determining that some shake in the other directions with the intension of the inclination in the right direction is an inclination in one direction except for the right direction. The inclinations in the other directions are also determined in similar fashion.

Subsequently, the symbol determiner 40 determines a symbol to be inputted, based on the symbol conversion table as shown in FIG. 14, which is held in the assignment information holder 34, from the information about the detected direction and the input key 10 pushed (S16). For example, in a case where the detected direction is "right" and where the input key 10 pushed is "key 10*a*", the symbol to be inputted is determined to be "ゝ", based on the symbol conversion table corresponding to the key 10*a* as shown in FIG. 14.

Subsequently, the symbol determiner 40 outputs the symbol thus determined (S17).

As described above, the input apparatus 200 of the present embodiment enables stabler input based on the inclination of the key top 220 around the axis on the key top supported portion 20 in the input key 10. This makes it feasible to substantialize the input apparatus 200 superior in terms of operability.

Figure 42:
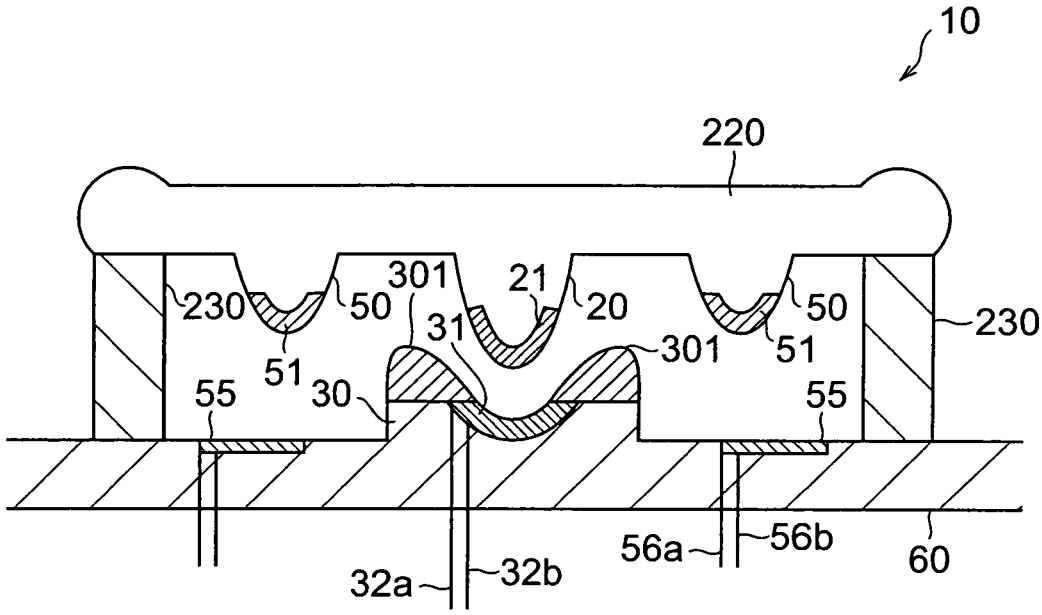
FIG. 42 is a vertical sectional view of an input key in another example in the fifth embodiment.
Figure 43:
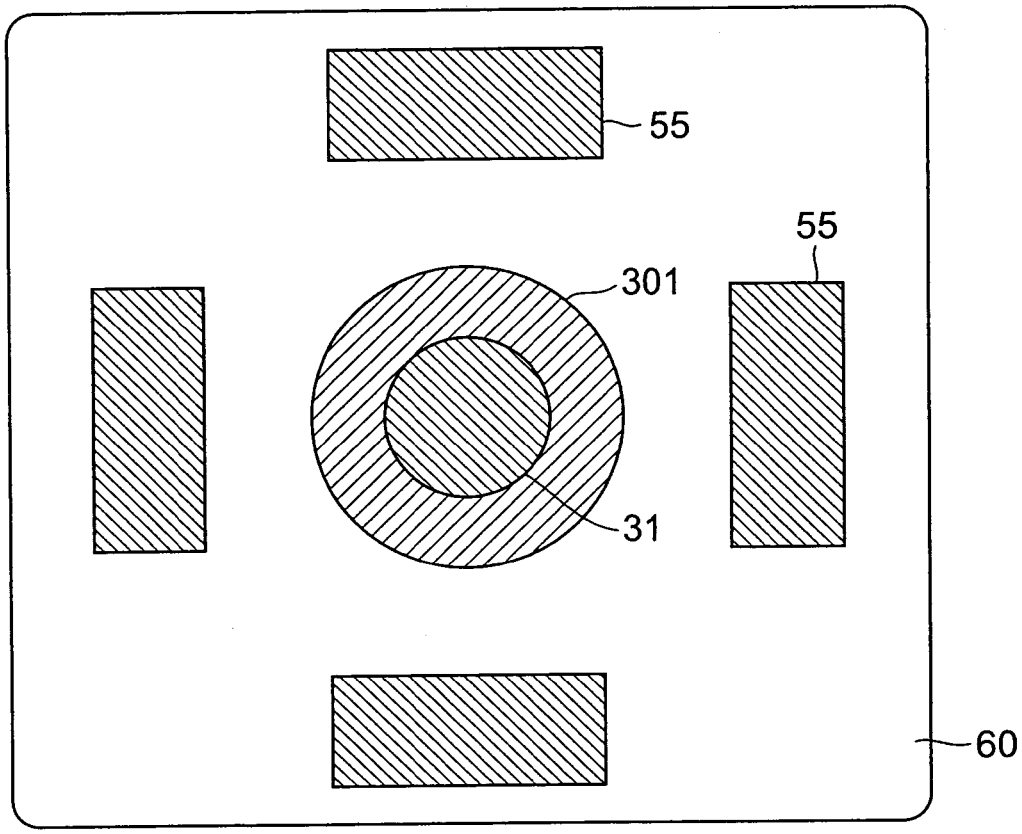
FIG. 43 is a plan view of a support plate in another example in the fifth embodiment.

In the present embodiment, as shown in the vertical cross section of the input key of FIG. 42 and in the plan view of the support plate of FIG. 43, a guard portion 301 bulging high so as to implement easier support of the key top supported portion 20 may be provided around the part to support the key top supported portion 20, in the key top supporting portion 30. In this configuration, in order to make the key top supported portion 20 securely supported on the key top supporting portion 30, the distal end of the key top supported portion 20 is arranged to be lower with respect to the plane of the support plate 60 than the distal end of the guard portion 301 in a state in which the input key 10 is not pushed. However, the height of the guard portion 301 should be determined so as to prevent the key top supported portion from hitting the guard portion 301 during inclination of the key top 220 to impede an inclination detector 50 from coming into contact with the support plate 60. The guard portion 301 is made of a material so hard as to function as a guard and, normally, may be made of a material similar to the support plate 60.

Figure 35:
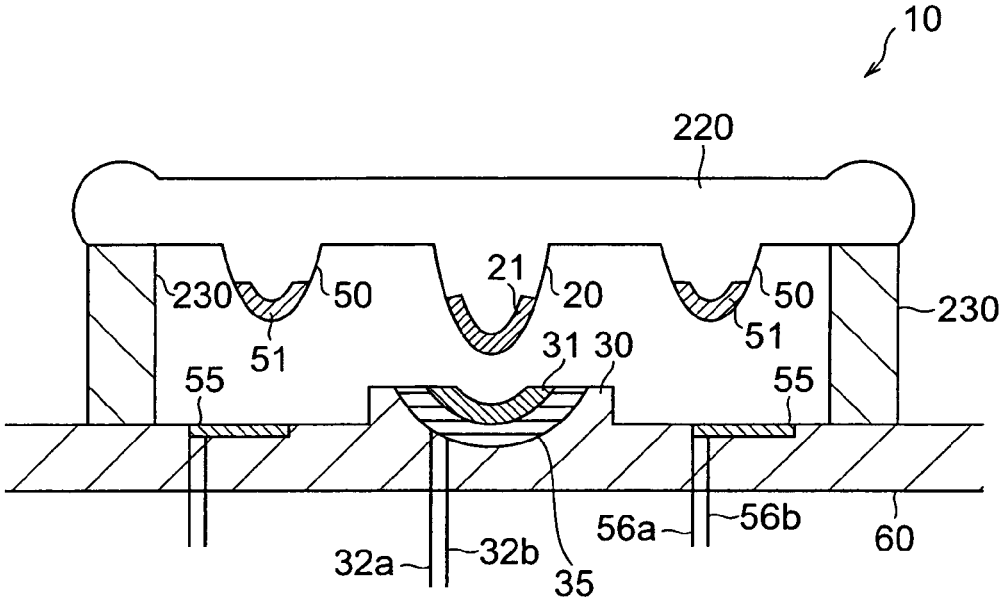
FIG. 35 is a vertical sectional view of an input key in another example in the fifth embodiment.

In the present embodiment, as shown in FIG. 35, the concave part 35 of the key top supporting portion 30 may be made of an elastically deformable material. In this configuration, when the key top 220 is pushed to bring the key top supported portion 20 into contact with the concave part, this part deforms in accordance with the shape of the convex part of the key top supported portion 20 depending upon the pressure of the push, so as to increase the contact area, thereby enabling securer detection of the push.

Figure 36:
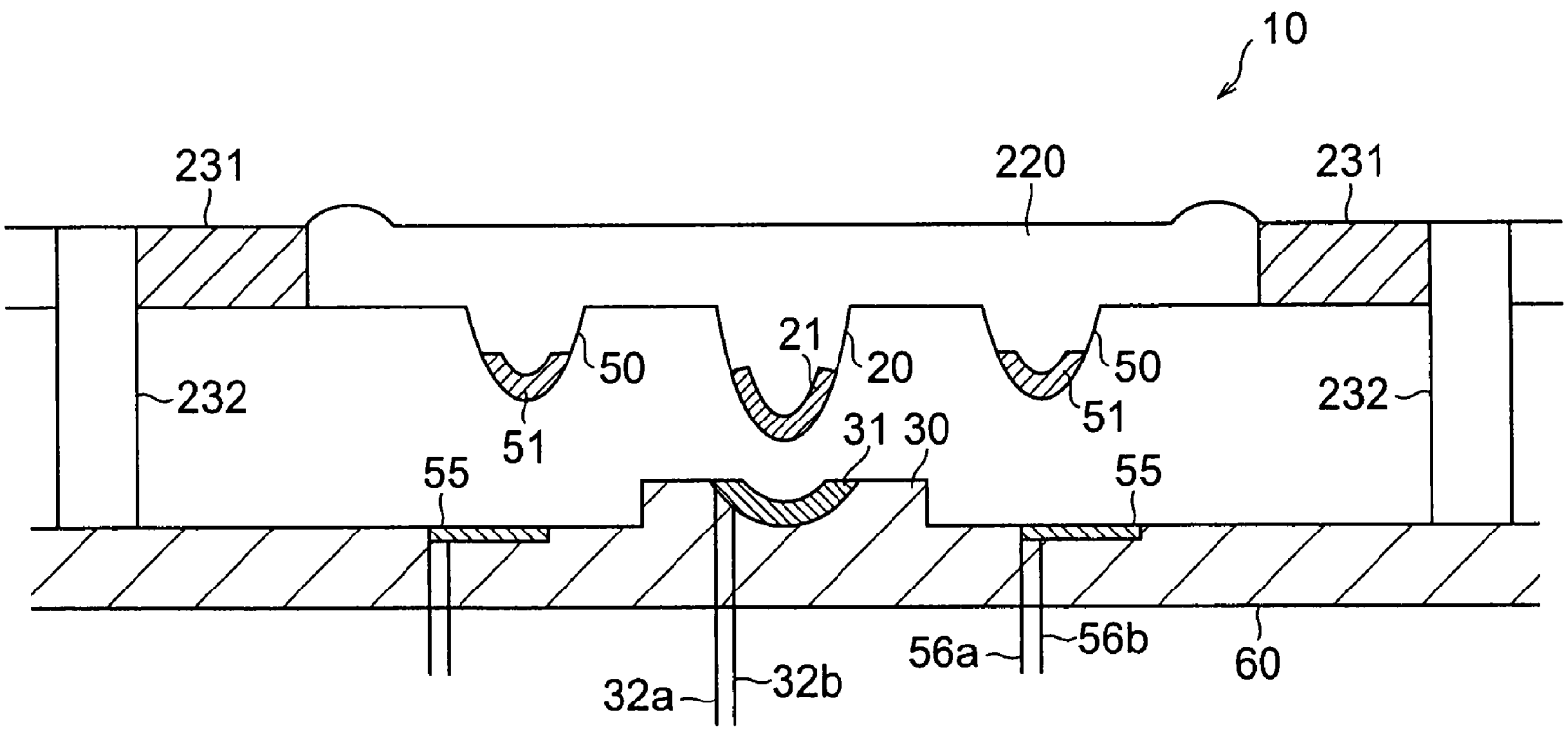
FIG. 36 is a vertical sectional view of an input key in another example in the fifth embodiment.

In the present embodiment, as shown in FIG. 36, it is possible to adopt a configuration wherein a key top periphery support 231 made of an elastically deformable material such as a spring, synthetic rubber, soft plastic, or soft vinyl horizontally supports the key top 220, instead of the key skirt 230.

Figure 37:
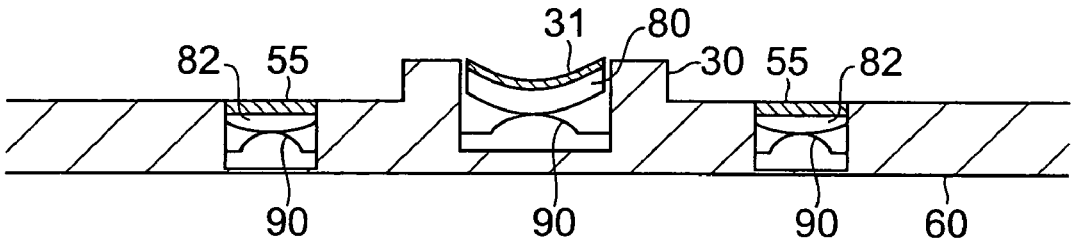
FIG. 37 is a vertical sectional view of a support plate in another example in the fifth embodiment.

In the present embodiment, as shown in FIG. 37, the key top supporting portion 30 of the support plate 60 and the portions to come into contact with the inclination detectors 50 may be configured using the piston and embossed structure. As shown in FIG. 37, the key top supporting portion 30 is constructed in such structure that a piston 80 having a part to come into contact with the key top supported portion 20 is made in a concave shape and that an embossed structure portion 90 made of an embossed sheet or the like is placed below the piston 80. Each of the portions to come into contact with the inclination detectors 50 is also configured of a piston 82 and an embossed structure portion 90 similar to the above.

The above configuration permits the user to have a "click feel" from the instantaneous dent and strong restoring force of the embossed structure portion 90 via the piston 80, 82.

Figure 44:
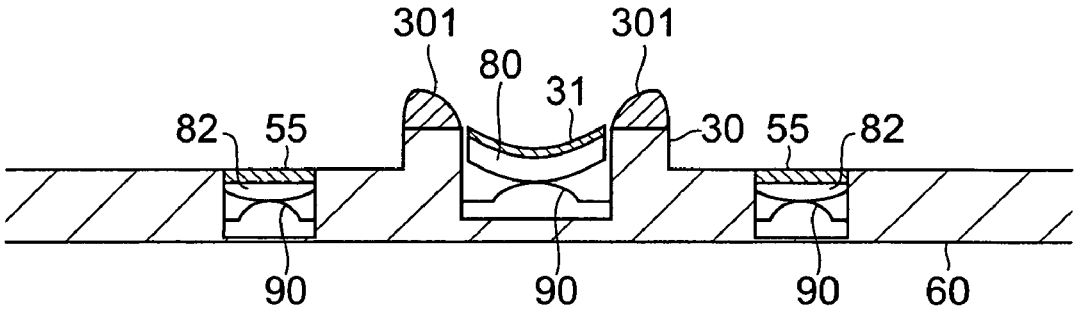
FIG. 44 is a vertical sectional view of a support plate in another example in the fifth embodiment.

Furthermore, as shown in FIG. 44, a guard portion 301 bulging high so as to achieve easier support of the key top supported portion 20 may be provided around the part to support the key top supported portion 20, in the key top supporting portion 30.

In the present embodiment the push detector 36 and the inclination direction detector 38 are constructed separately from the input key 10, but they may be constructed integrally with the input key 10 as shown in FIG. 16.

The above system adopts the key input based on one symbol per push, but it is also possible to adopt continuous input of symbols based on continuation of a push state on the input key 10 as described below.

In the above-stated system, the inclination direction of the key top 220 was determined when the push on the input key 10 was finished, that is, when the duration $t_0$ of the non-conducting state exceeded the constant value $T_0$ (>0). Here the inclination direction is also determined if the following condition is satisfied.

$t_i > C_i$ (i=any one of A to E)

Here $C_i$ is a positive constant value and is an appropriate time enough to assume that the input key 10 was pushed, e.g., a value of two to several seconds. When the push state on the input key 10 further continues after satisfying the above condition, the inclination direction is determined every time the following condition is met.

$t_i > C_i + nDC_i$ (i=any one of A to E) (n=1, 2, . . . )

Here $DC_i$ is a positive constant value and value indicating an appropriate time enough to assume that a symbol was entered continuously twice or more times through the input key 10. Since that time is normally a time shorter than that of the first input, it is preferable to set $C_i > DC_i$.

As the inclination direction is also determined where the above conditions are met, the inclination direction of the key top 220 is determined in continuation of the push state, at appropriate intervals during the continuation, thus enabling the continuous input on the key.

Sixth Embodiment

Figure 38:
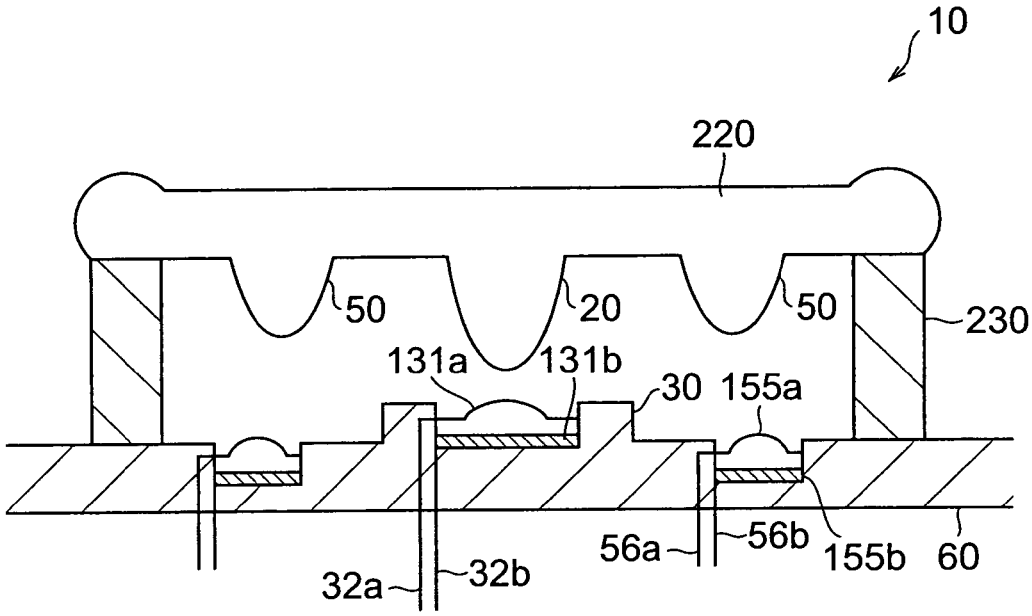
FIG. 38 is a vertical sectional view of an input key in the sixth embodiment.

FIG. 38 shows a vertical cross section of an input key 10 in the sixth embodiment. The exterior configuration and functional configuration of input apparatus 200, the flow of processing, etc. are similar to those in the fifth embodiment unless otherwise stated.

As shown in FIG. 38, the key top supported portion 20 is provided in the center on the opposite surface in the key top 220 to the support plate 60 and the inclination detectors 50 are provided in the respective directions of up, down, left, and right on the opposite surface. In the present embodiment, different from the fifth embodiment, each protruding portion is not provided with an electrode.

As shown in FIG. 38, the key top supporting portion 30 is provided on the support plate 60. The key top supporting portion 30 rises from the other part of the support plate 60 and is located with a clearance to the opposed part of the key top supported portion 20. The part of the key top supporting portion 30 to come into contact with the key top supported portion 20 is provided with an embossed structure portion 131*a* formed of an embossed sheet or the like, and an electrode 131*b* is located with a clearance below the embossed structure portion 131*a*. The embossed structure portion 131*a* is provided with an electrode and is constructed in a structure wherein when the key top 220 is pushed by force applied through the key top supported portion 20 to make the embossed structure portion 131*a* dented to the lower side, the electrode part comes into contact with the electrode 131*b* provided below. This contact brings the wiring line 32*a* connected to the electrode of the embossed structure portion 131*a* and the wiring line 32*b* connected to the electrode 131*b* provided below the embossed structure portion 131*a*, into an electrically conducting state through the electrodes, whereby the push detector 36 detects the conducting state and detects a push on the input key 10. Each of the portions in the support plate 60 to come into contact with the inclination detectors 50 is also constructed in a structure similar to the key top supporting portion 30, by an embossed structure portion 155*a*, an electrode 155*b*, and wiring lines 56*a*, 56*b*. A contact of an inclination detector 50 with the support plate 60 (a push on the support plate 60) is also detected in a manner similar to the above.

When the user pushes the input key 10, the key top is subject to reaction from the embossed structure portion 131*a* of the key top supporting portion 30 before the force of the push reaches a given level. Once the force applied exceeds the given level, the embossed structure portion 131*a* collapses at a stretch to become dented, so as to decrease the reaction at a breath. When the user pushes the input key 10 with a finger, the user can sense the decrease of the reaction at a fingertip. As the user lifts the finger from the input key 10, the embossed structure portion 131*a* gradually returns from the dented state of the central bulging portion to the original state to elevate the input key 10. When the embossed structure portion returns to a certain shape, the central bulging portion suddenly generates a strong restoring force to quickly increase the force to lift the input key 10. In the dented state of the embossed structure portion 131*a*, the line 32*a* and the line 32*b* are in the conducting state through the electrodes as described above to detect a push on the input key 10. When the central bulging portion of the embossed structure portion 131*a* recovers without force of the push, a non-conducting state is established, whereby an end of the push is detected.

In the dented state of the embossed structure portion 131*a* during a push on the input key 10, the key top supported portion 20 is supported by the embossed structure portion 131*a*, and thus the inclination of the key top 220 is made in a stable state in which the key top supported portion 20 in the supported state functions as a fulcrum.

The detection of inclination of the key top 220 is also carried out in a manner similar to the detection of the push, by the structure of the inclination detectors 50, and the portions of the support plate 60 to come into contact with the inclination detectors 50.

As described above, the input apparatus 200 of the present embodiment enables stabler input and permits the user to have a touch of a push and inclination of the key top 220, so called a "click feel".

Figure 45:
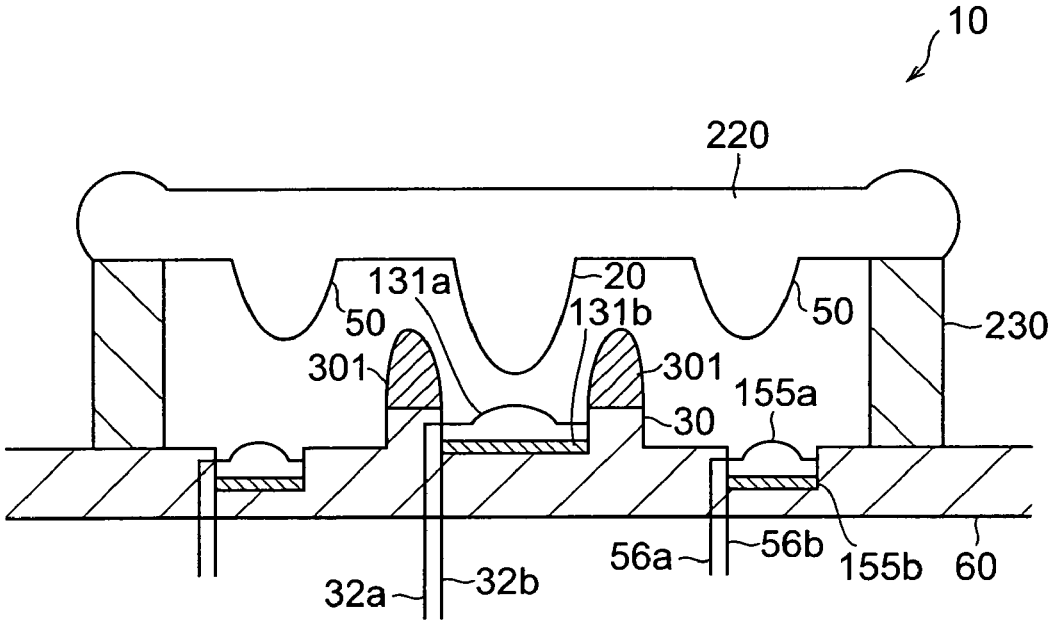
FIG. 45 is a vertical sectional view of an input key in another example in the sixth embodiment.

As shown in FIG. 45, a guard portion 301 bulging high so as to achieve easier support of the key top supported portion 20 may be provided around the part to support the key top supported portion 20, in the key top supporting portion 30.

Figure 46:
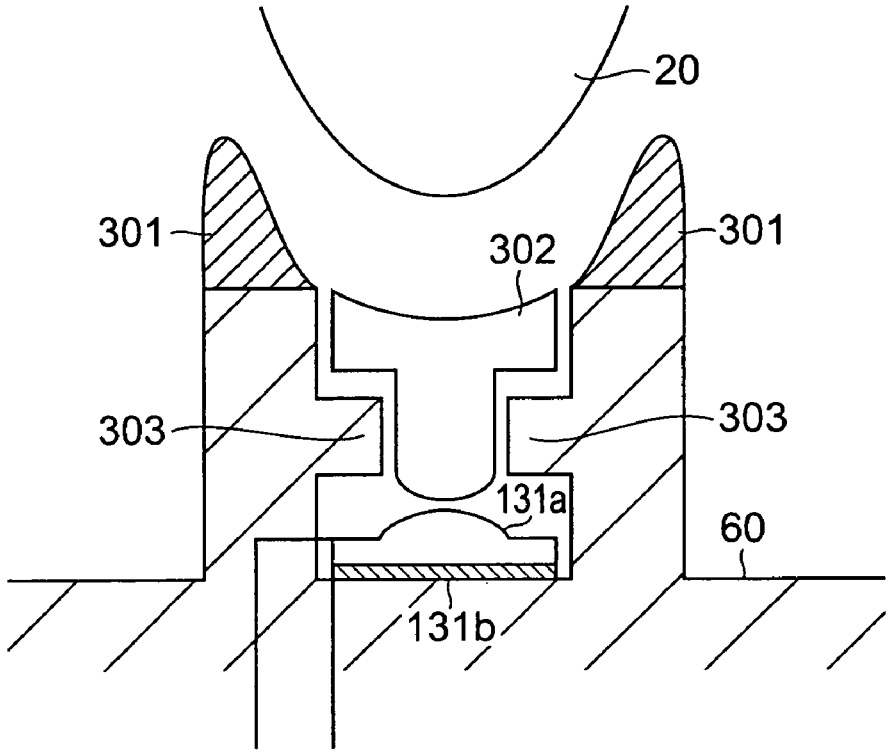
FIG. 46 is a vertical sectional view of a key top supporting portion in another example in the sixth embodiment.

As shown in FIG. 46, the part to push the embossed structure portion 131*a* may be constructed in a structure wherein the key top supported portion 20 pushes a piston 302 and the piston 302 thus pushed then pushes the embossed structure 131*a*. When this structure is provided with a stopper 303 against the piston 302, it can prevent excessive pressure from being exerted on the embossed structure portion 131*a*.

Seventh Embodiment

Figure 39:
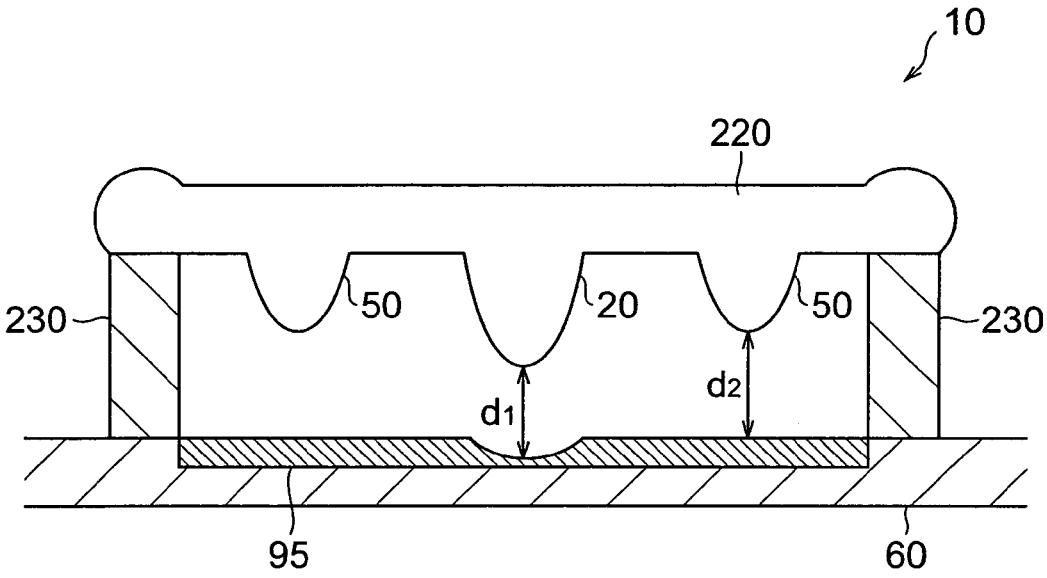
FIG. 39 is a vertical sectional view of an input key in the seventh embodiment.

FIG. 39 shows a vertical cross section of an input key 10 in the seventh embodiment. The exterior configuration and functional configuration of input apparatus 200, the flow of processing, etc. are similar to those in the fifth embodiment unless otherwise stated.

As shown in FIG. 39, the key top supported portion 20 is provided in the center on the opposite surface in the key top 220 to the support plate 60, and the inclination detectors 50 are provided in the respective directions of up, down, left, and right on the opposite surface. In the present embodiment, different from the fifth embodiment, each protruding portion is not provided with an electrode.

As shown in FIG. 39, a pressure detecting sheet 95 is attached onto the opposite surface in the support plate 60 to the key top 220. A plurality of piezoelectric devices are embedded in the pressure detecting sheet 95 so as to be able to detect pressure of contact when the key top 220 undergoes a push and inclination to bring the key top supported portion 20 and inclination detector 50 into contact with the support plate 60. This configuration enables detection of a push and inclination of the key top 220. In the support plate 60, the part opposed to the key top supported portion 20 is of a concave dent shape (this part corresponds to the key top supporting portion) and during a push on the key top 220 that part can support the key top supported portion 20. The support plate 60 itself is made of an elastically deformable material.

When the user pushes the key top 220, the key top supported portion 20 comes into contact with the pressure detecting sheet 95 to push the pressure detecting sheet 95. This push generates a voltage in a piezoelectric device in the pushed part buried in the pressure detecting sheet 95, and the push is detected by sensing the voltage.

Figure 40:
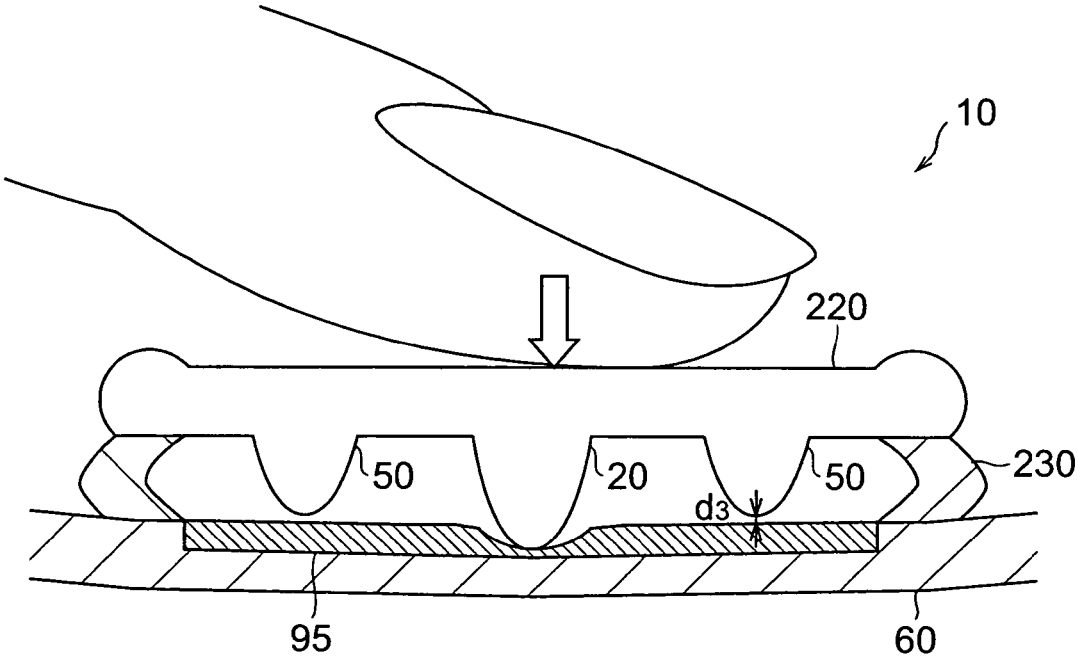
FIG. 40 is an illustration showing an example of a state during a push on an input key in the seventh embodiment.
Figure 41:
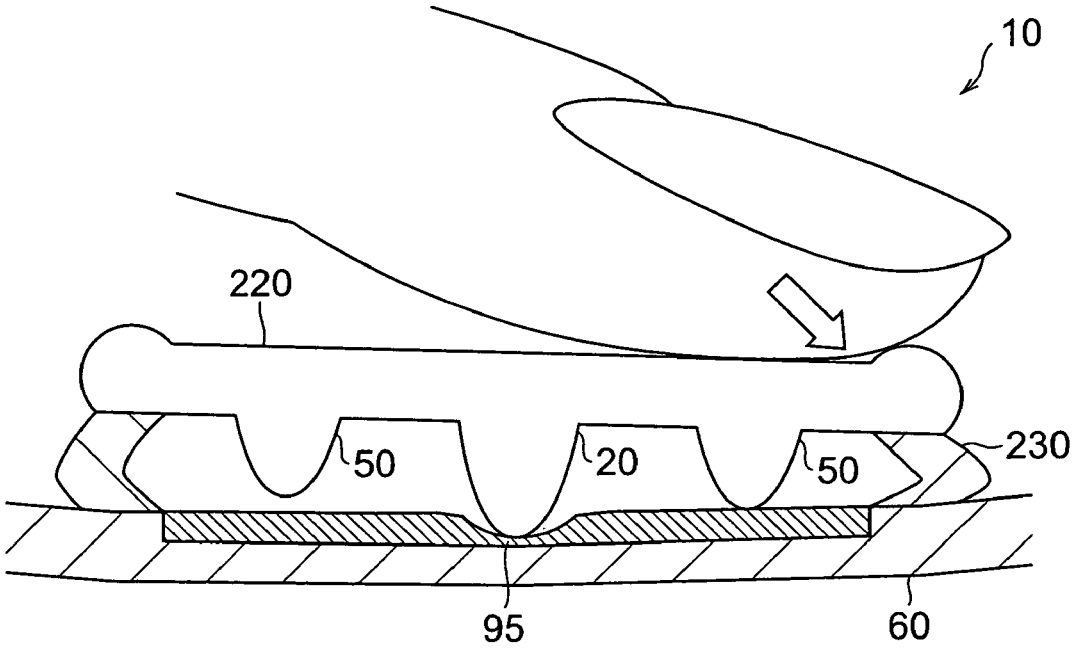
FIG. 41 is an illustration showing an example of a state during a push on an input key in the seventh embodiment.

Since the support plate 60 is made of an elastically deformable material, it deforms so as to be dented in the pushed part as shown in FIG. 40 when pushed by the key top supported portion 20. When deformed as described above, the distance $d_3$ between the inclination detectors 50 and the support plate 60 becomes smaller than the distance in a state in which the support plate 60 is not elastically deformed (i.e., the distance of $(d_2-d_1)$ in FIG. 39). Therefore, as shown in FIG. 41, the amount of inclination of the key top 220 becomes smaller to facilitate the inclination of key top 220. The inclination is made in a stable state in which the key top supported portion 20 supported in the concave dent part of the support plate 60, functions as an axis.

When the key top 220 is inclined to bring an inclination detector 50 into contact with the support plate 60, the inclination can be detected in a manner similar to the above by the pressure detecting sheet 95.

As described above, the input apparatus 200 of the present embodiment enables stabler input. The inclination of the key top 220 for information input becomes easier.

Figure 47:
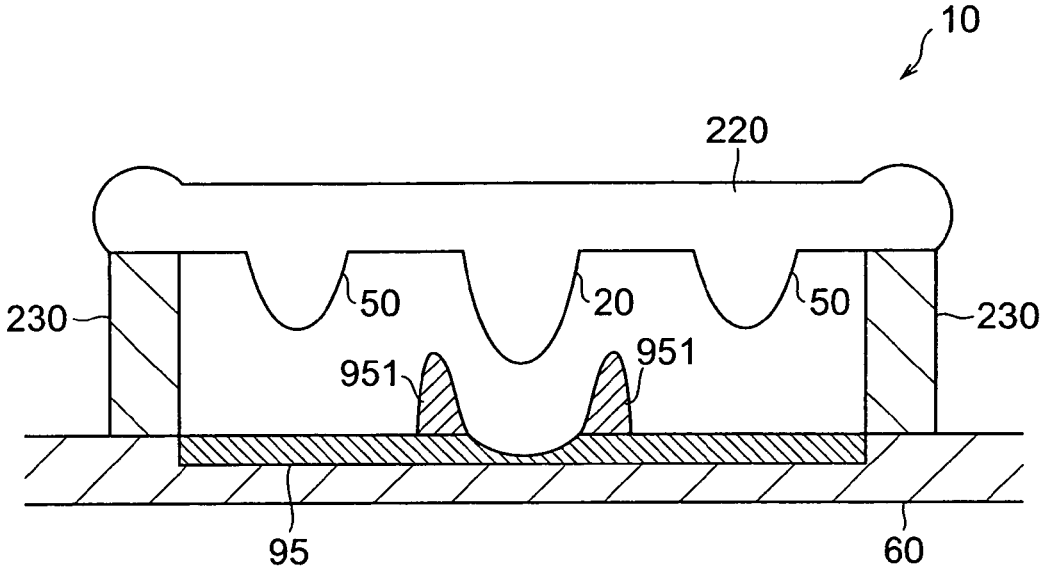
FIG. 47 is a vertical sectional view of an input key in another example in the seventh embodiment.

As shown in FIG. 47, a guard portion 951 bulging high so as to achieve easier support of the key top supported portion 20 may be provided around the part in the support plate 60 to support the key top supported portion 20.

Eighth Embodiment

The eighth embodiment will be described below as an embodiment wherein the inclination detectors of the input key according to the present invention form part of the opposite surface in the key top to the support plate and are comprised of a key-top-side slope portion formed so as to increase the distance to the support plate from the interior side to the exterior side.

Figure 56:
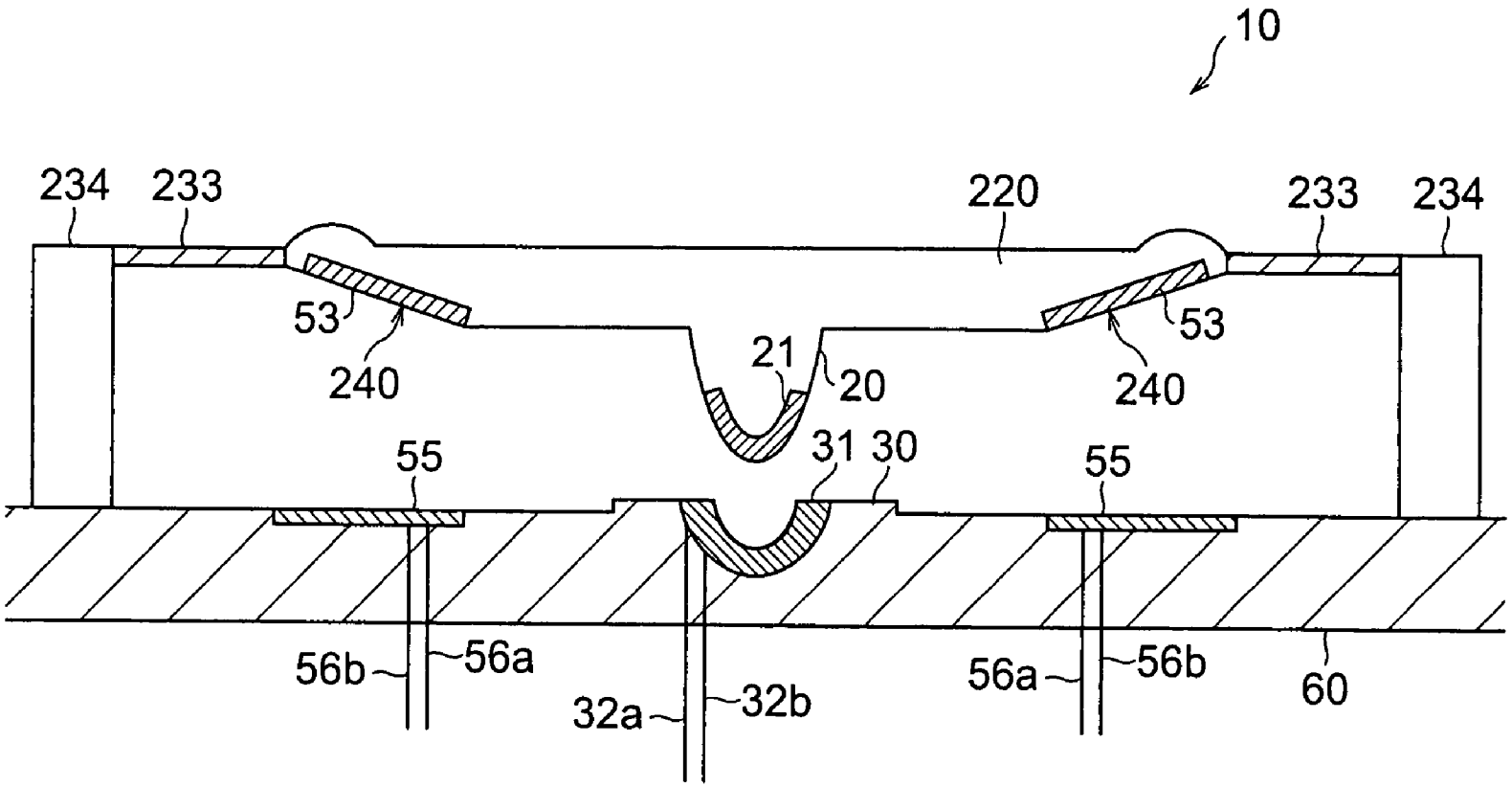
FIG. 56 is an illustration showing a vertical cross section of an input key in the eighth embodiment.

FIG. 56 shows a vertical cross section of an input key 10 in the eighth embodiment. As shown in this FIG. 56, an input key 10 is comprised of a key top 220, a column 234, a key top periphery support 233, a key top supported portion 20, and a key top supporting portion 30, and is provided on a support plate 60. Among these, the structure of the key top supported portion 20 and the structure of the key top supporting portion 30, electrode 55, and wiring lines 56*a*, 56*b* on the support plate 60 side are similar to those in the fifth embodiment. However, the inclination detectors according to the present invention are comprised of key-top-side slope portion 240 forming part of the opposite surface in the key top 220 to the support plate 60 and made in such a slope shape as to increase the distance to the support plate 60 from the interior side toward the exterior side. For example, electrodes 53 herein are set on the surface of this key-top-side slope portion 240.

The column 234 stands vertically to the support plate 60 and the peripheral part of the key top 220 is connected to the upper end of the column 234 through the key top periphery support 233. In this structure, the key top 220 is held with a constant clearance from the support plate 60 in a state in which no force is exerted on the key top 220.

Figure 57:
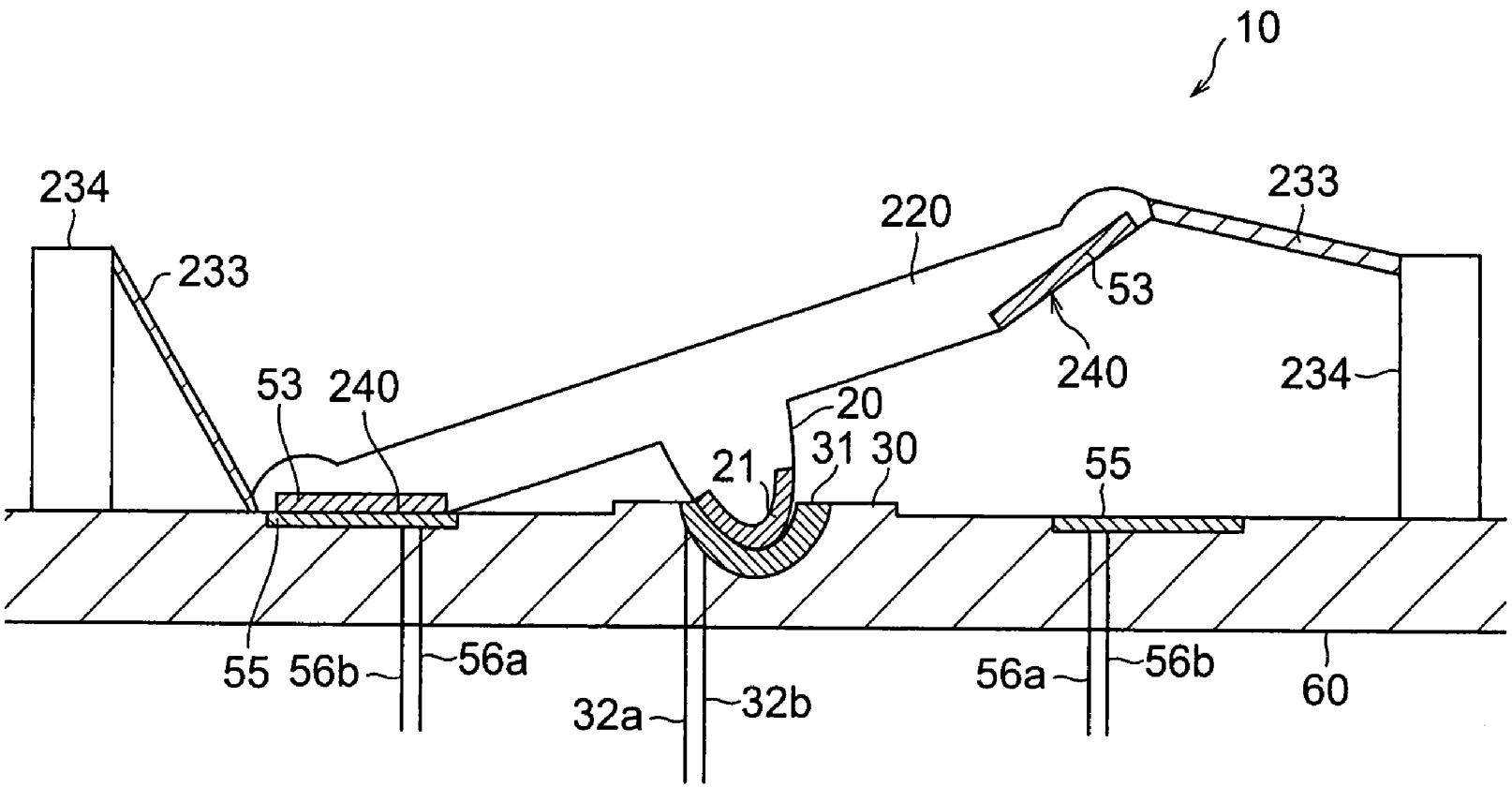
FIG. 57 is an illustration showing a state of a push on an input key in the configuration example of FIG. 56.

The key top periphery support 233 is made of an elastically deformable material, e.g., a spring, synthetic rubber, soft plastic, soft vinyl, or the like. For this reason, when the key top 220 is pushed in an arbitrary direction, as shown in FIG. 57, the key top periphery support 233 is elastically deformed to incline the key top 220 relative to the support plate 60 about an axis at a contact point between the key top supported portion 20 and the key top supporting portion 30, whereby an electrode 53 on the key-top-side slope portion 240 comes into electrical contact with an opposed electrode 55 on the support plate 60 side. The inclination direction of the key top 220 can be detected by detecting the electric contact between the electrode 53 on the key-top-side slope portion 240 and the electrode 55 on the support plate 60 side. The detection of the contact may be implemented by a method of placing a button, a switch, a piezoelectric device, a strain gage, or the like on one or both of the contact portions and detecting the contact thereby, besides the method of attaching the electrodes to the contact portions as described above.

Since the eighth embodiment as described above facilitates the contact with the opposed support plate 60 by provision of the key-top-side slope portion 240, it presents the effect of capability of surely carrying out the detection of contact through the use of electrodes 53, 55 or the like.

Figure 58:
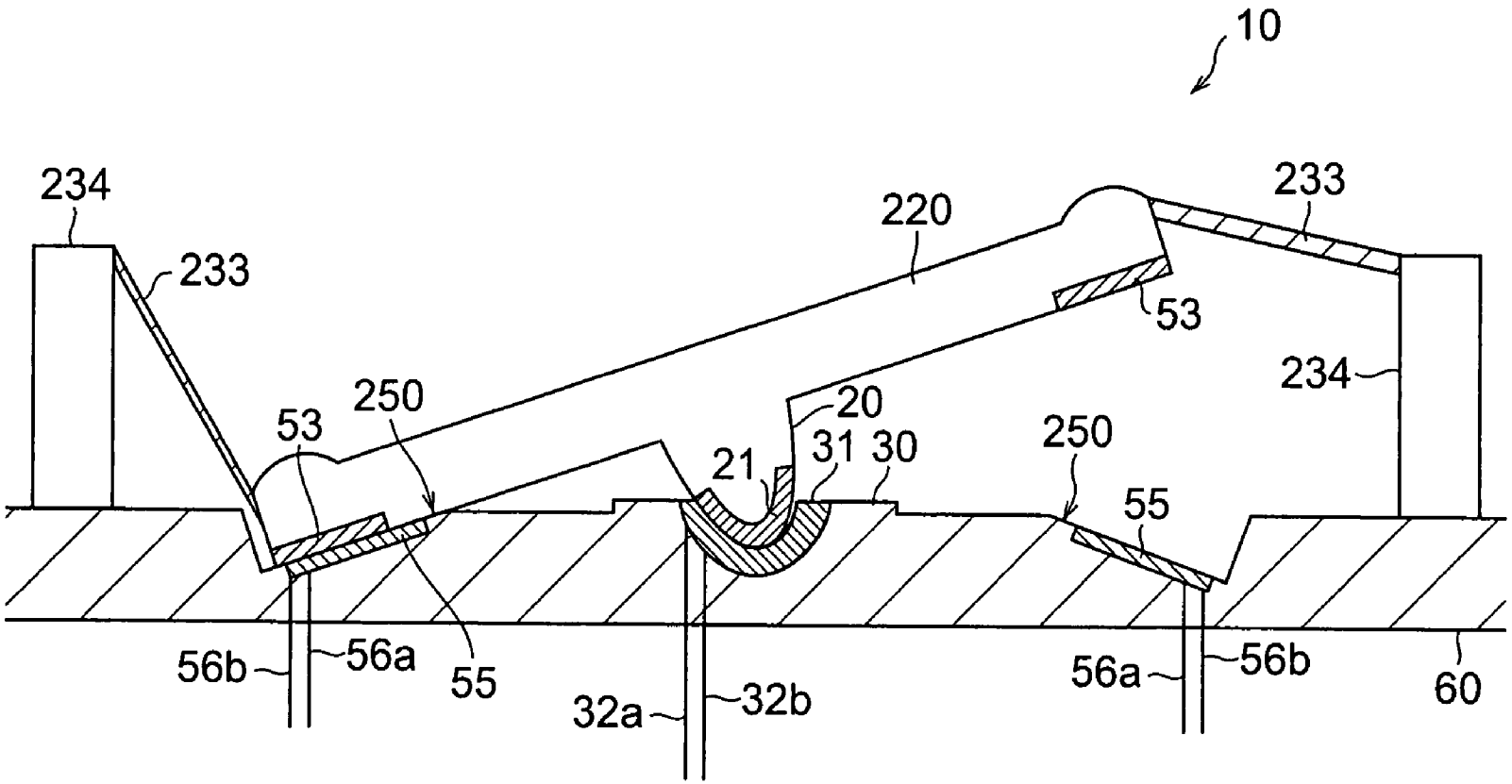
FIG. 58 is an illustration showing a state of a push on an input key in a modification example of FIG. 56.

The inclination detectors according to the present invention do not always have to be placed on the key top 220 side, but may be formed on the support plate 60 side as shown in FIG. 58. Namely, the inclination detectors may be comprised of a support-plate-side slope portion 250 constituting part of the opposite surface in the support plate 60 to the key top 220 and made in such a slope shape as to increase the distance to the key top 220 from the interior side toward the exterior side, with effect similar to that in the example of FIGS. 56 and 57.

Furthermore, the inclination detectors according to the present invention may be formed on both sides of the key top 220 side and the support plate 60 side. Namely, they may be comprised of slope portions formed in the slope shape on the respective sides of key top 220 side and support plate 60 side so as to increase the distance to the key top 220 and to the support plate 60 from the interior side toward the exterior side, with effect similar to that in the examples of FIGS. 56 to 58.

Figure 55:
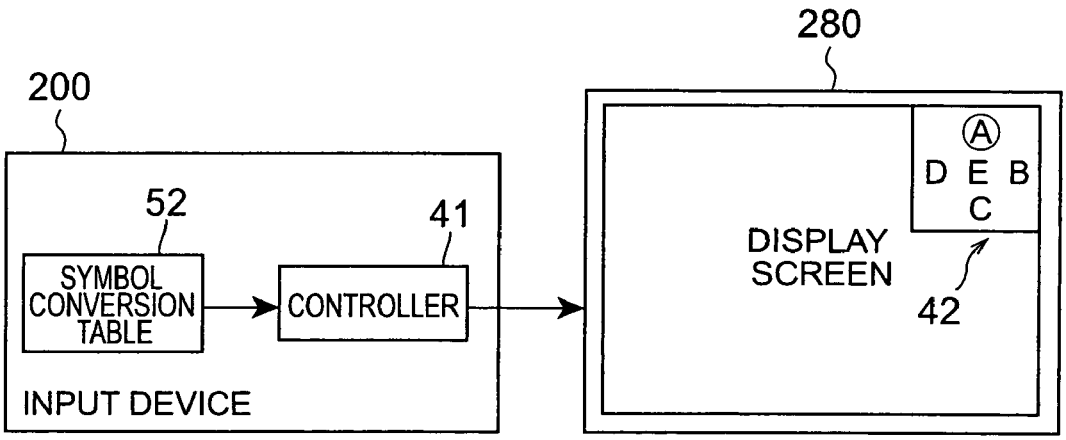
FIG. 55 is an illustration showing a configuration example provided with a feedback function to feed up-to-date information of conversion table back to a user.

Incidentally, each of the above embodiments is preferably configured to be able to feed the up-to-date information of the conversion tables about the input keys back to the user during the push operation on the input key by the user. A configuration with such feedback function of the up-to-date information of conversion tables to the user will be described below. As shown in FIG. 55, the input apparatus 200 is further provided with a controller 41, and during a push operation on an input key (i.e., during a period from a start of the operation on the key top to confirmation of operation settlement by a switch) the controller 41 outputs to the display screen 280 information of the conversion table 52 about the input key at that time (information assigned to each direction) to highlight the input candidate information corresponding to the push operation at the present time on the display screen 280. For example, like an image 42 shown at the upper right corner of the display screen 280, it is feasible to feed back to the user such information that symbols A to E are assigned to the respective directions and that symbol "A" highlighted by a circle is presently selected.

The feedback is desirably carried out, for example, at a time of a change in assignment of plural input information elements to the input keys according to frequencies of use or the like, or at timing immediately after manipulation of the F key 162 in FIG. 48 (i.e., immediately after a mode changeover of symbol input) even without any change in assignment, and this achieves the three effects below.

Namely, (1) in the case of a change in assignment of symbol information or the like to the input keys according to frequencies of use or the like, the user can check the up-to-date assignment information in the image 42 at the upper right corner of the display screen 280 during a push operation on the input key. (2) For example, in the case where the input mode is switched from the input mode of the Japanese hiragana writing symbols to the alphabet input mode, the user can check the up-to-date assignment information of the different input mode, which is not easily indicated by only the display on the key top, in the image 42. Furthermore, (3) the user can also check in the image 42 the information as an input candidate corresponding to a push operation at that moment (information selected at the present time). This feedback function of the up-to-date assignment information can dramatically improve easiness and certainty of the user operation.

The disclosure of Japanese Patent Application No. 2004-24165 filed Jan. 30, 2004 including specification, drawings and claims, the disclosure of Japanese Patent Application No. 2004-24193 filed Jan. 30, 2004 including specification, drawings and claims, and the disclosure of Japanese Patent Application No. 2004-294230 filed Oct. 6, 2004 including specification, drawings and claims are incorporated herein by reference in its entirety.

What is claimed is:

1. An input key which is assigned a plurality of information items to be inputted, comprising:

a key top which can incline relative to a support plate for supporting the input key;

a key top supported portion provided on an opposite surface in the key top to the support plate and arranged to be pushed together with the key top;

a key top supporting portion provided on the support plate, and arranged to come into contact with the key top supported portion during a push on the key top and to support the key top supported portion so as to permit the key top to incline in a state of the contact with the key top supported portion;

at least one inclination detector provided in a direction assigned one of the information items to be inputted, on an opposite surface in the support plate to the key top or on the opposite surface in the key top to the support plate;

push detecting means for detecting a push on the input key; and inclination direction detecting means for detecting an inclination direction of the key top when the push detecting means detects a push on the input key.

2. The input key according to claim 1, wherein the inclination detector is of such a protruding shape as to facilitate contact with the surface opposite to the surface where the inclination detector is provided, and wherein the inclination direction detecting means detects the contact of the inclination detector with the opposite surface to detect the inclination direction of the key top.

3. The input key according to claim 1, wherein the inclination detector is comprised of one or two out of:

a key-top-side slope portion forming a part of the opposite surface in the key top to the support plate and formed so as to increase distance to the support plate from the interior side toward the exterior side; and a support-plate-side slope portion forming a part of the opposite surface in the support plate to the key top and formed so as to increase distance to the key top from the interior side toward the exterior side; and wherein the inclination direction detecting means detects contact of the inclination detector with the opposite surface to detect the inclination direction of the key top.

4. The input key according to claim 1, further comprising a key top periphery supporting portion formed of an elastically deformable material and arranged to support a peripheral portion in the key top so as to keep the distance substantially constant between the key top and the support plate.

5. The input key according to claim 1, wherein the inclination detector is provided on the opposite surface in the key top to the support plate, and wherein when the key top is inclined during a push on the key top, the key top supported portion comes into contact with the key top supporting portion to be supported by the key top supporting portion and the inclination detector comes into contact with the support plate.

6. The input key according to claim 1, wherein the inclination detector is provided on the opposite surface in the support plate to the key top, and wherein when the key top is inclined during a push on the key top, the key top supported portion comes into contact with the key top supporting portion to be supported by the key top supporting portion and the inclination detector comes into contact with the key-top-side opposite surface or with the key top supported portion.

7. The input key according to claim 1, wherein one of the key top supported portion and the key top supporting portion is of a convex shape and the other is of a concave shape.

8. The input key according to claim 1, wherein contact detecting means for detecting contact is placed on both or either one of the inclination detector, and a surface with which the inclination detector comes into contact during an inclination of the key top, and wherein the inclination direction detecting means detects the contact of the inclination detector with said surface by the contact detecting means to detect the inclination direction of the key top.

9. The input key according to claim 1, wherein the support plate is formed of an elastically deformable material.

10. The input key according to claim 1, wherein one portion or both portions in at least one combination out of combinations of portions to come into contact with each other inside the input key during a push on the input key are of an embossed structure.

11. An input apparatus for input of information through at least one input key assigned a plurality of information items to be inputted, comprising:

an input key comprising: a key top which can incline relative to a support plate for supporting the input key; a key top supported portion provided on an opposite surface in the key top to the support plate and arranged to be pushed together with the key top; a key top supporting portion provided on the support plate, and arranged to come into contact with the key top supported portion during a push on the key top and to support the key top supported portion so as to permit the key top to incline in a state of the contact with the key top supported portion; and at least one inclination detector provided in a direction assigned one of the information items to be inputted, on an opposite surface in the support plate to the key top or on the opposite surface in the key top to the support plate;

assignment information holding means for holding assignment information of each of the information items to be inputted, according to an inclination direction of the key top of the input key;

push detecting means for detecting a push on the input key;

inclination direction detecting means for detecting an inclination direction of the key top when the push detecting means detects a push on the input key; and information determining means for determining an information item to be inputted, based on the inclination direction detected by the inclination direction detecting means and the information held in the assignment information holding means and fed according to the inclination direction.

12. The input apparatus according to claim 11, further comprising controlling means for, during a push operation on an input key, outputting assignment information of a plurality of input information elements to the input key at a time of the push operation, to an external display device and for making the display device highlight information of an input candidate corresponding to the push operation at the time out of the plurality of input information elements.

* * * * *